US012276126B2

(12) United States Patent
Girard

(10) Patent No.: US 12,276,126 B2
(45) **Date of Patent: *Apr. 15, 2025**

(54) PORTABLE MULTI-HINGED SHELTER

(71) Applicant: Mark Timothy Girard, Darwin, MN (US)

(72) Inventor: Mark Timothy Girard, Darwin, MN (US)

( * ) Notice: Subject to any disclaimer, the term of this patent is extended or adjusted under 35 U.S.C. 154(b) by 349 days.

This patent is subject to a terminal disclaimer.

(21) Appl. No.: 17/866,494

(22) Filed: Jul. 16, 2022

(65) Prior Publication Data

US 2023/0151633 A1 May 18, 2023

Related U.S. Application Data

(60) Provisional application No. 63/280,027, filed on Nov. 16, 2021.

(51) Int. Cl.
*E04H 15/06* (2006.01)

(52) U.S. Cl.
CPC ..... *E04H 15/06* (2013.01)

(58) Field of Classification Search
CPC ..... E04H 15/06
See application file for complete search history.

(56) References Cited

U.S. PATENT DOCUMENTS 2,054,673 A * 9/1936 Hastings ..... E04H 15/06 135/88.13
3,006,353 A * 10/1961 Richardson ..... E04H 15/06 135/96
4,088,363 A * 5/1978 Palmer ..... B60P 3/341 135/88.13
6,017,081 A * 1/2000 Colby ..... B60P 3/341 296/168
6,802,327 B2 * 10/2004 Koss ..... E04H 15/38 296/159
11,371,255 B2 * 6/2022 Frederickson ..... B60J 7/1621

* cited by examiner

*Primary Examiner* — David R Dunn
*Assistant Examiner* — Danielle Jackson
(74) *Attorney, Agent, or Firm* — Michael A. Mochinski

(57) ABSTRACT

A portable multi-hinged shelter for housing one or more individuals and storing gear commonly associated with outdoor excursions and like activities, which includes a box frame mounted atop of and connected to an open cargo bay of a vehicle and fitted with a secondary shelter shell and a supportive wind wall removably attached to the box frame and pivotally connected to a lower wind wall and sideward arms of a moveable frame assembly. The moveable frame assembly further includes primary and secondary canopies pivotally connected to the sideward arms and a ground brace pivotally connected to the primary canopy that collectively accept and support attachment of a primary shelter shell, whereby multiple pairs of linear actuators operating in unison and connecting to and interacting with select structural aspects of the supportive wind wall and moveable frame assembly yields automated expansion and contraction of the moveable frame assembly respectively for occupancy and compact transport alongside the vehicle.

30 Claims, 33 Drawing Sheets

150
150a
150c
150b
152
148b
148
126
126b
126c
132
50a
134
128
132a
132d
136a
136c
130c
130
130a
130b
124
162
140
134c
134d
138
136b
142b
142a
146
160
148a
124a
124b
126a
132b
132c
138a
138c
126c
134e
126d
134
134c
50
162a
86
A
150
150a
150c
156
148d
154
148
148c
120

150
158a
150d
158
158
156b
154a
156a
154
156
154d
156d
152
160
154c
160a
154b
156c
148c
148b
A 124
132
132d
134a
136a
136
134
138a
136b
162
134b
138b
142
138
140
144d
144a
144
144b
86
144c

PORTABLE MULTI-HINGED SHELTER

CROSS-REFERENCE TO RELATED APPLICATIONS

This application claims the benefit of U.S. Provisional Application No. 63/280,027, filed Nov. 16, 2021, entitled "Multi-hinged Fishing Shelter," the disclosures of which, including all attached documents, are incorporated herein by reference in their entirety for all purposes.

FIELD OF THE INVENTION

The present invention is largely directed to a portable multi-hinged shelter for attachment to and operation with vehicles generally equipped with an open cargo bay or bed, such as a truck, a utility terrain vehicle (UTV), an all-terrain vehicle (ATV), or equivalent. More particularly, the portable multi-hinged shelter offers automated operation for expansion to form an enclosure for occupancy by multiple individuals and storage of cargo and the like and contraction to facilitate convenient self-storage on the vehicle for effectual transport to varying locations or destinations.

BACKGROUND OF THE INVENTION

Portable shelters or enclosures are often utilized in recreational activities such as ice fishing and camping to protect the enthusiast from the cold and sometimes harsh climatic conditions. Ice fishing, for example, is a popular and favorite outdoor sport or hobby held typically in northern regions of many countries with cold climatic conditions, often necessitating the need for some form of protective enclosure or shelter. Ice fishing in general involves catching fish from atop of an ice sheet formed on a body of water. Access to the aquatic environment that underlies the ice sheet is mainly achieved by drilling or cutting a hole through the ice sheet of sizable dimension to allow ample room for adequately accommodating passage of fish line, a fish catch of varying size and weight, and ancillary fishing equipment like that of a sonar fish finder without undue hinderance and difficulty. Some ice fishing enthusiasts or anglers desirably participate in the sport within the open environment so as take in the fresh air, while others may preferably reside within the comforts of an enclosure to protect them from the elements and harsh cold conditions.

Enclosures directed for this purpose may vary in type and size, with some being of the semi-permanent type fabricated from metal or wood to resemble a structured shed or shack and optionally fitted with wheels or skids to fulfill relocation relatively about the ice sheet as may be desired from time to time, whereas other types of enclosures may be extensively portable in nature. Portable shelters that often fulfill the enthusiastic angler's requirements are typically inexpensive, can accommodate one or more persons, albeit generally limited in number, lightweight for transport to and from the body of water, and incorporate features for quick assembly and disassembly so that one may desirably relocate the shelter coincident to the movement of feeding fish for attainment of the ultimate catch.

The construct of and features associated with portable fishing shelters are recognized in the art to vary by some degree, but are generally represented by three basic design types: a pop-up tent, a rigid sled incorporating a flip-over tent, and a flip-over tent connectively adapted to a utility terrain vehicle (UTV) or equivalent.

As considered the most basic form of a portable fishing shelter, the pop-up tent fishing shelter is usually featured with similar components as one would find for a tent used in camping, absent an integrated floor structure. This type of the portable shelter typically includes a light-weighted assembly of flexible poles hingedly mounted to and extending from hubs to expand outwardly and forcibly act against an all-encompassing, water-proof fabric skin to rigidly form a structured enclosure suited for occupancy and containment of a minimal amount of fishing gear and the like. Although pop-tent shelters are rather inexpensive and light-weighted for carry and assembly by an individual fishing angler, they can be cumbersome in fulfilling the capability of transporting the desirable amount of fishing gear with that of the pop-up tent, in addition to the difficulty associated with setup, particularly in relation to embedding the requisite anchors within the ice sheet and connecting lines to structural aspects of the pop-up tent to consummate the assembly.

In an extended version or variation of the pop-up tent fishing shelter described above, the rigid sled with the flip-over tent type of fishing shelter incorporates within the structure of the sled a pair of sideward anchoring plates that offers mounting of one or more swinging canopy supports that selectively connect in part to an outer, waterproof skin and pivotally rotate relative to the anchoring plate to spatially expand and relocate the outer skin from within the confines of the sled to structurally form an enclosure for occupancy and containment of a limited amount of fishing gear. Like the pop-up tent fishing shelter, the canopy supports inherently possess capabilities to extend outwardly and forcibly act against the outer skin and lock in place to consummate the assembly. Although this type of fishing shelter conveniently offers onboard storage of the outer skin and associated canopy supports to admirably advance aspects portability for transport to the body of water and relocation relatively about the ice sheet at moment's notice, there is a tendency for premature wear and tear of operative components and hardware as well as calamitous opportunities for damaging fishing gear and sensitive equipment due to traversing over rough sheets of ice and mounds of snow, particularly if the sled is being transported behind a moving vehicle like that of a snowmobile or UTV and the like. Additionally, this type of fishing shelter, like that of the pop-tent type, is spatially limited for occupancy and storage of fishing gear, can be difficult for one to manage setup during adverse climatic and windy conditions, and with due consideration of its weight and overall bulkiness and sizable dimension, can be problematic for the individual user to load and unload the fishing shelter respectively into and from the vehicle, which, on most occasions, necessitates use of a truck or an equivalent type of vehicle offering sizable holding capacity.

Like the two previously described portable fishing shelters, the flip-over tent for UTV's utilizes a plurality of flexible canopy supports and an attachable stretchable fabric skin capable of being attached to and expanded outwardly from the UTV to form an enclosure, generally offering a minimal footprint with limited overall spatial capacity for comfortably accommodating multiple anglers and fishing gear. As with most designs of this type, the flexible canopy supports and attachable fabric skin typically collapse or fold together to attain a level of compactness for convenient storage within the spatial confines of a cargo bay or bed of the UTV, which in turn adversely limits the vehicle's onboard storage capacity for carrying fishing gear and ancillary necessities. Although this type of portable fishing shelter may possess practicality and convenience for most anglers, there still remains unresolved issues of utilizing flexible canopy supports that are inherently difficult to manage during adverse, climatic conditions and are prone to breakage. Furthermore, inadvertent jarring of the vehicle during travel and snow and ice unwantedly accumulating within the bed of the UTV may unduly compromise vital operating components of the flip-over tent as well as fishing gear that may accompany transport therewith.

Accordingly, there remains a need for a portable multi-hinged shelter that is adaptable for use with most vehicle types having an open cargo bay or bed and incorporates automated and structural components for readily forming a structural enclosure that sufficiently and comfortably accommodates one or more individuals and accompanying gear and attains a level of compactness for onboard storage on the vehicle without unduly compromising the vehicle's overall spatial capacity to stow and transport ancillary necessities and items typically relating to an outdoor excursion.

BRIEF SUMMARY OF THE INVENTION

In order to overcome the numerous drawbacks apparent in the prior art, a portable multi-hinged shelter has been devised for readily attaching to and conjunctively operating with a variety of vehicle types that generally incorporate an open cargo bay or bed, such as a truck, a utility terrain vehicle (UTV), an all-terrain vehicle (ATV), or equivalent.

It is an object of the present invention to provide a portable multi-hinged shelter that includes structural components operating conjunctively with powered linear actuators to readily fulfill expansion of an attachable fabric skin to form a protective enclosure for occupancy of one or more individuals and storage of accompanying gear and ancillary necessities, while equally possessing the capabilities to readily contract or fold together to attain a level of compactness for transport.

It is a further object of the present invention to provide a portable multi-hinged shelter that retains the onboard storage capacity of the vehicle so as adequately accommodate storage of accompanying gear and ancillary necessities without unduly compromising the comfort of passengers situated within the vehicle.

It is yet another object of the present invention to provide a portable multi-hinged shelter that is relatively simple in terms of design and construction and fabricated from corrosion resistant materials to sustain long-term use and operation in harsh climatic conditions.

It is yet another object of the present invention to provide a portable multi-hinged shelter that offers stowable bench seating for advancing comfort to individuals and ample storage capacity within the formed enclosure for immediate, convenient access to accompanying gear and ancillary equipment.

It is yet another object of the present invention to provide a portable multi-hinged shelter that consists of modular components for readily effecting repair and replacement of damaged or failed components.

It is a further object of the present invention to provide a portable multi-hinged shelter that is capable of being held within the height and width of the vehicle's dimensional relationship while in a folded, compact arrangement so as to afford unhindered travel into and out of a trailer, a garage, or other forms of storage accommodations.

In accordance with the present invention, a portable multi-hinged shelter has been devised to comfortably house one or more occupants and fulfill convenient and accessible storage of accompanying gear during outdoor excursions and like activity, the portable multi-hinged shelter includes a box frame mountably situated atop of sidewalls of an open cargo bay of a transport vehicle and connecting to a moveable frame assembly by way of a supportive wind wall that equally connects to a lower wind wall, the box frame further includes provisions for storage of items on one or more shelf platforms while maintaining a sufficient amount of loading capacity of the cargo bay and permits attachment of a secondary shelter shell for forming a protective enclosure, the moveable frame assembly further includes primary and secondary canopies and a ground brace that are individually capable of pivotal movement and permit attachment of a primary shelter shell, whereby multiple pairs of linear actuators connecting to and interacting with select structural aspects of the supportive wind wall and moveable frame assembly yields automated expansion and contraction of the moveable frame assembly respectively for occupancy and convenient transport alongside the vehicle without unduly hindering the vehicle's safe operation.

Other objects, features, and advantages of the present invention will become apparent in the following detailed description of the preferred embodiments thereof when read in conjunction with the accompanying drawings in which like reference numerals depict the same parts in the various views.

BRIEF DESCRIPTION OF THE SEVERAL VIEWS OF THE DRAWINGS

A preferred embodiment of the present invention will now be described by way of example with reference to the accompanying drawings, in which.

DETAILED DESCRIPTION OF THE INVENTION

Figure 1:
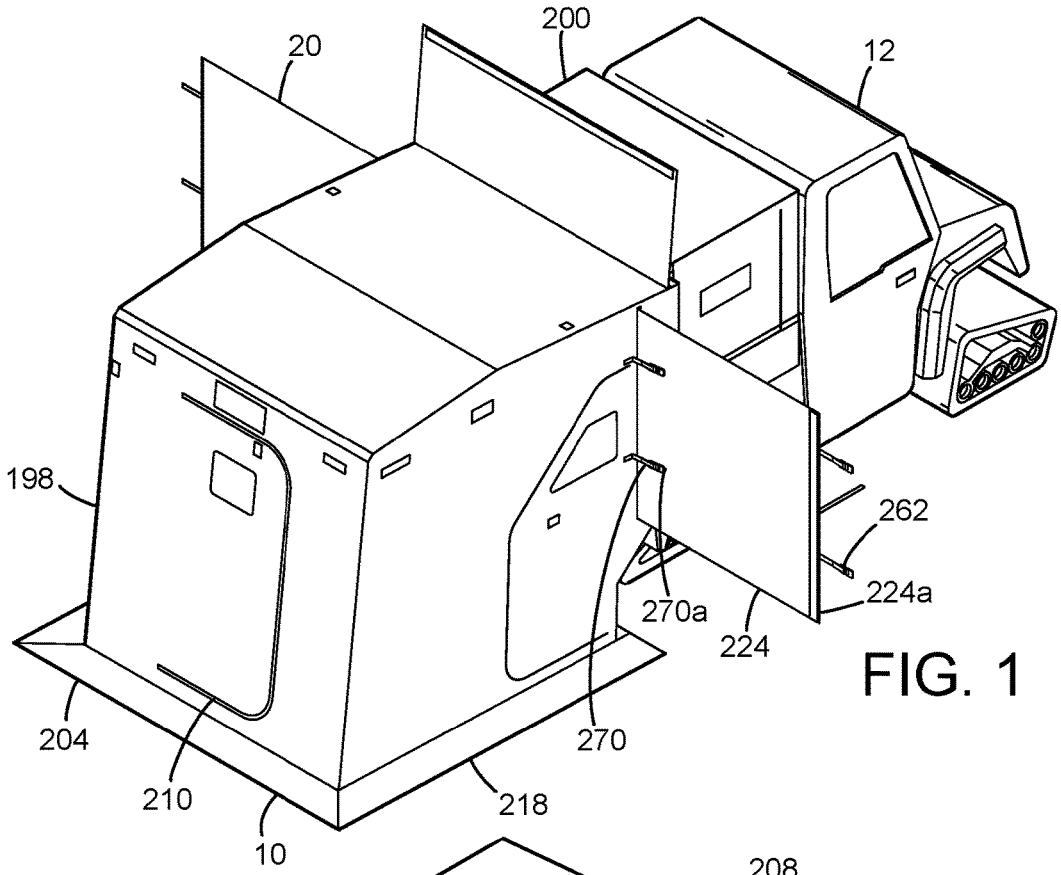
FIG. 1 is a rear perspective view of the preferred embodiment of the present invention illustrating a primary shelter shell joined to a secondary shelter shell collectively covering a box frame and moveable frame assembly and being attached to a vehicle.

While this invention is susceptible of being embodied in many different forms, the preferred embodiment of the invention is illustrated in the accompanying drawings and described in detail hereinafter with the understanding that the present disclosure purposefully exemplifies the principles of the present invention and is not intended to unduly limit the invention to the embodiments illustrated and presented herein. The present invention has particular utility as a portable shelter for outdoor excursions and like activities with structural features that advances automated assembly for immediate occupancy by one or more individuals and storage of accompanying gear and ancillary items, while equally possessing capabilities to attain a level of compactness for onboard, self-storage on a variety of vehicle types.

Referring now to FIGS. 1-4, there is shown generally at 10 a portable multi-hinged shelter in expanded form and mounted and attached to a vehicle 12 of the particular type equipped with an open cargo bay 12*a* or bed, with a portion of the portable shelter extending outwardly from a rearward end 12*b* of the vehicle to advance an increase in spatial capacity for comfortably accommodating one or more individuals and storage of accompanying equipment and related gear. As further shown therein, the portable multi-hinged shelter includes a protective shell assembly 14 semi-permanently attached to and exteriorly covering a box frame 16 and a moveable frame assembly 18, in addition to incorporating an integral assembly of flaps 20 suited to protectively wrap and encase the moveable frame assembly while presented in collapsible form, primarily in preparation for transport.

The box frame 16 in FIGS. 5-8 preferentially resides above the open cargo bay 12*a* and is configured to attach to sidewalls 12*c* substantially forming the cargo bay of the vehicle and includes four corner posts 22 generally extending vertically in alignment with the sidewalls and perpendicular to a bottom surface 12*d* of the open cargo bay, with each of the corner posts having a first end 22*a* and a second end 22*b* respectively connecting to upper horizontal members 24 and lower horizontal members 26 by way of a three-way connector 28. The three-way connector in particular is shown in FIGS. 9-14 to include an aperture 30 extending through each of the three walls 28*a* of the three-way connector for accepting therethrough a cap screw 32 or equivalent, with a threaded end 32*a* thereof being threadably inserted within a cylindrical bore 22*c*, 24*a*, 26*a* extending lengthwise about the corner post as well as of each of the upper and lower horizontal members. Accessible openings 34 supplement the three-way connector to allow access to and passage of the cap screw for advancing and consummating assembly. To promote proper alignment and positioning of the corner posts 22 with respect to the horizontal members 24, 26, the three-way connector as in FIGS. 11 and 12 incorporates within its structure an alignment member 36 extending outwardly from a backside 28*b* of each wall configured with the aperture for fitment within an open track 22*d*, 24*b*, 26*b* integrated within and extending lengthwise along each of the corner posts and horizontal members, generally formed within each as an extrusion. A corner cap 38 of the type depicted in FIGS. 13 and 14 encases the three-way connector, whereby connectivity is maintained by a pair of outward pins 40 that engage and snap in place within corners of an open side 28*c* of the three-way connector 28, while a pair of inversed grooved slides 42 engagingly mate with an equally configured pair of inversed grooved slides 44 integrated within the structure of the three-way connector's walls bearing the accessible openings.

As further depicted in FIGS. 15-18, the box frame 16 incorporates one or more intermediate members 46 to supplement its overall strength and rigidity and generally connect midway to each of the upper horizontal members 24 and lower horizontal members 26 as well as extending in between a pair of parallel upper horizontal members 48. Connection of the individual intermediate members in this regard may be advanced by a first common connective assembly 50 primarily comprising a cap screw 50*a* or equivalent passing into and fitting within a cross bore 24*c*, 26*c* extending perpendicularly through the upper and lower horizontal members, whereupon the cap screw's threaded end threadably engages a cylindrical bore 46*a* of the intermediate member 46.

Figure 17:
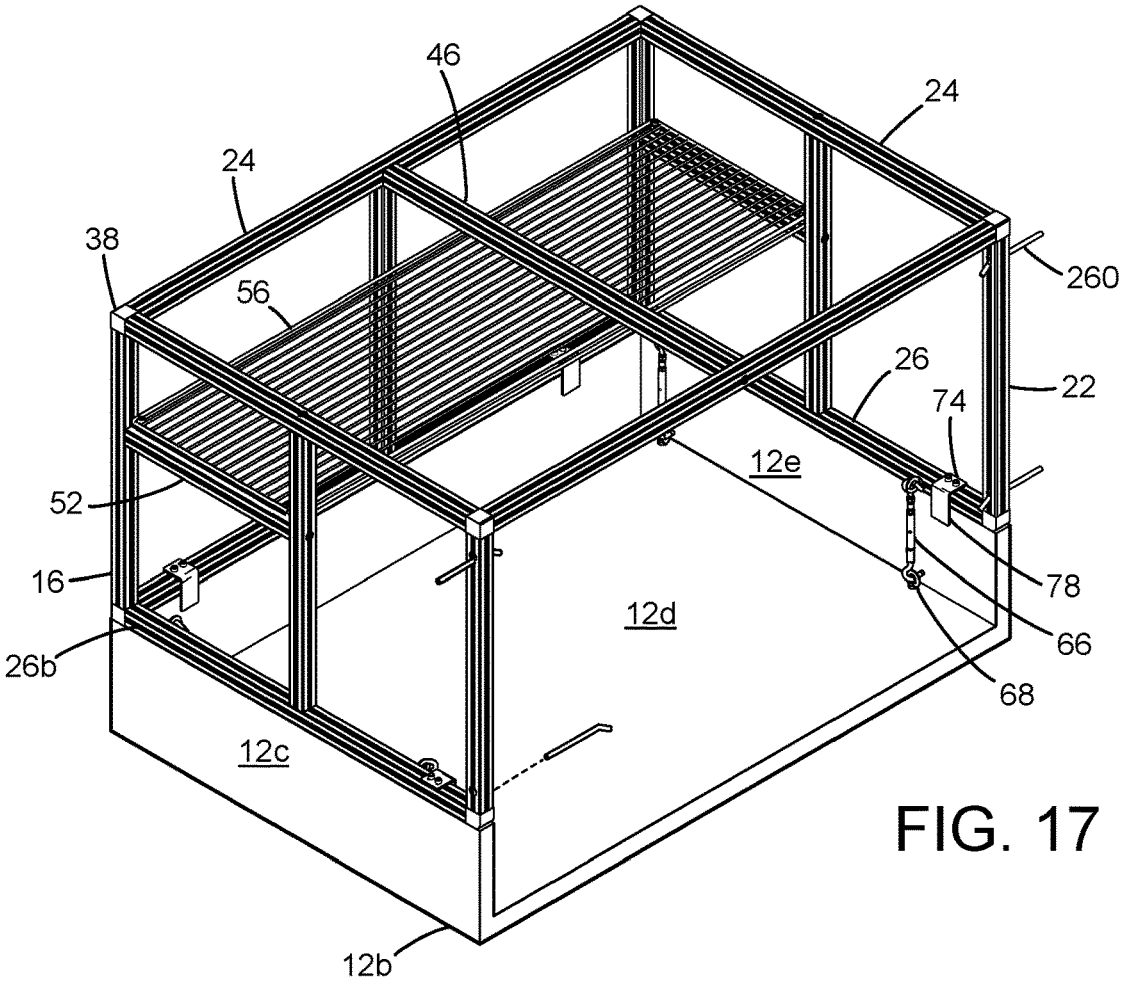
FIG. 17 is a top perspective view of the preferred embodiment of the present invention illustrating a box frame positioned atop of sidewalls of and mounted to an open cargo bay of a vehicle.
Figure 18:
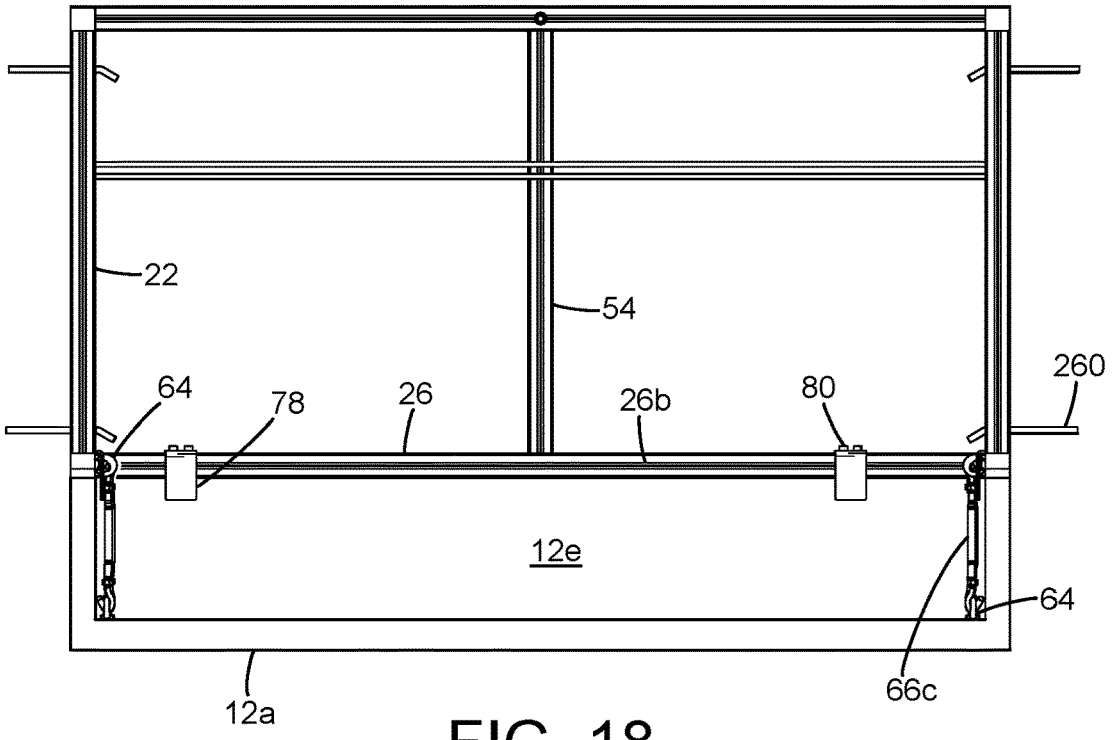
FIG. 18 is a rear elevational view of the preferred embodiment of the present invention illustrating a box frame mounted atop of an open cargo bay of a vehicle.
Figure 19:
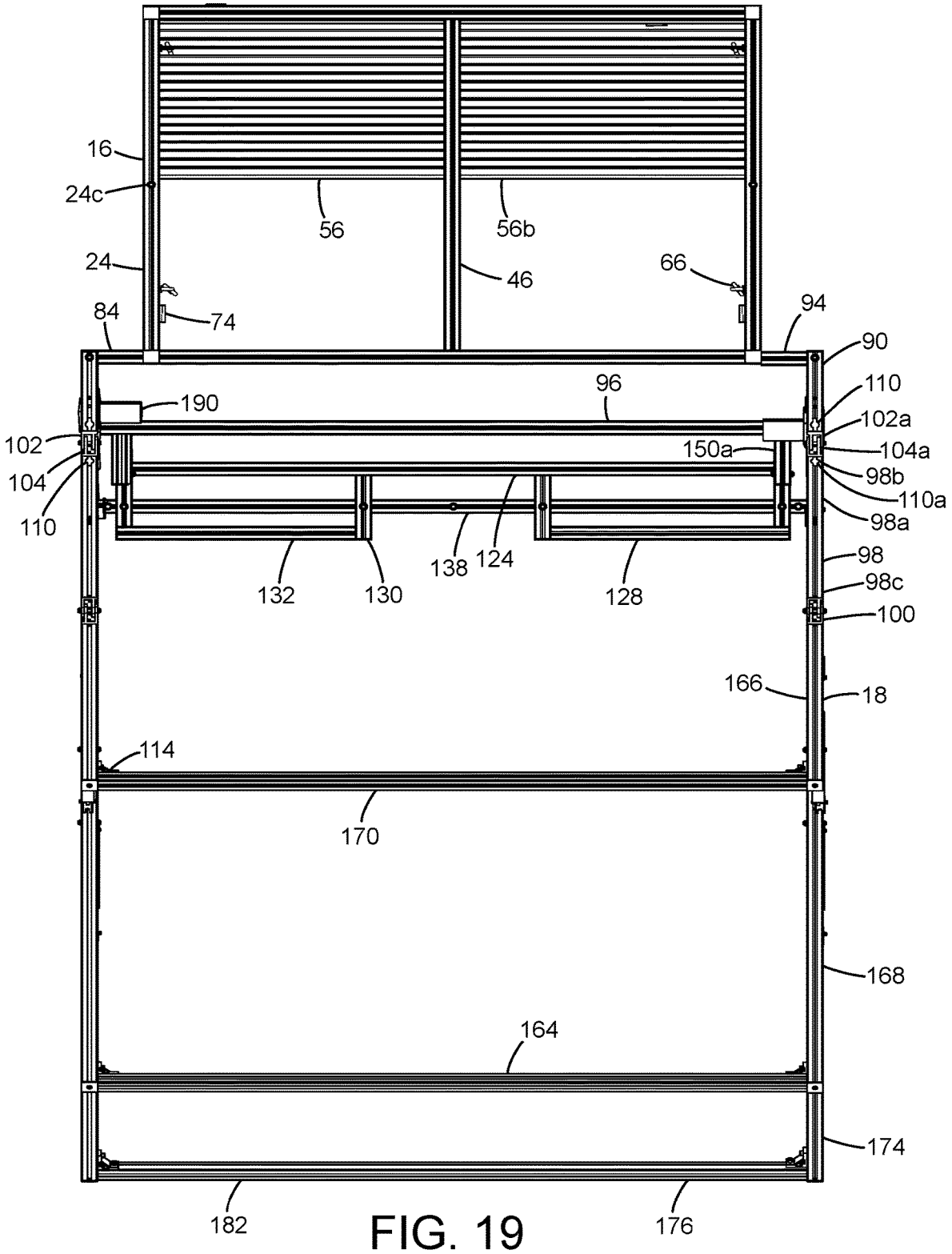
FIG. 19 is a top plan view of the preferred embodiment of the present invention illustrating a moveable frame assembly presented in expanded form and connecting to a box frame configured with a shelf platform.
Figure 20:
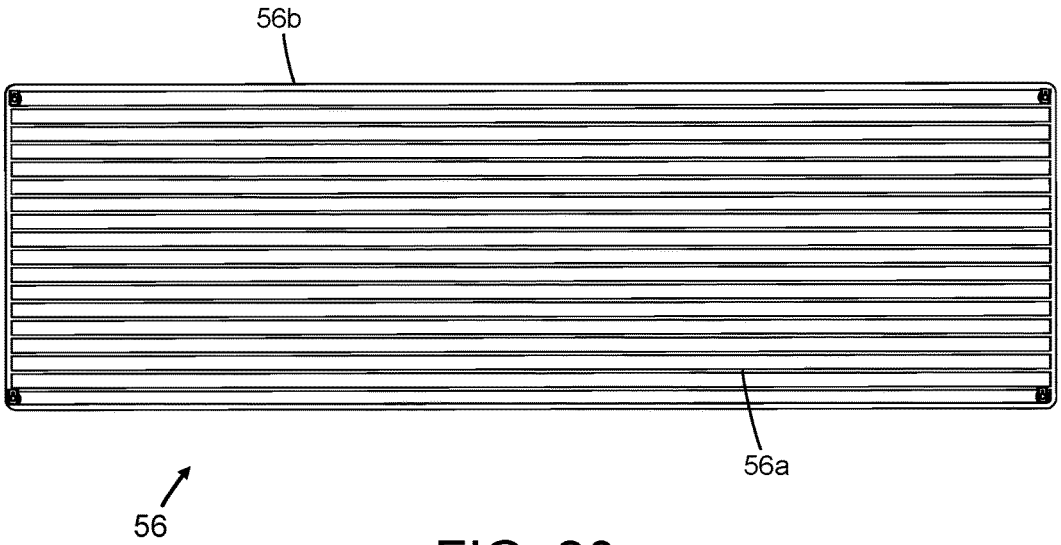
FIG. 20 is a top plan view of the preferred embodiment of the present invention illustrating a shelf platform.
Figure 21:
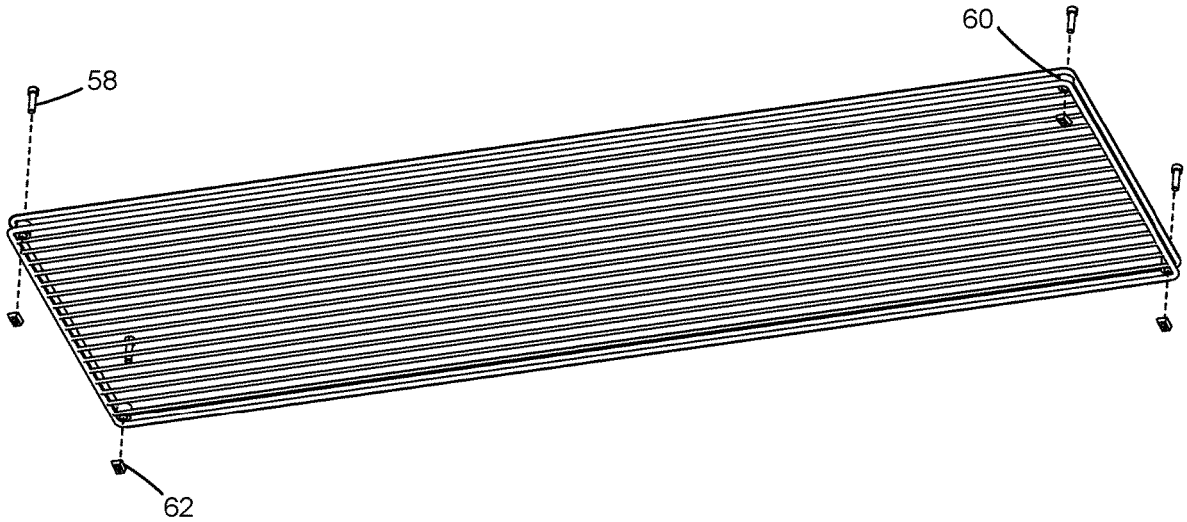
FIG. 21 is a bottom perspective view of the preferred embodiment of the present invention illustrating a shelf platform configured with cap screws and track nuts.

In some embodiments of the present invention, as represented in FIGS. 17 and 18, the box frame 16 may be fitted with an optional shelf system that fulfills expanded storage capabilities for items and the like interiorly within the confines of the portable shelter 10. In this regard, a pair of shelf supports 52 individually extend horizontally in between and connect to one of the four corner posts 22 and a vertically orientated intermediate member 54, generally in the manner shown in FIGS. 17-19. Connection is maintained by the first common connective assembly 50, whereby by individual cap screws 50*a* fit within a cross bore 22*e*, 54*a* respectively extending through the corner post and vertically orientated intermediate member and threadably engage and terminate within a cylindrical bore 52*a* of the shelf support 52. In completing assembly of the shelf system, a shelf platform 56 is illustrated in FIGS. 17 and 19 to extend to each of the mounted shelf supports 52 and attaches thereto by way of a cap screw 58 or equivalent fitting within a cylindrical sleeve 60 fixedly attached to each corner of the shelf platform. A track nut 62 of the type shown in FIGS. 20 and 21 includes an overall geometric shape that enables it to slidably pass into and within an open track 52*b* of the mounted shelf support 52 yet inhibits upward movement as the cap screw 58 is tightened to a specified torque setting. Although the construct of the shelf platform 56 may exist in numerous forms, practically adapting use of the types conventionally known in the art, it is preferably fabricated from a plurality of inner supports 56*a* spaced apart from one another and bounded by and connected at their ends to a supportive frame 56*b* so as to maintain passing of light from above-positioned light fixtures that may be used within the interior of the portable shelter 10. In some installations, where it is desired to increase the supportive strength of the shelf platform for heavily-weighted items, a stacked arrangement of shelf platforms may be aptly connected together by way of the cylindrical sleeves 60, typically in the manner depicted in FIG. 21.

Figure 22:
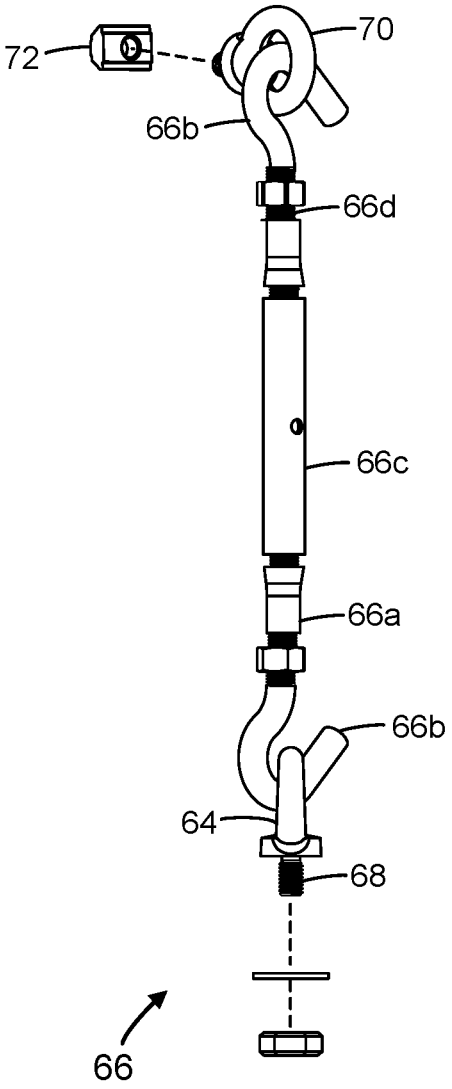
FIG. 22 is a side elevational view of the preferred embodiment of the present invention illustrating a turnbuckle having connective hooks configured to engage eye bolts.
Figure 23:
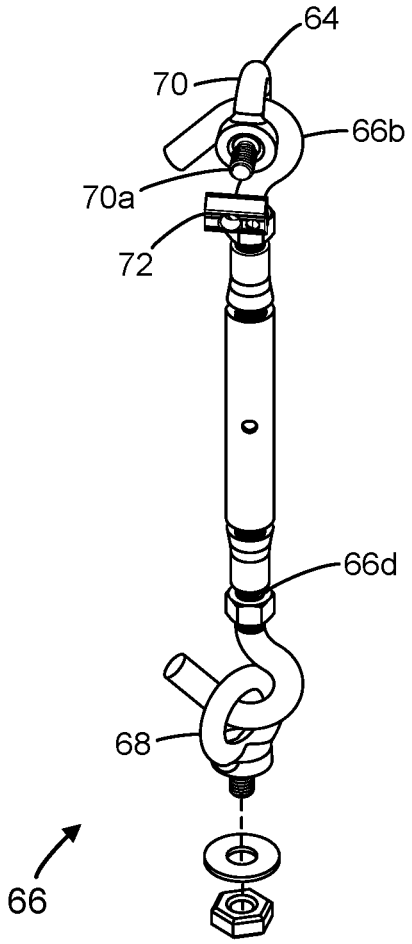
FIG. 23 is a top perspective view of the preferred embodiment of the present invention illustrating a turnbuckle having connective hooks configured to engage eye bolts.

As illustrated in FIGS. 17, 22 and 23, the box frame 16 is preferentially attached to the vehicle's cargo bay 12*a* by way of an assembly of eye bolts 64 and multiple turnbuckles 66 of the type generally recognized in the art for such applications, with each of the turnbuckles having a pair of ends 66*a* individually configured with a connective hook 66*b* or equivalent and a tensioning mechanism 66*c* operating conjunctively with threaded stem portions 66*d*, whereby turning of the tensioning mechanism clockwise or counterclockwise respectively shortens or lengthens the effective length of the turnbuckle. In fulfilling attachment of the turnbuckles 66 to the box frame, one end bearing the connective hook 66*b* engages a lowermost eye bolt 68 fixedly mounted to the open cargo bay's bottom surface, whereas the other, companion connective hook is configured to engage an uppermost eye bolt 70 extending outwardly from and connecting to one of the lower horizontal members 26. Adjustability of the eye bolt along the lower horizontal members is fulfilled by the capabilities of a track nut 72 slidably fitting within the open track 26*b*, whereas a threaded portion 70*a* of the eye bolt passes into and threadably engages the track nut to consummate a secured arrangement, as generally depicted in FIGS. 22 and 23.

Figure 24:
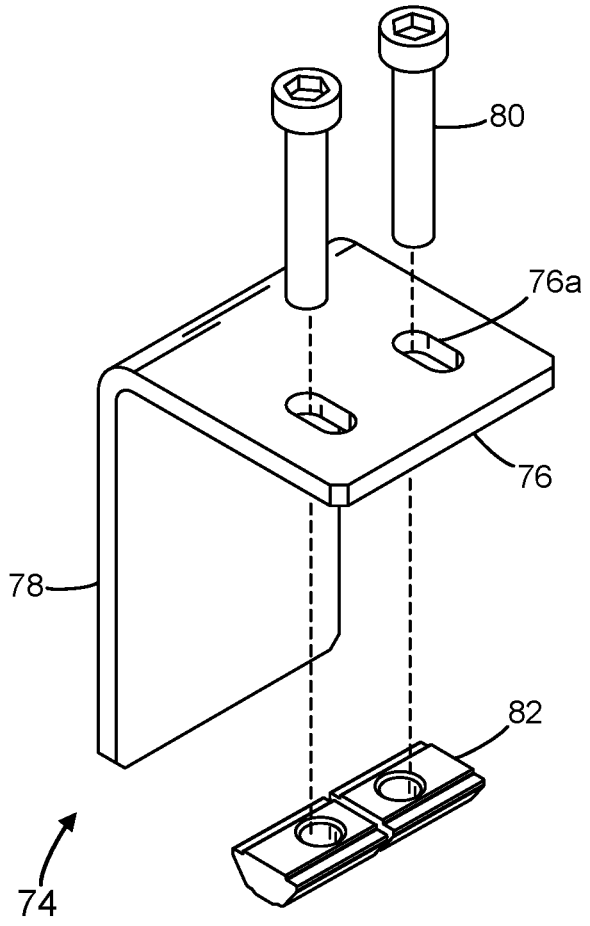
FIG. 24 is a top perspective view of the preferred embodiment of the present invention illustrating an alignment plate having a top planar element integrally connecting to a sideward planar element.
Figure 25:
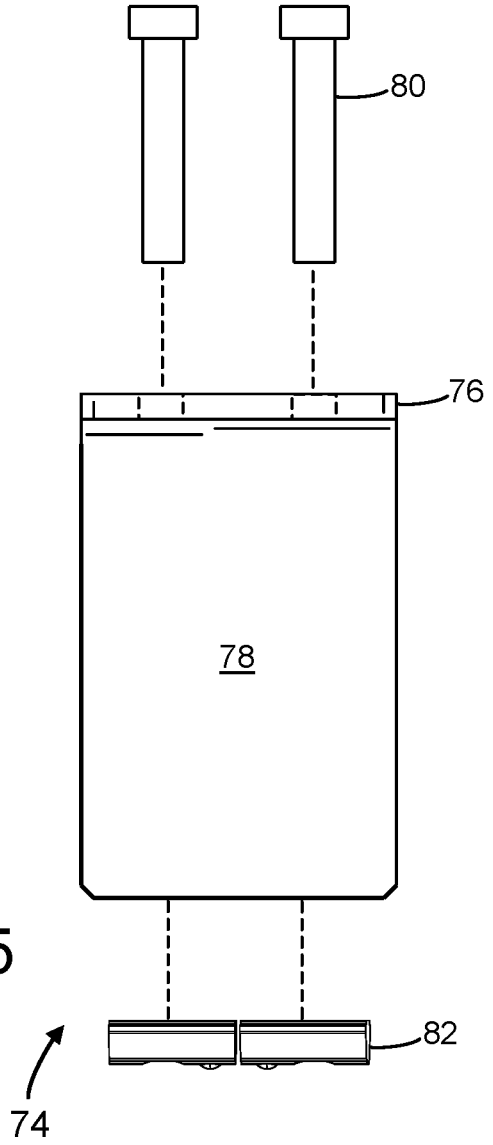
FIG. 25 is a front elevational view of the preferred embodiment of the present invention illustrating an alignment plate designated for use with a pair of cap screws and track nuts.

In further association with the box frame 16, a plurality of alignment plates 74 may be employed to ensure proper orientation and alignment of the box frame relative to the open cargo bay 12*a* while positioned atop the sidewalls 12*c* thereof. As can be seen in FIGS. 24 and 25, each alignment plate includes a top planar element 76 integrally connecting to and being perpendicularly orientated to a sideward planar element 78, where the top planar element is configured to sit atop of and engage the lower horizontal member with the sideward planar element being situated to simultaneously abut against the horizontal member and an inner wall surface 12*e* of the cargo bay's sidewall. Moveability and securement of the alignment plates relative to and along the lower horizontal member 26 is furthered by an assembled arrangement of a cap screw 80 passing into an aperture 76*a* extending through the top planar element 76 where it is allowed to threadably engage a track nut 82 capable of sliding along the open track 26*b* of the lower horizontal member 26 and being tightened to fulfill securement of the alignment plate.

Now in reference to FIGS. 26-30, the portable shelter 10 is further associated with a supportive wind wall 84 possessing structural features for connecting the box frame 16 to the moveable frame assembly 18 as well as supporting connectivity of a lower wind wall 86 that supplementally serves to establish seating interiorly for one or more occupants with provisions for storage as well as being stowed for transportational purposes.

Figure 26:
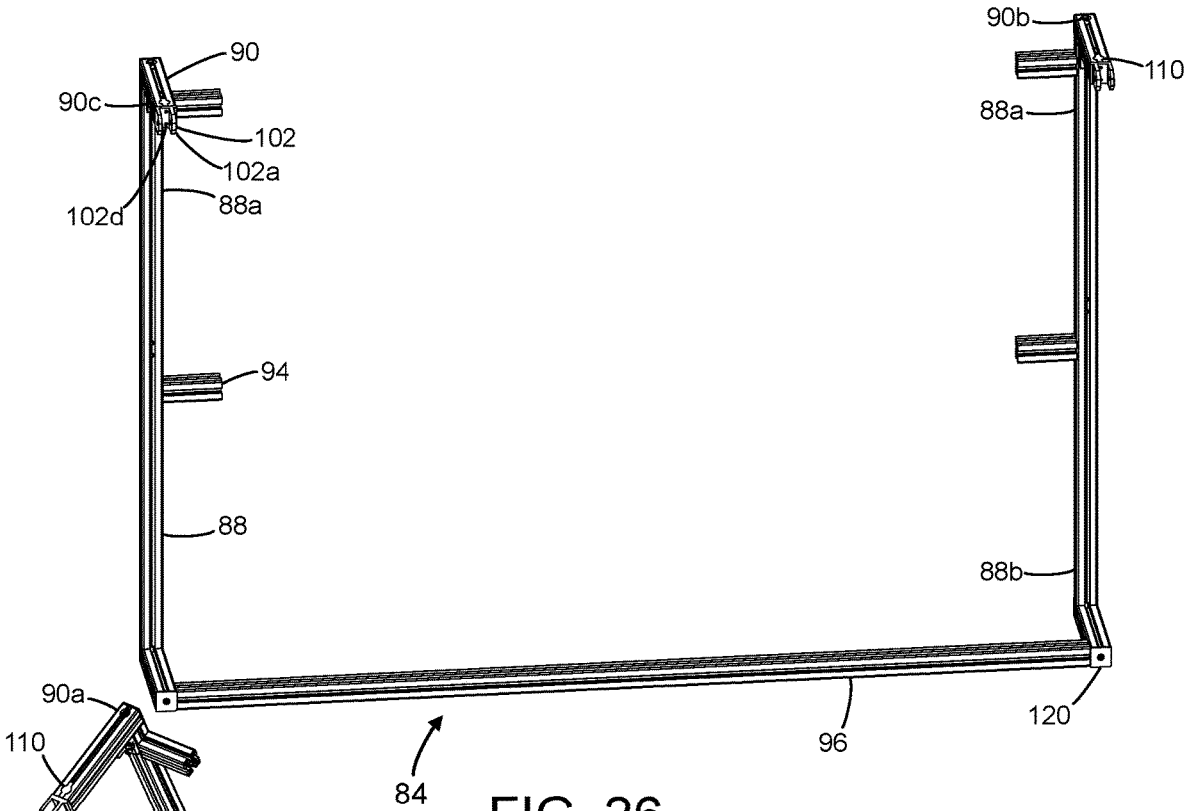
FIG. 26 is a front perspective view of the preferred embodiment of the present invention illustrating a supportive wind wall having a pair of upright supports connecting to a lower support member.
Figure 27:
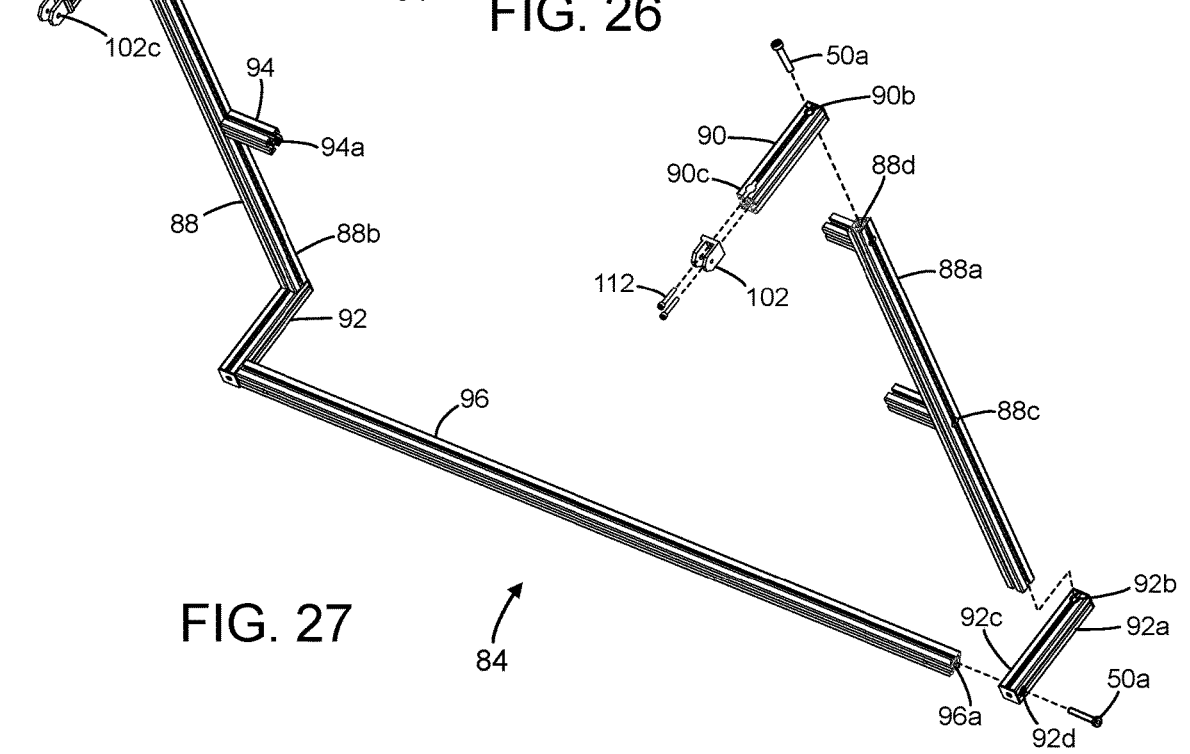
FIG. 27 is a top perspective view of the preferred embodiment of the present invention illustrating a supportive wind wall having a pair of upright supports connecting to a lower support member.

The supportive wind wall in particular is shown in FIGS. 26 and 27 as having a pair of upright supports 88 each configured with a top end 88*a* and a bottom end 88*b* respectively connecting to an upper outward member 90 and a lower outward member 92 at each of their first ends 90*a*, 92*a*. Each of the upright supports is further featured with at least one pair of inward supports 94 that serves to interface with and connect to the vertical post 22 of the box frame situated rearward of the vehicle 12. Like the box frame, the first common connective assembly 50 is employed for this purpose, which includes individual cap screws 50*a* passing into and fitting within cross bores 88*c*, 90*b*, 92*b* extending through the upright support at predetermined locations and at the first ends of the upper and lower outward members and threadably fitting within the designated cylindrical bores 88*d*, 94*a* respectively associated with the upright support 88 and inward support 94.

In fulfilling connection of the two upright supports 88 as well as offering structural support for the lower wind wall 86, each of the lower outward members 92 in FIG. 27 connects to a lower support member 96 by way of the first common connective assembly 50, whereby each of the lower outward members includes a second end 92*c* configured with a cross bore 92*d* for accommodating therewithin cap screw 50*a* for threadably engaging a cylindrical bore 96*a* integral to the lower support member.

Comparatively, FIGS. 19 and 27 show each of the upper outward members 92 pivotally connecting to a sideward arm 98 of the moveable frame assembly 18 by way of an end-mounted pivot bracket assembly 100, which includes a first pivot bracket 102 and a second pivot bracket 104 with each thereof being configured with a pair of parallel plates 102*a*, 104*a* in an offsetting arrangement and extending upwardly from and integrally connecting to a base plate 102*b*, 104*b*. In fulfilling connectively of the pair of pivot brackets in this regard, a bracket connective assemblage 106 comprising a pivot bolt 106*a*, one or more washers 106*b* and a nut 106*c* is collectively appointed for use with an aligned arrangement of bores 102*c*, 104*c* extending through each set of parallel plates.

As specifically indicated in FIG. 19, connection of the first pivot bracket 102 to a second end 90*c* of the upper outward member and the second pivot bracket 104 to a first end 98*a* of the sideward arm 98 is advanced by a second common connective assembly 108, which primarily comprises a pair of s-connectors 110 mountably associated with a pair of cap screws 112. Each of the s-connectors in particular is shown in FIG. 19 to include a top planar portion 110*a* geometrically configured to fit within an equally configured opening 90*d*, 98*b* extending into each opposing side of the upper outward member 90 and sideward arm 98. The s-connector is further featured with a protuberance 110*b* configured with an aperture 110*c* that is suited to threadably accept therein the cap screw's 112 threaded end, as exemplarily depicted in FIGS. 31 and 32 and used in the context of other structural members of the portable shelter 10 having reliance on end-to end pivoting action discussed hereinafter, whereby the base plate 102*b*, 104*b* is generally positioned in a manner that establishes a perpendicular orientation of the parallel plates relatively to the top planar portion 110*a* of the s-connector 110, while holes 102*d*, 104*d* extending through the base plate of the pivot bracket and aligning with the apertures 110*c* of the s-connector, as generally housed within the open track, accommodate the cap screws 112.

Figure 32:
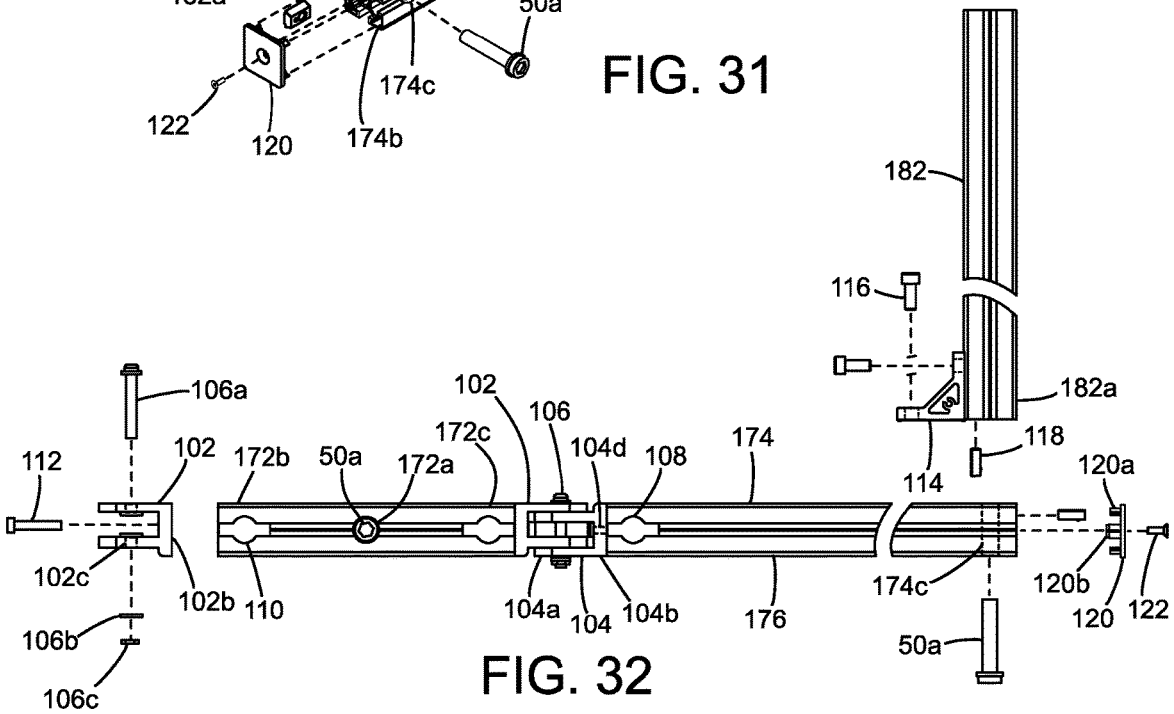
FIG. 32 is a top plan view of the preferred embodiment of the present invention illustrating partial sections of a primary canopy pivotally connecting to a sideward support of a ground brace.
Figure 33:
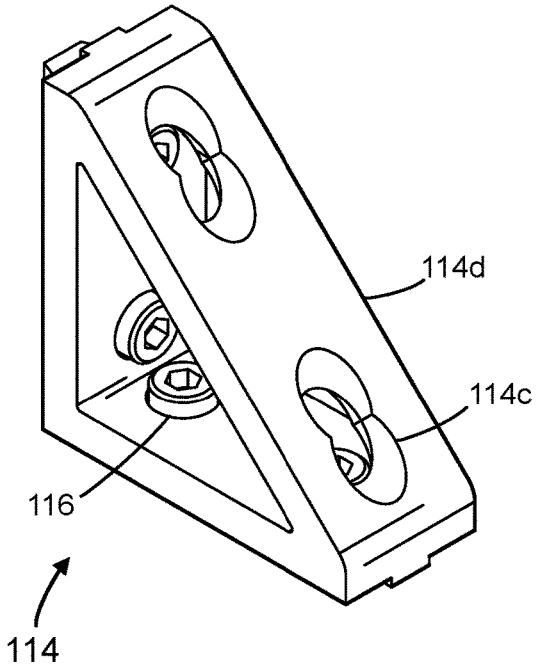
FIG. 33 is a front perspective view of the preferred embodiment of the present invention illustrating a corner brace having a triangular frame and elongate openings.
Figure 34:
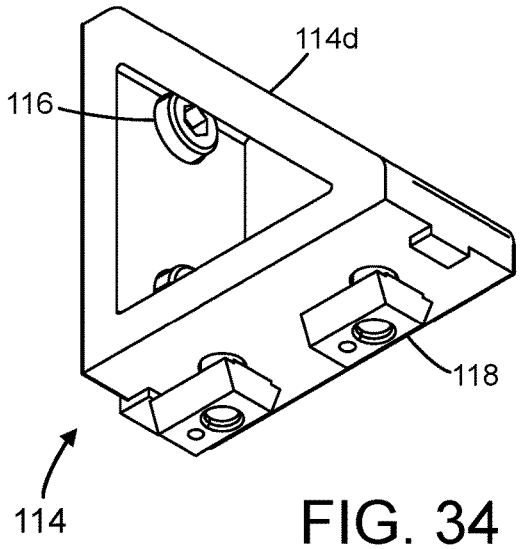
FIG. 34 is a bottom perspective view of the preferred embodiment of the present invention illustrating a corner brace adaptably fitted with cap screws connecting to track nuts.
Figure 35:
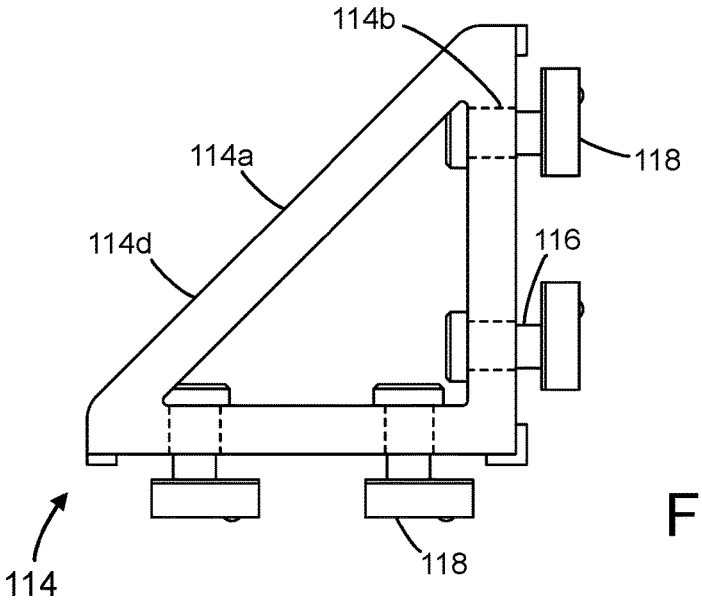
FIG. 35 is a side elevational view of the preferred embodiment of the present invention illustrating a corner brace adaptably fitted with cap screws connecting to track nuts.

In supplementing rigidity and strength of the supportive wind wall 84, particularly to withstand applied forces that may act thereon during operative events, corner braces 114 of the type generally depicted in FIGS. 33-35 may be employed relatively about the unified relationships of the upper and lower outward members with that of each of the upright supports 88. Each of the corner braces, as shown in FIG. 35 and adaptably used with the supportive wind wall and elsewhere within the portable shelter 10, is fabricated as a triangular frame 114*a*, where two sides are perpendicularly orientated to one another with each side including one or more apertures 114*b* for accommodating passage of a cap screw 116. Access to the cap screws for assembly purposes is made possible by equal number of elongate openings 114*c* extending through a diagonal wall 114*d* of the corner brace. Connection of the corner brace is generally fulfilled by a track nut 118 slidably positioned within the open track of the upper and lower outward members and upright supports before undertaking full assembly thereof. End caps 120 of the type depicted in FIGS. 31 and 32 may be used generally at exposed ends of the upper and lower outward members as well as with other exposed structural members of the portable shelter 10, whereby corner prongs 120*a* of the end cap each extend inwardly within an elongate cavity configured with walls generally forming and defining the open track and cylindrical bore. Securement of the end cap is fulfilled by an end screw 122 fitted within an expandable sleeve 120*b* suited for fitment within the cylindrical bore.

Figures 28, 29, 30, 30A:
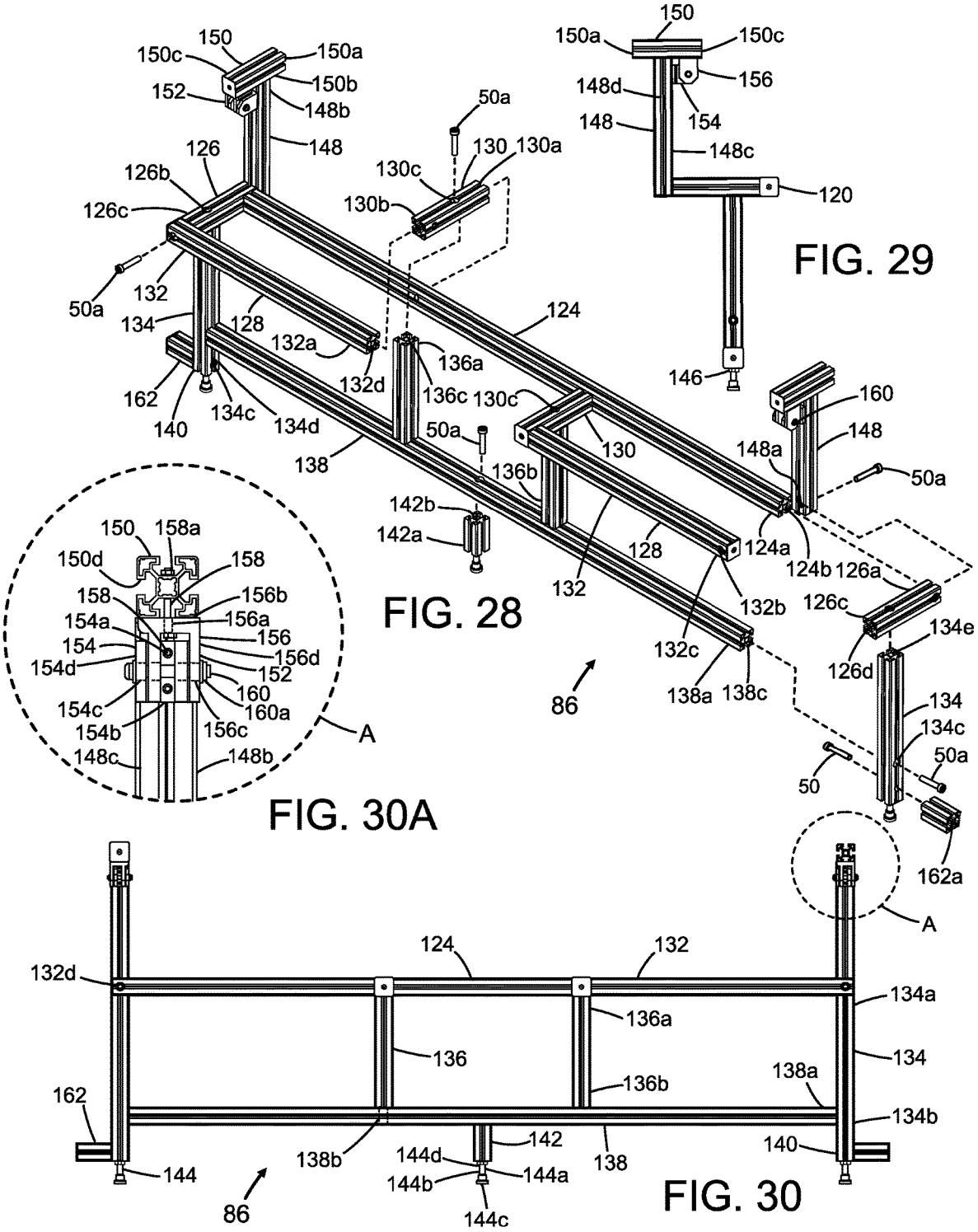
FIG. 28 is a top perspective view of the preferred embodiment of the present invention illustrating a lower wind wall having lower and upper horizontal beams respectively connecting to a pair of outward vertical pillars and a pair of end supports.
FIG. 29 is a side elevational view of the preferred embodiment of the present invention illustrating an anchoring support pivotally connecting to a vertical member of a lower wind wall.
FIG. 30 is a rear elevational view of the preferred embodiment of the present invention illustrating a lower wind wall having lower and upper horizontal beams respectively connecting to a pair of outward vertical pillars and a pair of end supports.
FIG. 30A is a partial enlarged view of the preferred embodiment of the present invention illustrating a surface-mounted pivot bracket assembly connecting to an anchoring support and a vertical member collectively associated with a lower wind wall.

Referring now to FIGS. 28-30, the lower wind wall 86 is generally depicted therein as having an upper horizontal beam 124 extending in between and having ends 124*a* individually connecting to a first end 126*a* of an end support 126 by means of the first common connective assembly 50, which includes cap screw 50*a* passing into its cross bore 126*b* and threadably fitting within a cylindrical bore 124*b* associated with the upper horizontal beam. The lower wind wall is structurally supplemented with a pair of framed sections 128 of which generally serve as seating or shelving for accommodating individuals, items and the like, whereby a pair of cantilevered supports 130 each extend outwardly from the upper horizontal beam and connect thereto at its first end 130*a* while a second end 130*b* connects to an inward end 132*a* of a running support 132 generally extending parallel to the upper horizontal beam. Connections in this regard are equally fulfilled by the first common connective assembly 50, whereby individual cap screws 50*a* fit within cross bores 130*c*, 132*b* respectively extending through the second end of the cantilevered support as well as an outward end 132*c* of the running support and threadably engage a cylindrical bore 132*d*, 126*d* of the running support and second end 126*c* of the end support.

As shown further in FIGS. 28 and 30, the lower wind wall is supplemented with a pair of outward vertical pillars 134 each having a first end 134*a* connecting intermediate along each of the end supports 126 and a pair of inward vertical pillars 136 each connecting at its first end 136*a* intermediate along each of the cantilevered supports. Second ends 134*b* of the outward vertical pillars are depicted in FIGS. 28 and 30 as extending beyond outward ends 138*a* of a lower horizontal beam 138 to form an outer leg 140 and connecting thereto intermediate along the outward vertical pillar, whereas second ends 136*b* of the inward vertical pillars connect intermediate along the lower horizontal beam. An inner leg 142 connecting to the lower horizontal beam 138, primarily in between the inward vertical pillars, may supplement inner support to the lower wind wall. Connections of the foregoing are maintained by the first common connective assembly 50, whereby cross bores 126*b*, 130*c*, 138*b* respectively extend into and through each of the end supports 126, cantilevered supports 130, and the lower horizontal beam 138 for receiving therein cap screw 50*a* that threadably engages the appropriate cylindrical bore 134*e*, 136*c*, 142*b*, 138*c* respectively associated with each of the outward vertical pillars 134, inward vertical pillars 136, inner leg 142, and lower horizontal beam 138. As further evident in FIG. 30, each second end 134*b* of the outward vertical pillars forming the outer leg 140 and an unconnected end 142*a* of the inner leg are optionally fitted with an adjustable leg 144 that offers upward and downward adjustment of the lower wind wall 86 so as to manage uneven surfaces that may be inherently associated with a ground's surface. A threaded stem portion 144*a* configured at one end 144*b* with a foot pad 144*c* and second end 144*d* threadably fitting within the cylindrical bore 142*b* and cooperating with a fitted lock nut 146 consummates the assembly.

Figure 36:
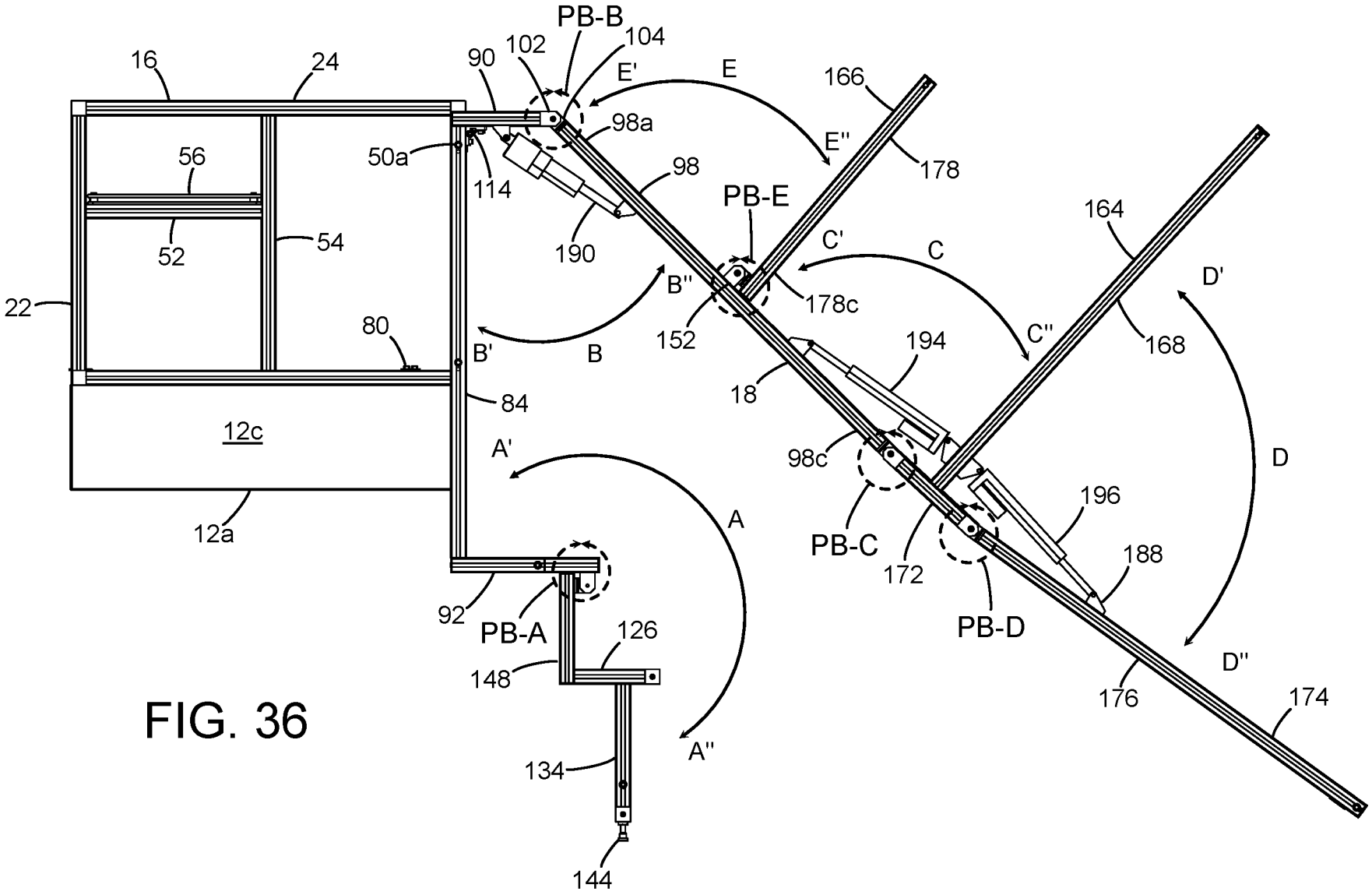
FIG. 36 is a side elevational view of the preferred embodiment of the present invention illustrating a moveable frame assembly presented in expanded form and connecting to a box frame associatively mounted to an open cargo bay of a vehicle.

In fulfilling the capacity of the lower wind wall 86 to pivot for stowable purposes along path A in FIG. 36, the lower wind wall is further featured with a pair of vertical members 148 each connecting to the first end 126*a* of the end support by way of the first common connective assembly 50, whereby cap screw 50*a* fits within a cross bore 148*a* extending through the vertical member and threadably engages the cylindrical bore 126*d* of the end support 126, while an opposing end 148*b* of the vertical member pivotally connects to an anchoring support 150 as in FIG. 29 by way of a surface-mounted pivot bracket assembly 152, generally reflective of the type described hereinbefore.

A first end 150*a* of the anchoring support is shown in FIG. 19 as connecting inwardly from each end of the lower support member 96 of the supportive wind wall 84 so as to provide ample clearance as the lower wind wall 86 pivots relatively about the mating pivot brackets in FIG. 36 along path A. First and second pivot brackets 154, 156 of the surface-mounted pivot bracket assembly 152 are depicted in FIGS. 28-30 as respectively residing atop of and mounting to an outer surface 148*c*, 150*b* of the vertical member and anchoring support in proximity to their respective opposing and second ends 148*b*, 150*c*, whereby a pair of cap screws 158 inserted within holes 154*a*, 156*a* extending through a base plate 154*b*, 156*b* of the individual pivot brackets as well as the vertical member and anchoring support and fitted with a nut 158*a* or equivalent, as accommodated within their respective open tracks 148*d*, 150*d*, attains their securement to the lower wind wall. Aligned arrangement of apertures 154*c*, 156*c* extending through parallel plates 154*d*, 156*d* of the mating pivot brackets accommodates placement of a pivot bolt 160 configured with a nut 160*a*. Accordingly, by way of the foregoing assembly, the lower wind wall inherently possesses the capabilities of pivotally moving relatively about PB-A and traveling upwardly along path A in direction A' in FIG. 36 until the outer surface of the vertical member engages the second end of the anchoring support, and traveling downwardly along path A in direction of A" until the foot pads 144*c* of the adjustable legs contact or engage the ground's surface. A pair of outward extending braces 162 as in FIG. 30 may supplemental the structure of the lower wind wall to serve as a stop mechanism while the lower wind wall is advanced upwardly to attain compactness of the moveable frame assembly 18. Connection of each outward extending brace to the outward vertical pillar 134 is fulfilled by the first common connective assembly 50, which includes cap screw 50*a* or equivalent fitting within cross bore 134*c* extending through a lower portion 134*d* of the outward vertical pillar and threadably engaging a cylindrical bore 162*a* associated with the outward extending brace, as generally shown in FIG. 28.

Figure 37:
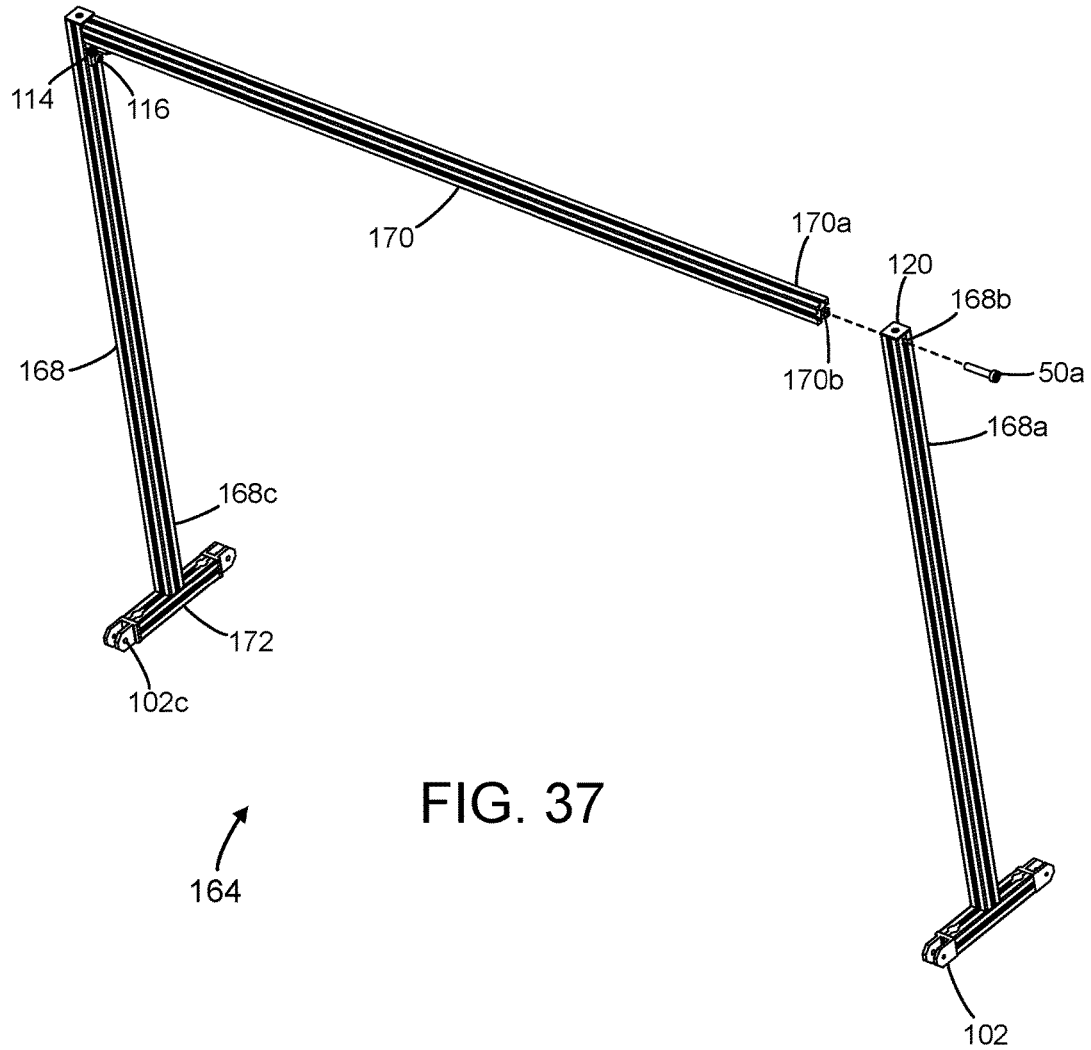
FIG. 37 is a top perspective view of the preferred embodiment of the present invention illustrating a primary canopy having a pair of sideward members connecting to a cross member.
Figure 38:
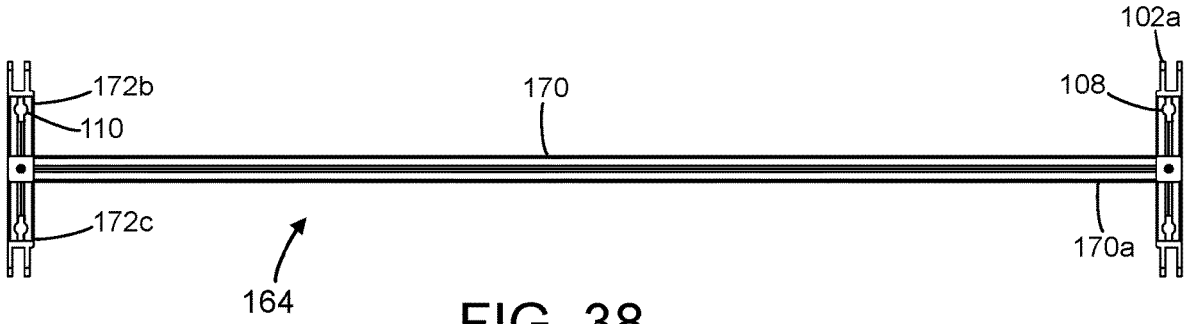
FIG. 38 is a top plan view of the preferred embodiment of the present invention illustrating a primary canopy having a pair of sideward members each connecting to a shortened arm.

Now in reference to FIGS. 36-38, the moveable frame assembly 18 is further associated with a primary canopy 164 extending from and connecting to second ends 98*c* of the sideward arms 98 and a secondary canopy 166 connecting intermediate along the sideward arms, whereby each of the canopies possesses the capabilities of collapsing inwardly toward the sideward arms as well as traveling outwardly therefrom respectively along paths C and E in FIG. 36 to attain full expansion of the moveable frame assembly 18.

As generally depicted in FIGS. 37 and 38, the primary canopy includes a pair of sideward members 168 each having a first end 168*a* connecting to ends 170*a* of a cross member 170 by way of the first common connective assembly 50, whereby cap screw 50*a* or equivalent fits within a cross bore 168*b* extending through each end of the sideward members and threadably engages a cylindrical bore 170*b* of the cross member. In further respects, the primary canopy includes a shortened arm 172 generally extending perpendicular to the sideward member 168 and connecting intermediate along thereof to a second end 168*c* of the sideward member by way of the first common connective assembly 50, which includes cap screw 50*a* or equivalent fitting within a cross bore 172*a* extending through the shortened arm and threadably engaging a cylindrical bore 168*d* integral to the sideward member.

In other featural aspects of the primary canopy 164, each of the shortened arms includes first and second ends 172*b*, 172*c* respectively connecting to the second end of the sideward arm 98 and a sideward support 174 of a ground brace 176 by way of the end-mounted pivot bracket assembly 100, particularly of same type used for pivotally joining the first end of the sideward member to the upper outward member of the supportive wind wall.

Figure 31:
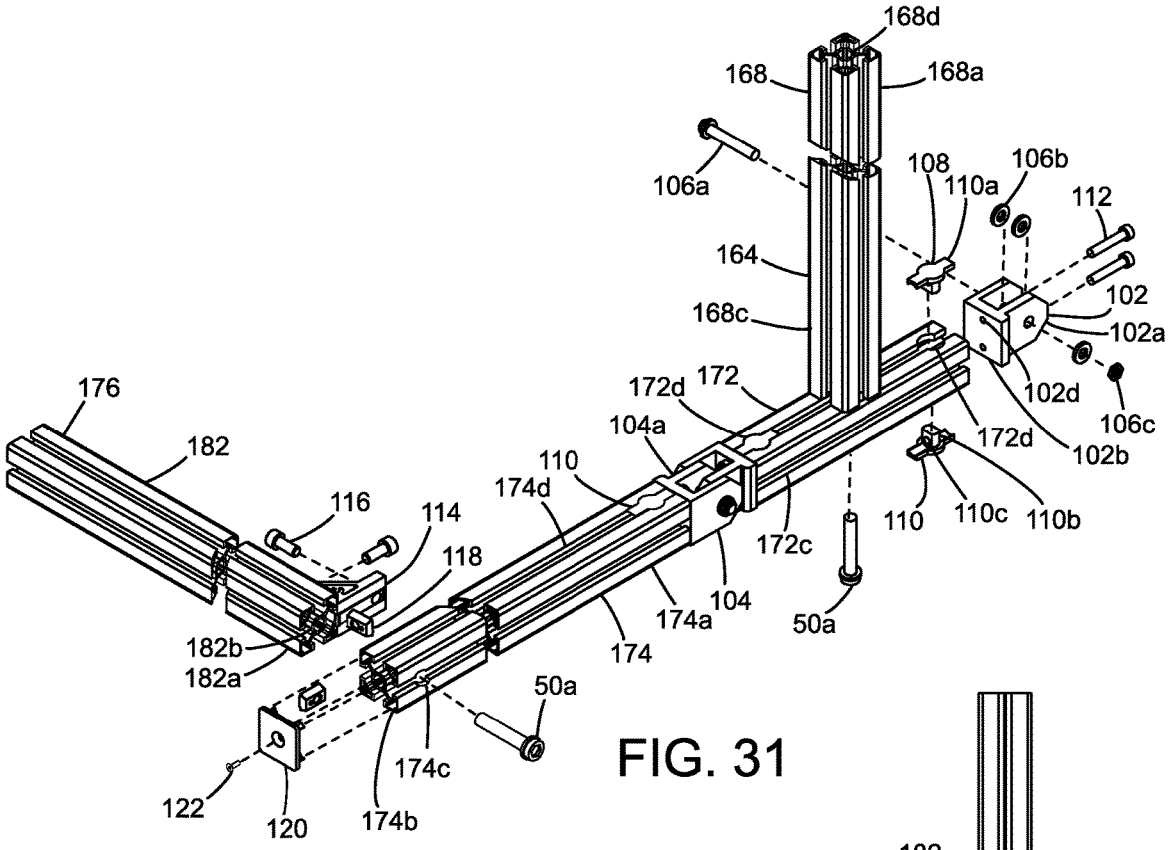
FIG. 31 is a top perspective view of the preferred embodiment of the present invention illustrating partial sections of a primary canopy pivotally connecting to a sideward support of a ground brace.

In the case of mounting the first pivot bracket 102 to the first end of the shortened arm as in FIGS. 31 and 32, and likewise to the second end thereof, the base plate 102*b* is positioned to abut against the first end such that the parallel plates 102*a* thereof extend upright to allow upward pivotal rotation. S-connectors 110, as a pair, are positioned within the corresponding openings 172*d* extending into the shortened arm 172 and existing on opposing outer surfaces thereof, whereby cap screw 112 or equivalent is inserted within each hole 102*d* of the base plate 102*b* of the pivot bracket and aperture 110*c* of the s-connector and threadably tightened to complete the pivot bracket's connective arrangement. In like manner, the second end 98*c* of the sideward arm 98 and a first end 174*a* of the sideward support 174 of the ground brace 176 are individually configured with the second pivot bracket 104 to engagingly mate and mesh with each of the pivot brackets mounted to ends of the shortened arm, as generally depicted in FIGS. 31 and 32. Insertion of the pivot bolt 106*a* within the aligned arrangement of bores 102*c*, 104*c* extending through the parallel plates and fitting thereon an assembly of one or more washers 106*b* and a nut 106*c* preparatorily fixates the pair of mating pivot brackets for pivotable movement.

Figure 39:
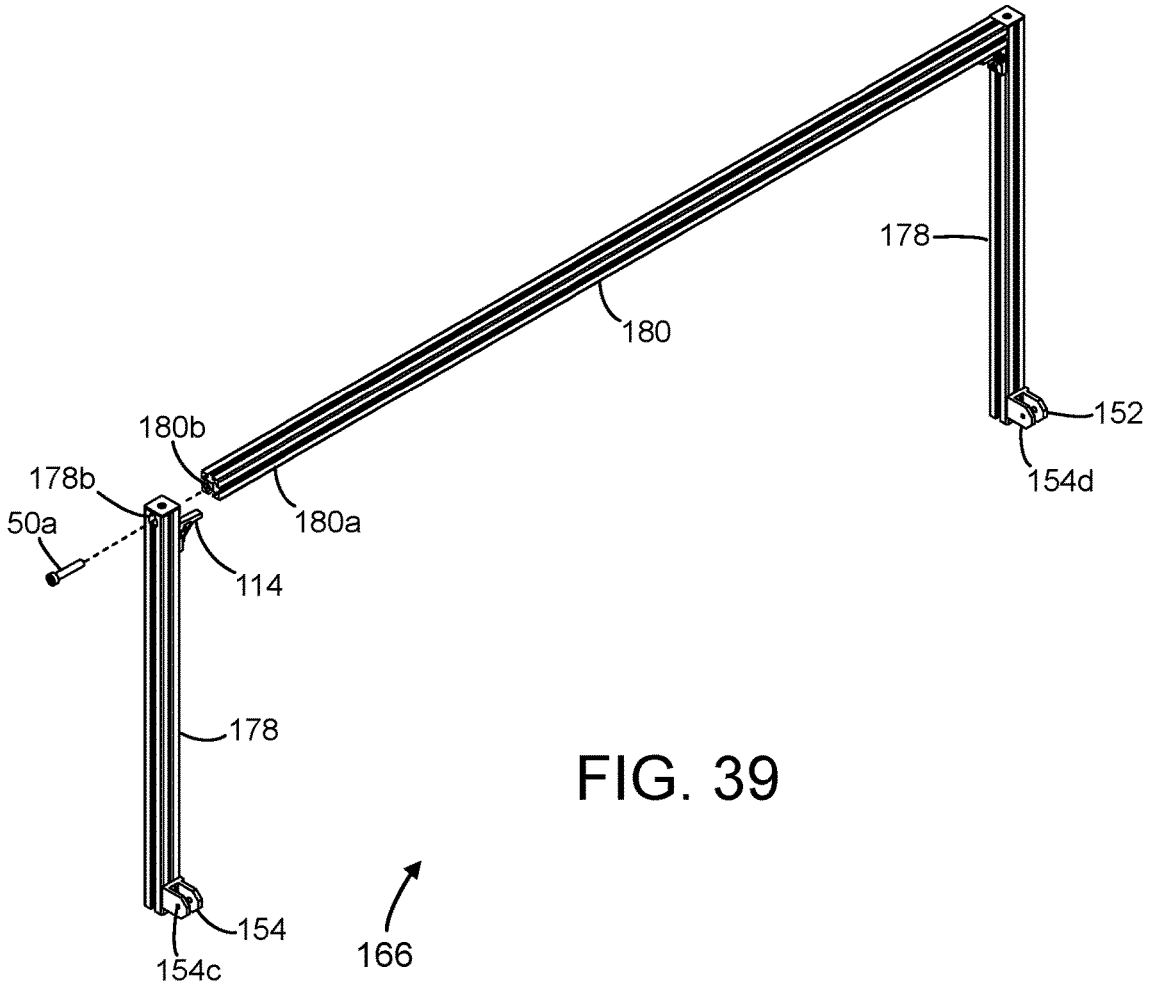
FIG. 39 is a top perspective view of the preferred embodiment of the present invention illustrating a secondary canopy having a pair of sideward members connecting to a cross support.
Figure 40:
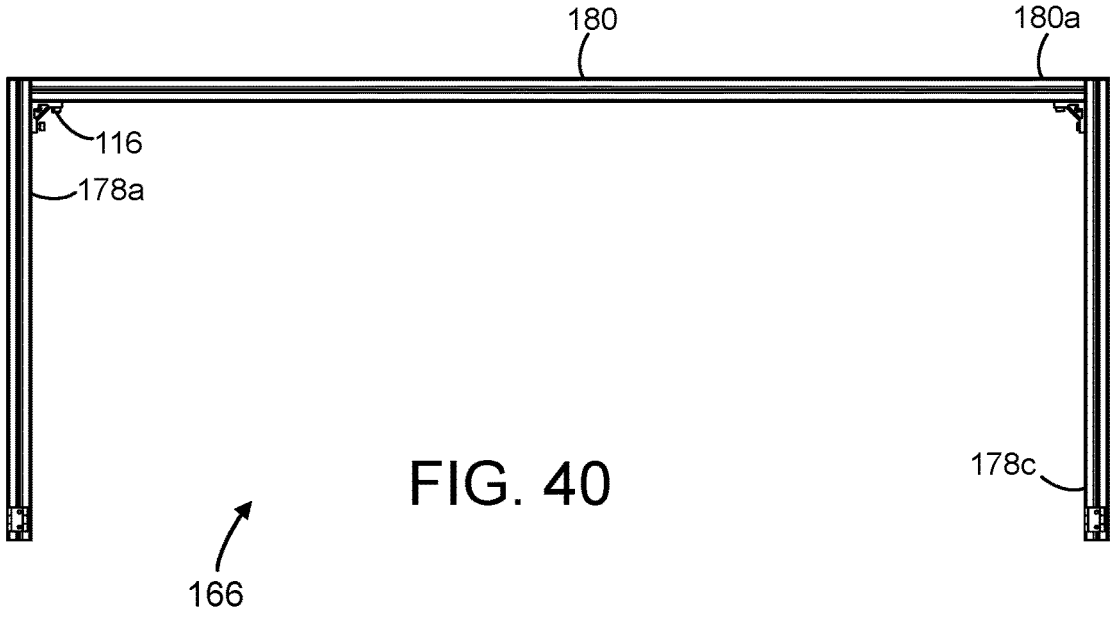
FIG. 40 is a front elevational view of the preferred embodiment of the present invention illustrating a secondary canopy having a pair of sideward members connecting to a cross support and reinforced with corner braces.

In FIGS. 39 and 40, the secondary canopy 166 is generally shown therein as comprising equivalent structure as the primary canopy, but differs slightly with respect to mounting of the pivot brackets so as to allow full collapse inwardly toward the supportive wind wall 84. Accordingly, the secondary canopy includes a pair of sideward members 178 each having a first end 178*a* connecting to ends 180*a* of a cross support 180 by way of the first common connective assembly 50, whereby cap screw 50*a* or equivalent fits within a cross bore 178*b* extending through the sideward member and threadably engages a cylindrical bore 180*b* integral to the cross support.

Comparatively, surface-mounted pivot bracket assemblies 152 as in FIG. 36 provide for connection of the sideward members 178 to the sideward arms 98, whereby first and second pivot brackets 154, 156 respectively mount to the second end 178*c* of the sideward member and intermediate along each of the sideward arms 98 of the moveable frame assembly 18. Connection of the first pivot bracket with respect to the sideward member is advanced by at least two cap screws 158 or equivalent passing into and through an aligned arrangement of apertures 154*c* extending through the base plates 156*b* of the pivot bracket and sideward member and threadably fitting thereto the requisite nut 158*a*. Connection of the second pivot bracket with respect to each sideward arm of the moveable frame assembly occurs in like manner.

Figure 8:
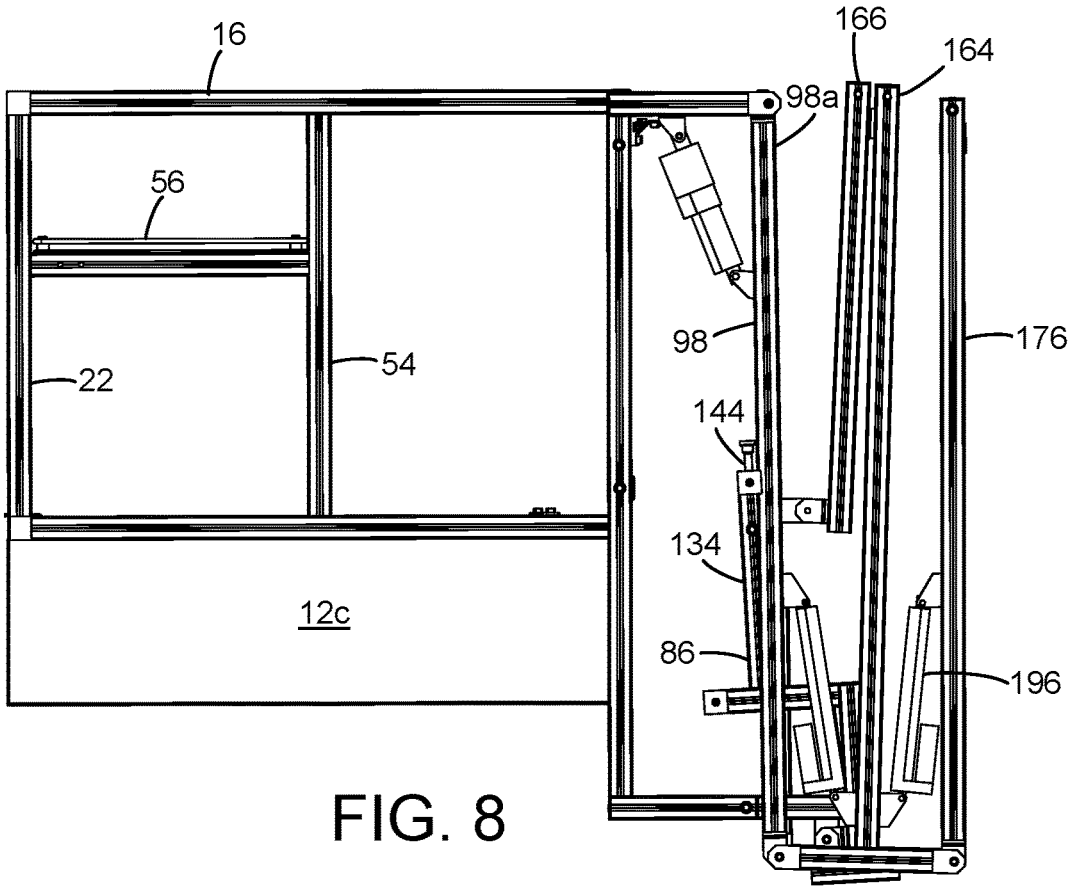
FIG. 8 is a side elevational view of the preferred embodiment of the present invention illustrating a movable frame assembly in a folded, compact position and connecting to a box frame.
Figure 9:
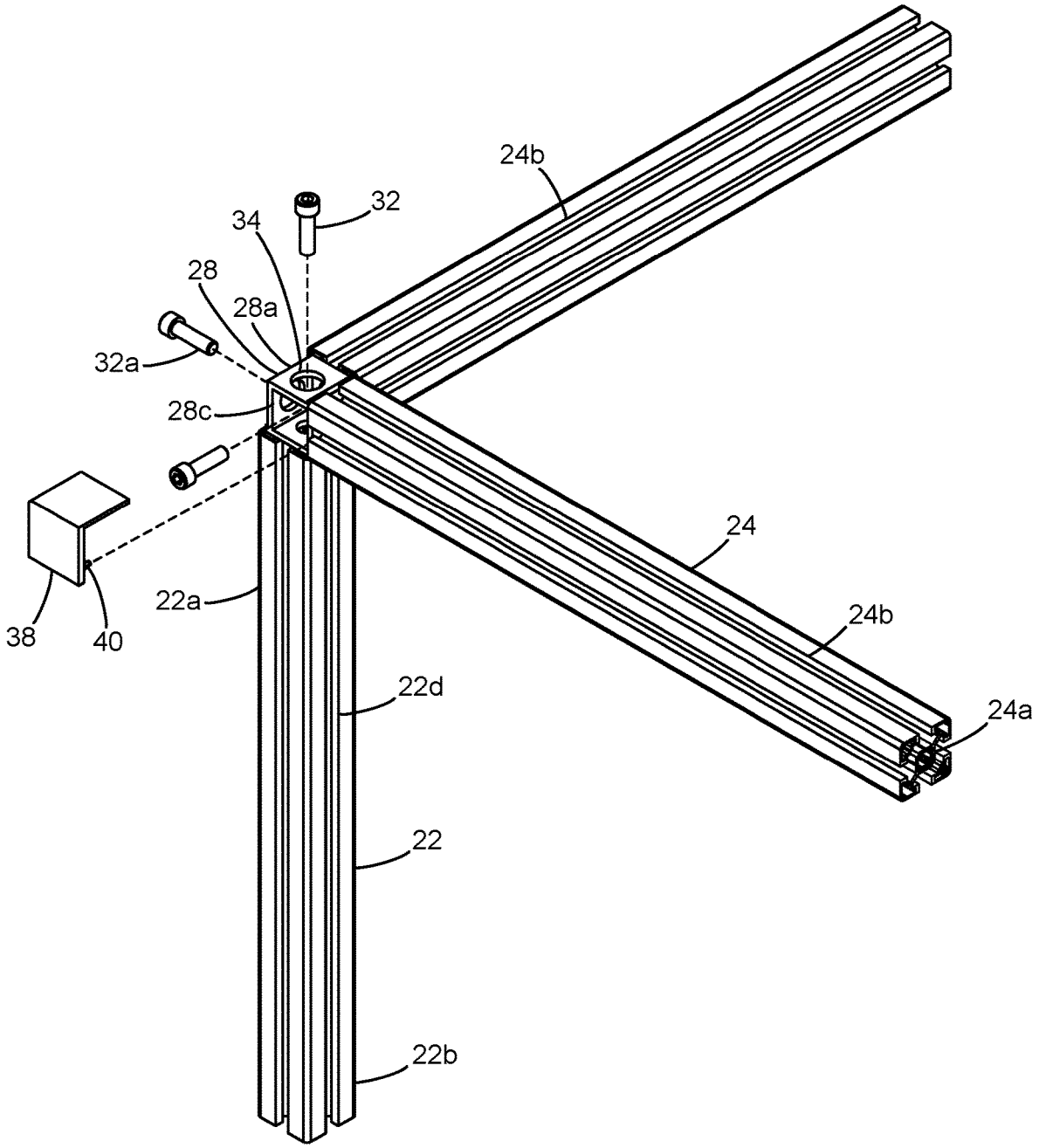
FIG. 9 is a top perspective view of the preferred embodiment of the present invention illustrating detail of joining upper and lower horizontal members to a corner post by a three-way connector.
Figure 10:
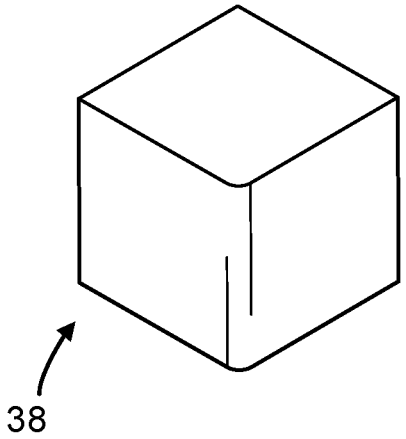
FIG. 10 is a rear perspective view of the preferred embodiment of the present invention illustrating of a corner cap fitted to a three-way connector.
Figure 11:
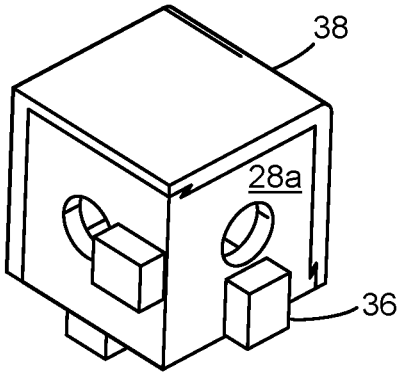
FIG. 11 is a front perspective view of the preferred embodiment of the present invention illustrating of a corner cap fitted to a three-way connector having accessible openings.
Figure 12:
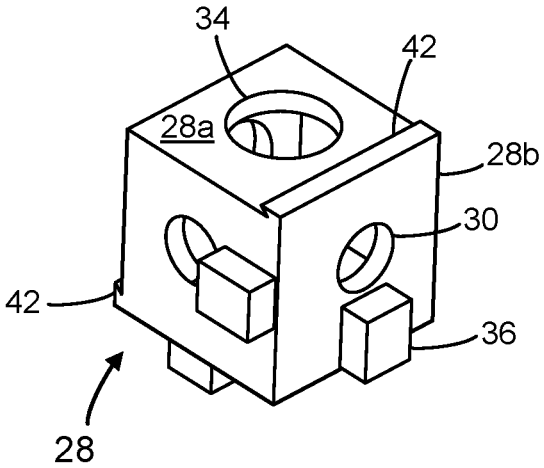
FIG. 12 is a front perspective view of the preferred embodiment of the present invention illustrating a three-way connector having accessible openings and alignment members.
Figure 13:
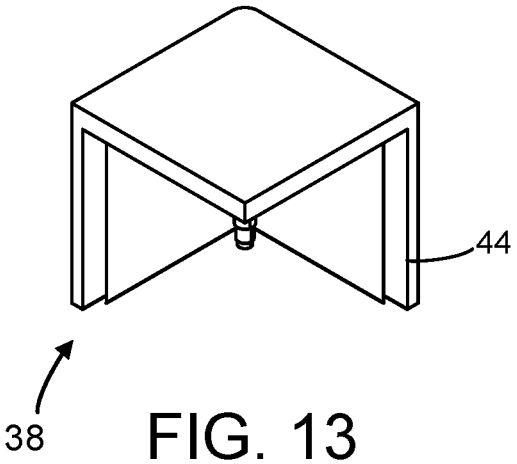
FIG. 13 is a rear perspective view of the preferred embodiment of the present invention illustrating of a corner cap having a pair of outward pins and a pair of inversed grooved slides.
Figure 14:
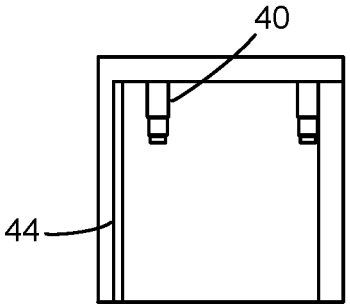
FIG. 14 is a side elevational view of the preferred embodiment of the present invention illustrating of a corner cap having a pair of outward pins.
Figure 15:
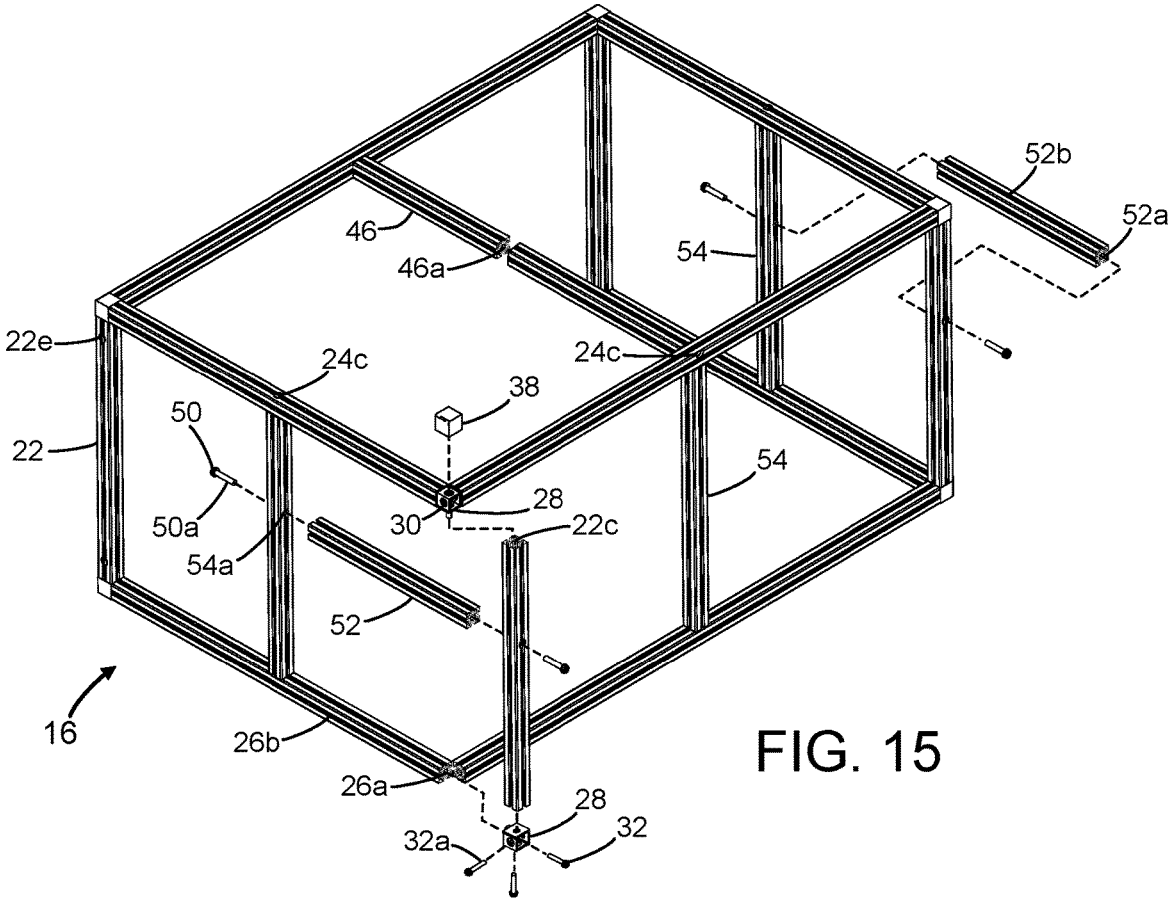
FIG. 15 is a top perspective view of the preferred embodiment of the present invention illustrating a box frame having upper and lower horizontal members connecting to corner posts.
Figure 16:
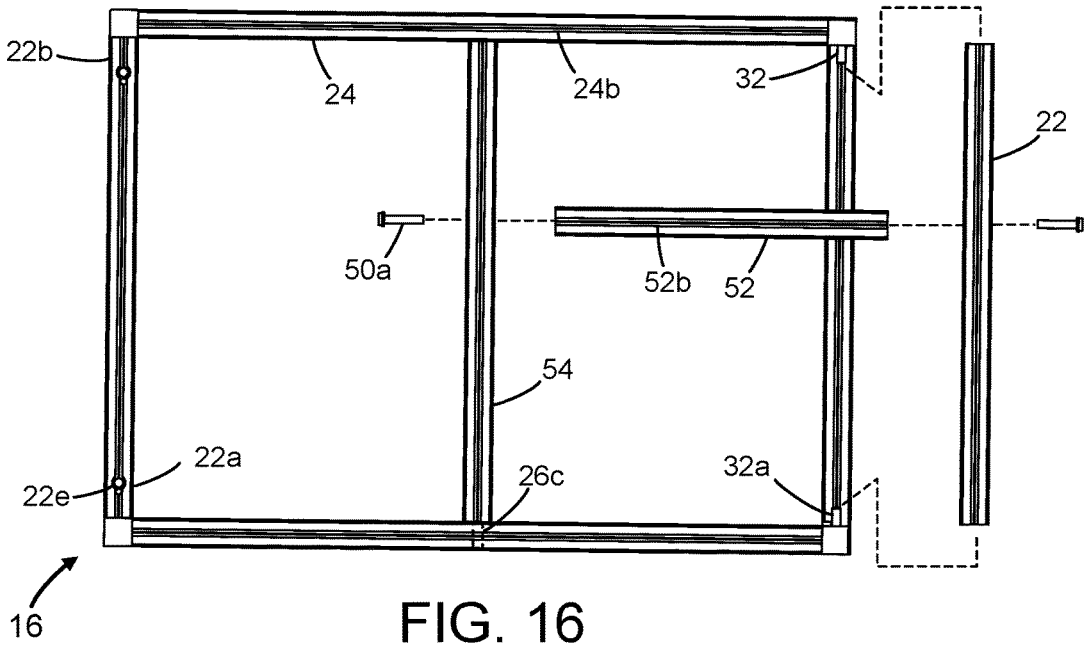
FIG. 16 is a side elevational view of the preferred embodiment of the present invention illustrating a box frame having upper and lower horizontal members connecting to corner posts.

Consequently, through the structural connective arrangement of the pivot brackets, the secondary canopy can pivotally travel relatively about PB-E, inwardly toward the supportive wind wall 84 in direction of E' along path E in FIG. 36, until the first end of the sideward member generally comes in proximate contact with the first end of the sideward arm 98 as in FIG. 8. Conversely, the secondary canopy 166 can travel outwardly away from the supportive wind wall 84, in direction of E" along path E in FIG. 36, until a portion of the second end 178*c* of the sideward member 178 generally contacts and engages the outer surface of the sideward arm 98, particularly as such to establish a near-perpendicular orientation thereof with respect to the sideward arm as evident in FIG. 36.

As generally shown in FIGS. 34 and 40, the primary and secondary canopies are preferentially equipped with corner braces 114 to offer structural strength and advance rigidity thereof, particularly among areas most prone for possible permanent disfiguration due to applied twisting and torsional forces that the portable shelter may sustain during operative events. Accordingly, it is desired to place and mount the corner braces with associative cap screws 116 and track nuts 118 at the unions of the sideward members with that of the cross member, as generally associated with the primary canopy, and sideward member 178 with that of the cross support 180, as generally associated with the secondary canopy.

Figure 41:
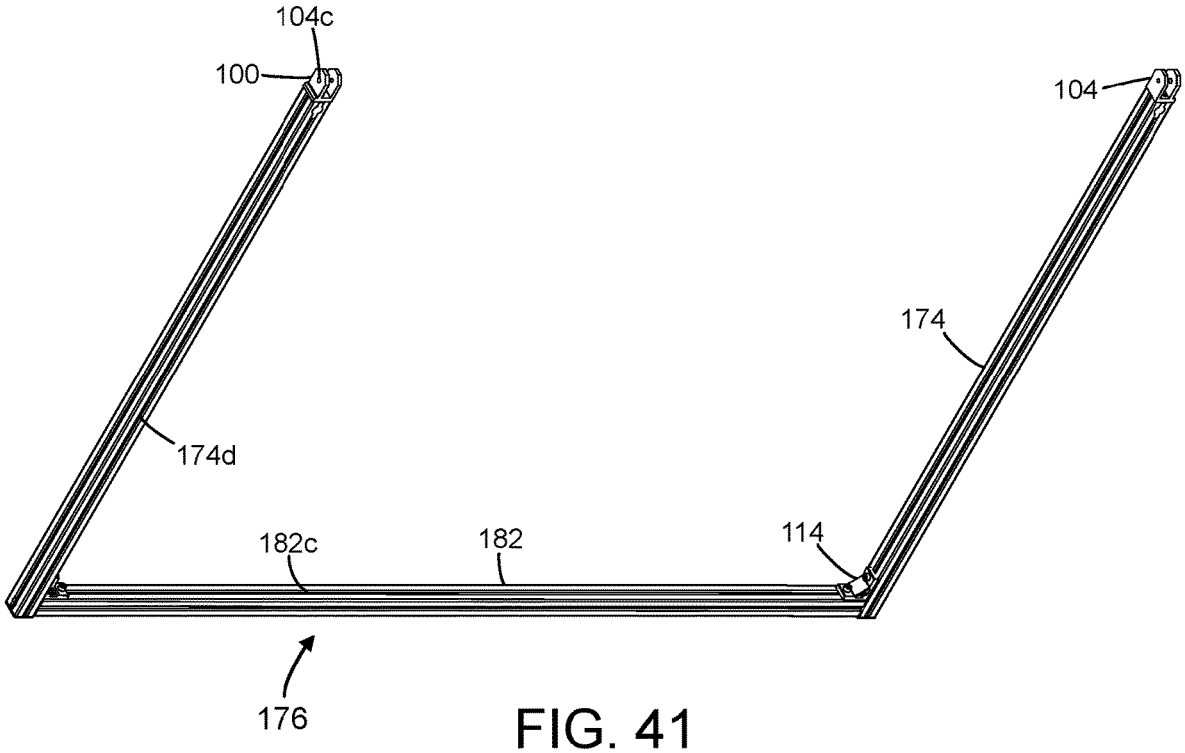
FIG. 41 is a bottom perspective view of the preferred embodiment of the present invention illustrating a ground brace having a pair of sideward supports connecting to a cross member.
Figure 42:
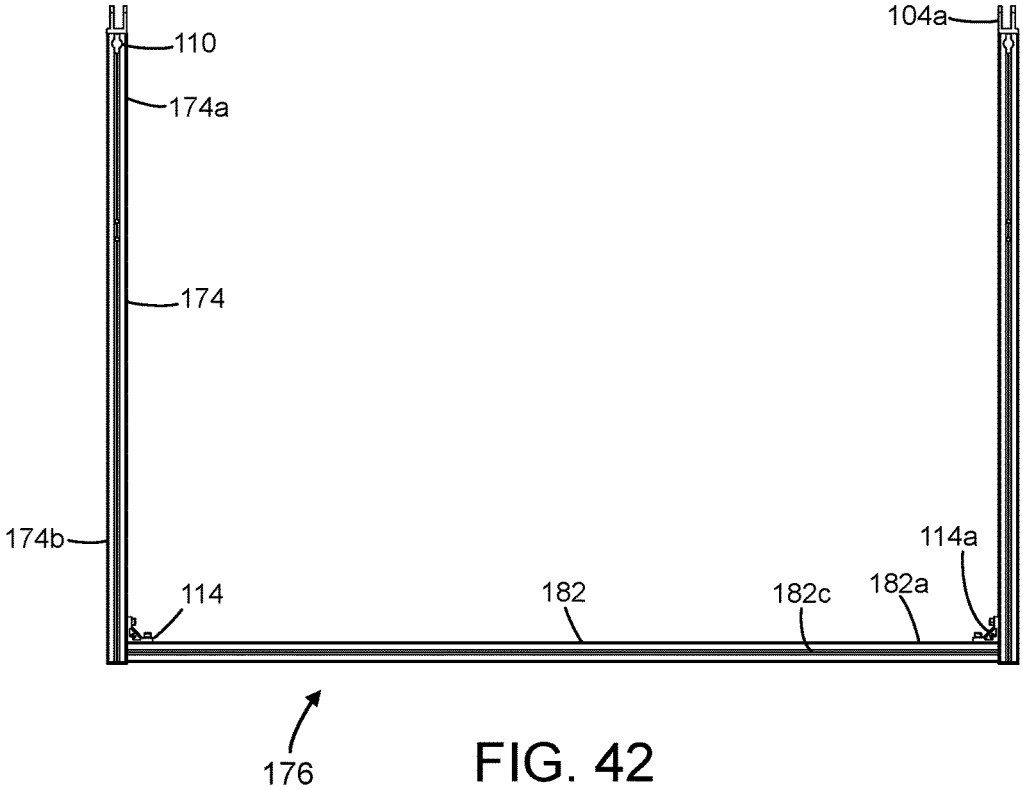
FIG. 42 is a side elevational view of the preferred embodiment of the present invention illustrating a ground brace having a pair of sideward supports connecting to a cross member.
Figure 43:
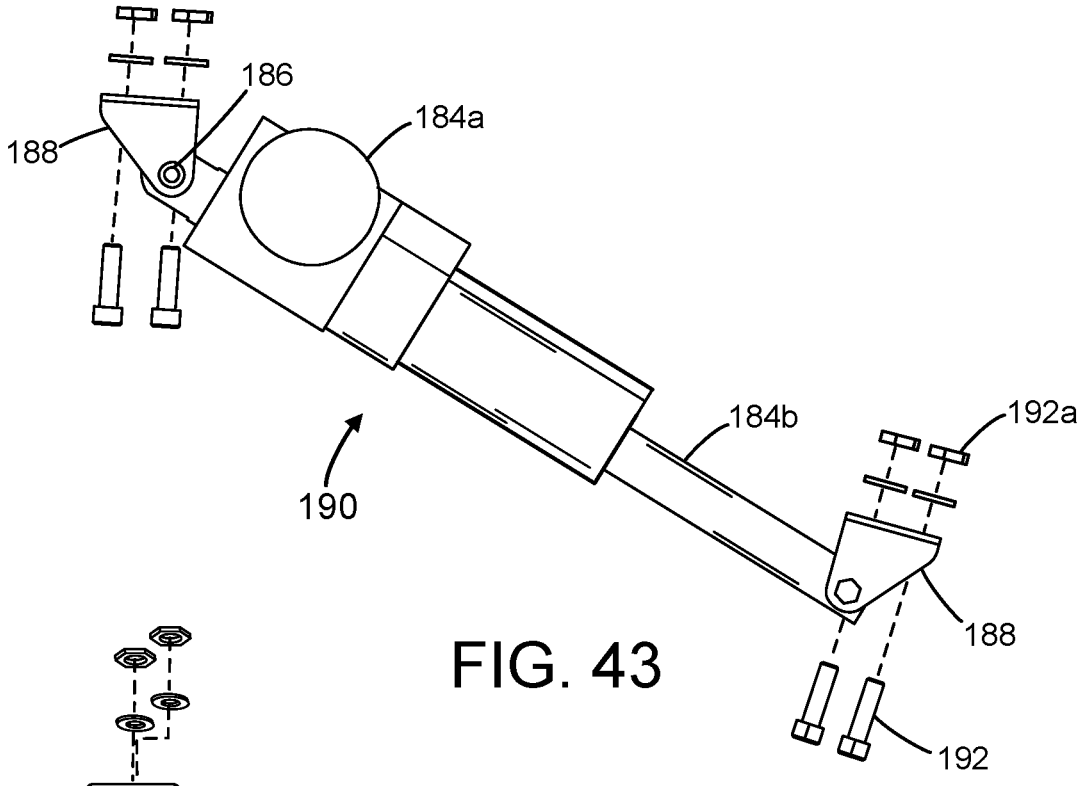
FIG. 43 is a side elevational view of the preferred embodiment of the present invention illustrating a first linear actuator designated for connection to a supportive wind wall and a moveable frame assembly.
Figure 44:
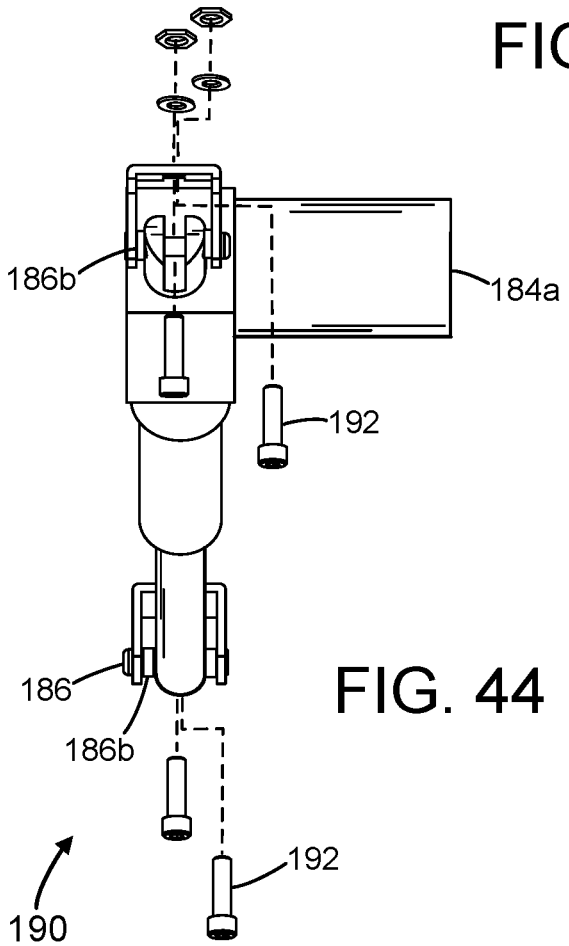
FIG. 44 is a rear elevational view of the preferred embodiment of the present invention illustrating a first linear actuator designated for connection to a supportive wind wall and a moveable frame assembly.
Figure 45:
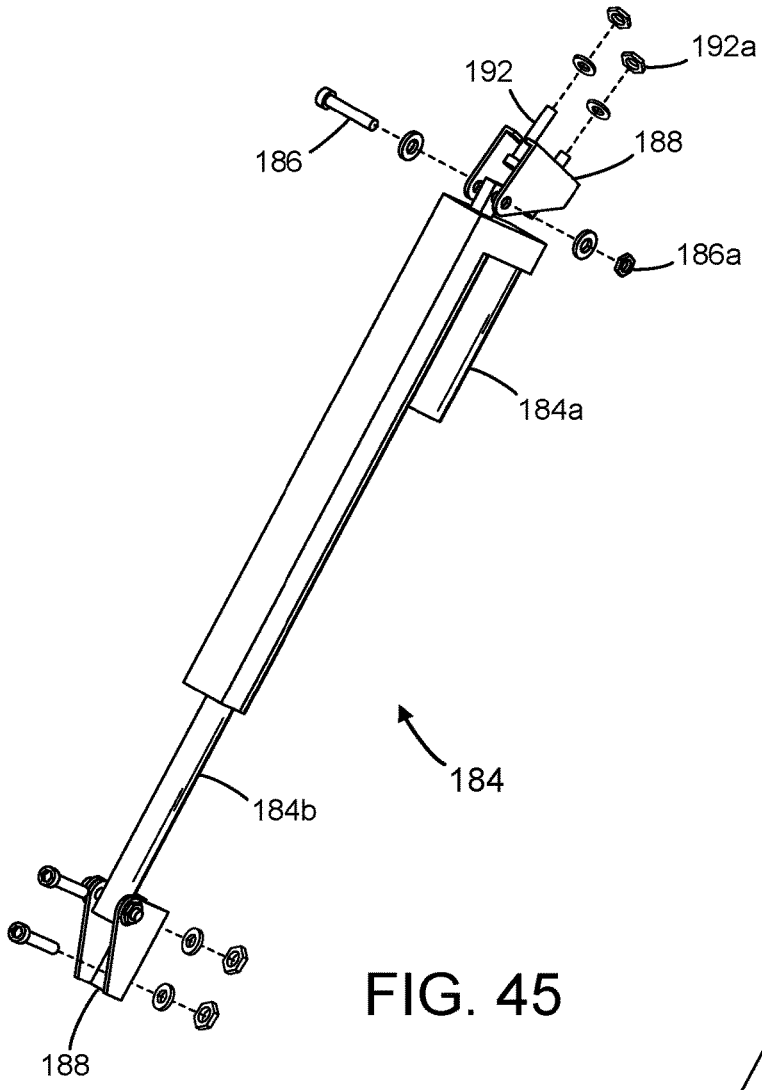
FIG. 45 is a top perspective view of the preferred embodiment of the present invention illustrating a second linear actuator designated for connection to a sideward arm of a moveable frame assembly and a primary canopy.
Figure 46:
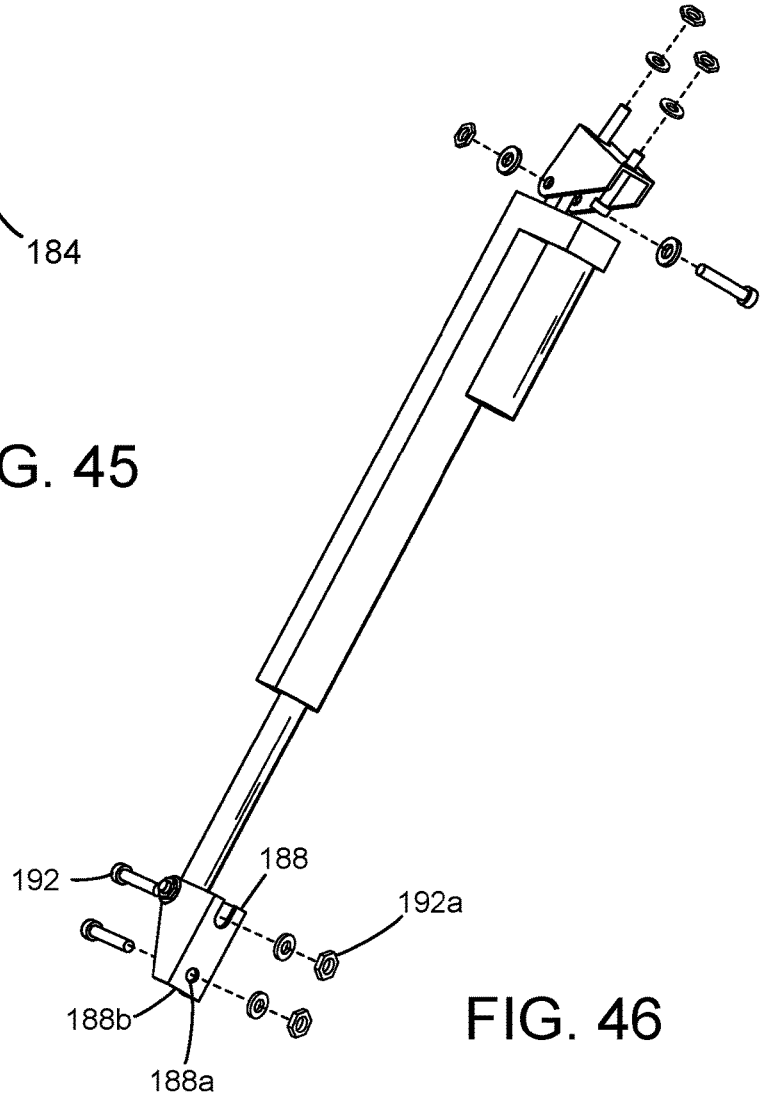
FIG. 46 is a bottom perspective view of the preferred embodiment of the present invention illustrating a second linear actuator designated for connection to a sideward arm of a moveable frame assembly and a primary canopy.

In further reference to FIGS. 41 and 42, the moveable frame assembly 18 includes ground brace 176 that offers overall structural support thereof while presented in expanded form for accommodating occupancy by individuals Similar to the construct of the primary and secondary canopies, the ground brace is shown as comprising sideward supports 174 each having a second end 174*b* connecting to one of two ends 182*a* of a cross member 182 by way of the first common connective assembly 50, which is fulfilled by cap screw 50*a* fitting within a cross bore 174*c* extending through the second end of the sideward support and threadably engaging a cylindrical bore 182*b* associated with the cross member. A corner brace 114 as in FIG. 42 may supplement the connection at each of the foregoing locations, with mounting thereof being accomplished by caps screws 116 and accompanying track nuts 118 placed within an open track 174*d*, 182*c* of the sideward support and cross member to facilitate threaded connection therewith. As generally illustrated in FIGS. 31 and 32 and discussed above, adaptation of the end-mounted pivot bracket assembly to join the sideward support 174 to the shortened arm 172 provide means by which the ground brace 176 pivotally moves with respect to the primary canopy 164 to fulfill states of partial compactness and expansion of the moveable frame assembly 18.

As represented in FIGS. 43-46, the movable frame assembly 18 incorporates multiple pairs of linear actuators 184 to advance automated contraction and expansion of the moveable frame assembly, particularly of the type generally recognized and available in the art for operative purposes set forth herein. The linear actuator preferably suited for the portable shelter 10 operates electrically and consists of a housed DC motor 184*a*, a series of gears (not shown) and a lead screw (not shown) with a driving nut (not shown) that pushes the main rod shaft 184*b* in and out, whereby a pivot pin 186 and an assembly of washers and a nut 186*a* and spacers 186*b* respectively secures and aligns the linear actuator with respect to a pair of mounts brackets 188, as will be described hereinafter in further detail.

As shown in FIG. 36, a first pair of linear actuators 190 each extendably spans the connective arrangement of the upper outward member 90 and sideward arm 98 to afford pivotal rotation relatively about the mating pivot brackets designated at PB-B, whereby the sideward arm primarily travels along path B in direction B' to generally reside in proximity to the upright support of the supportive wind wall 84 to effect a compact relationship thereof and, conversely, along path B in direction B" to extend outwardly from the upright support of the supportive wind wall to effect a fully expanded relationship. Each linear actuator in association with the first pair is mounted intermediate along the upper outward member and sideward arm by means of the mount brackets, whereby cap screws 192 or equivalent are placed within apertures 188*a* extending through a bottom plate 188*b* of the mount bracket as well as the outward support member and sideward arm and appropriately fitted an assembly of washers and nuts 192*a* to affix the mount bracket's desired position.

Figure 5:
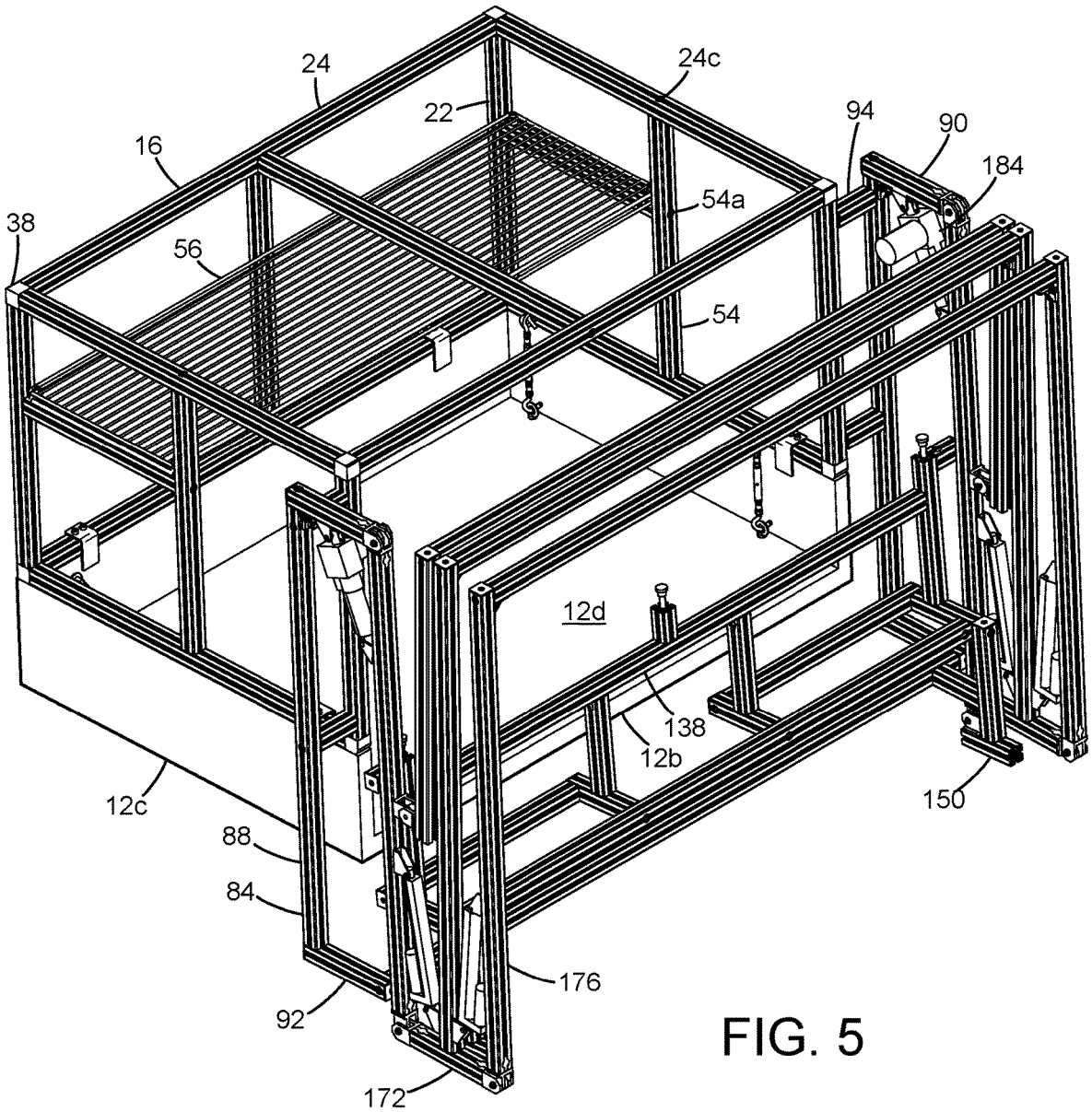
FIG. 5 is a top perspective view of the preferred embodiment of the present invention illustrating a box frame mounted to an open cargo bay of a vehicle and connecting to moveable frame assembly in a folded, compact position.
Figure 6:
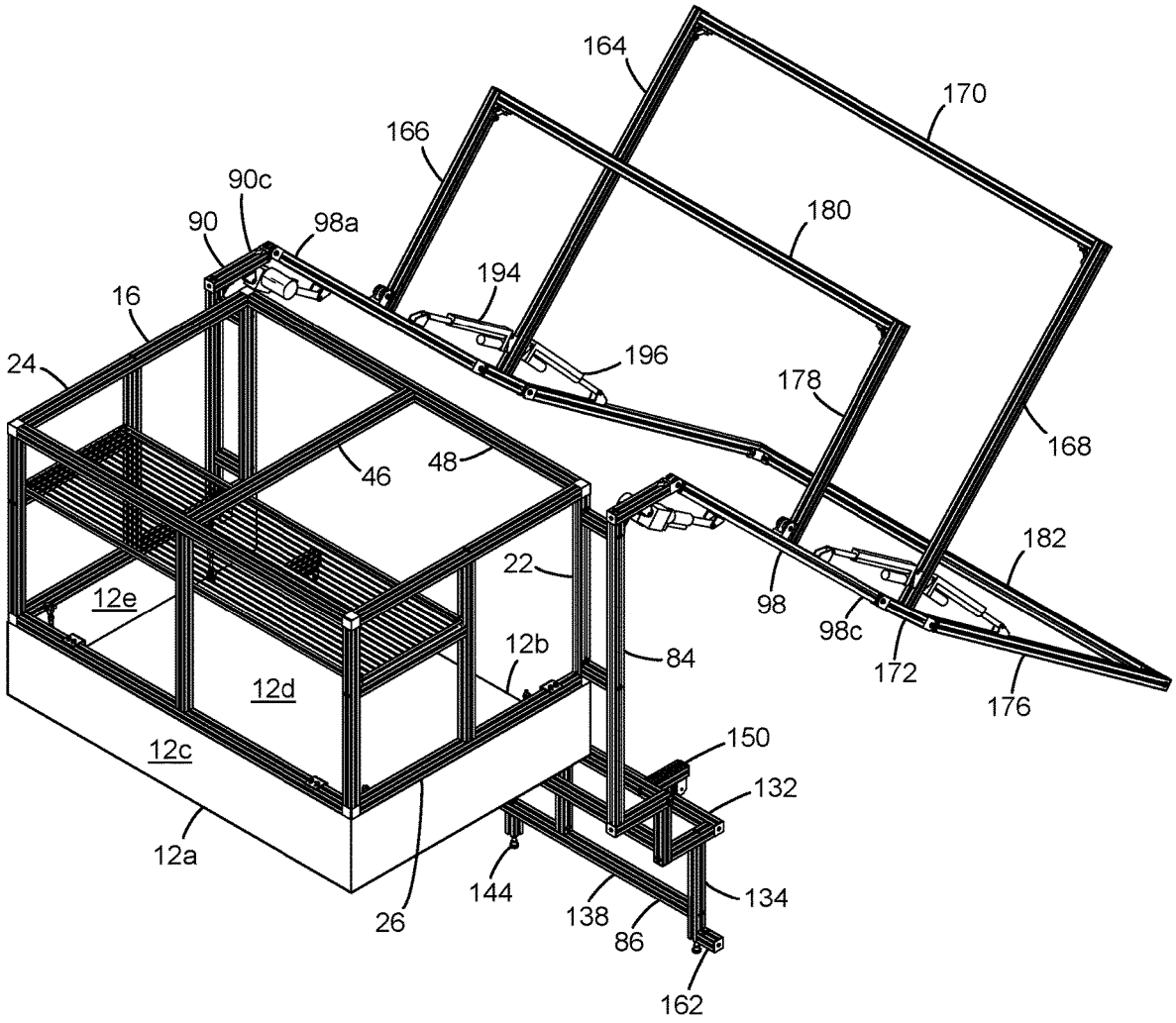
FIG. 6 is a rear perspective view of the preferred embodiment of the present invention illustrating a box frame mounted to an open cargo bay of a vehicle and connecting to a moveable frame assembly presented in expanded, open form.

Likewise, in FIG. 36, a second pair of linear actuators 194 each extendably spans the connective arrangement of the sideward arm and sideward member of the primary canopy to afford pivotal rotation relatively about the mating pivot brackets designated at PB-C, whereby the sideward member 168 primarily travels along path C in direction C' to generally reside in proximity to the sideward arm 98 as well as the secondary canopy 166 to effect a compact relationship thereof as in FIGS. 5 and 8, and conversely, along path C in direction C" to extend outwardly from the sideward arm to effect a fully expanded relationship and near linearity of the shortened arm with that of the sideward arm as in FIGS. 6 and 19. Each linear actuator in association with the second pair is mounted intermediate along the sideward arm and sideward member by means of the mount brackets 188, whereby cap screws 192 or equivalent are placed within apertures 188*a* extending through the bottom plate 188*b* of the mount bracket as well as the sideward arm and sideward member and appropriately fitted with the assembly of washers and nuts 192*a* to affix the mount bracket's desired position.

Figure 7:
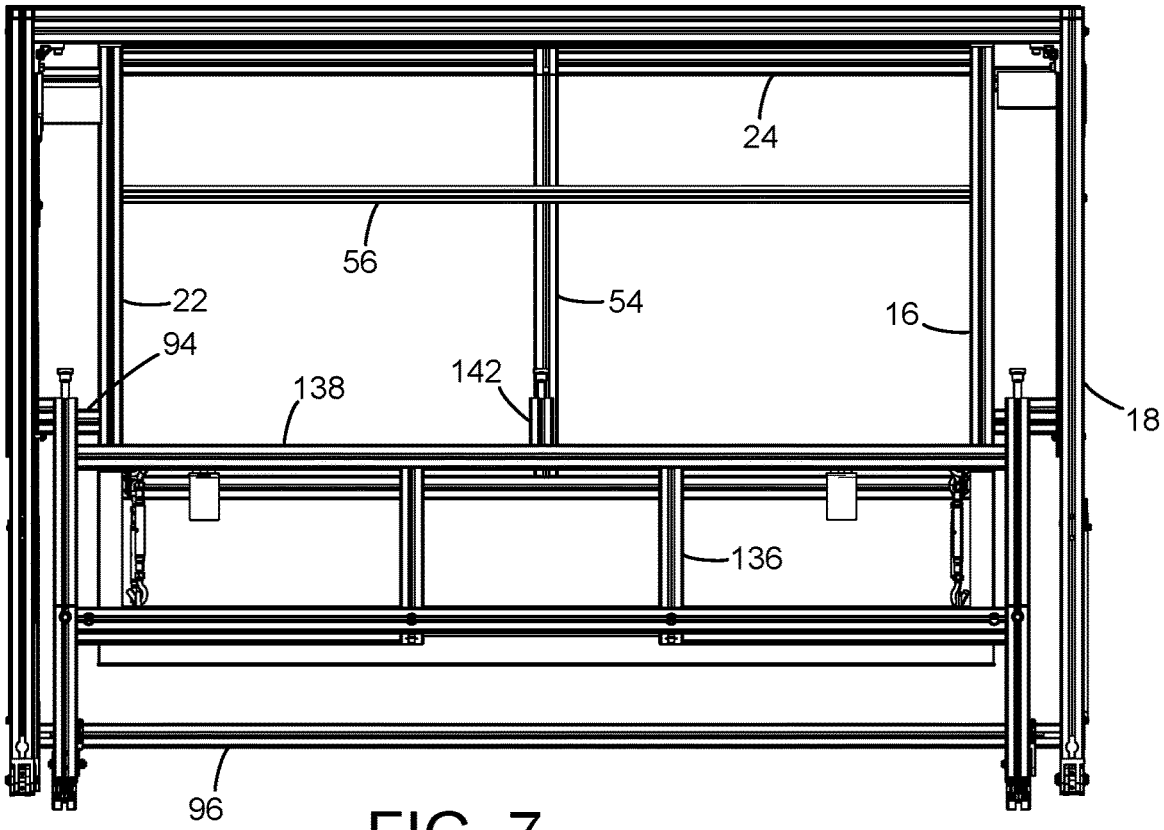
FIG. 7 is a front elevational view of the preferred embodiment of the present invention illustrating a movable frame assembly in a folded, compact position.

Finally, in FIG. 36, a third pair of linear actuators 196 each extendably spans the connective arrangement of the sideward member 168 of the primary canopy 164 and sideward support 174 of the ground brace 176 to afford pivotal rotation relatively about the mating pivot brackets designated at PB-D, whereby the sideward support primarily travels along path D in direction D' to generally reside in proximity to the sideward member of primary canopy to effect a compact relationship thereof as depicted in FIGS. 7 and 8, and conversely, along path D in direction D" to extend outwardly from the sideward member to effect a fully expanded relationship and linearity of the shortened arm 184 of the primary canopy with that of the sideward support as generally depicted in FIG. 6. Each linear actuator in association with the third pair is mounted intermediate along the sideward member 168 and sideward support 174 by means of the mount brackets, whereby cap screws or equivalent are placed within apertures extending through the bottom plate 188*b* of the mount bracket 188 as well as the sideward member and sideward support and appropriately fitted with the assembly of washers and nuts 192*a* to affix the mount bracket's desired position.

Figure 47:
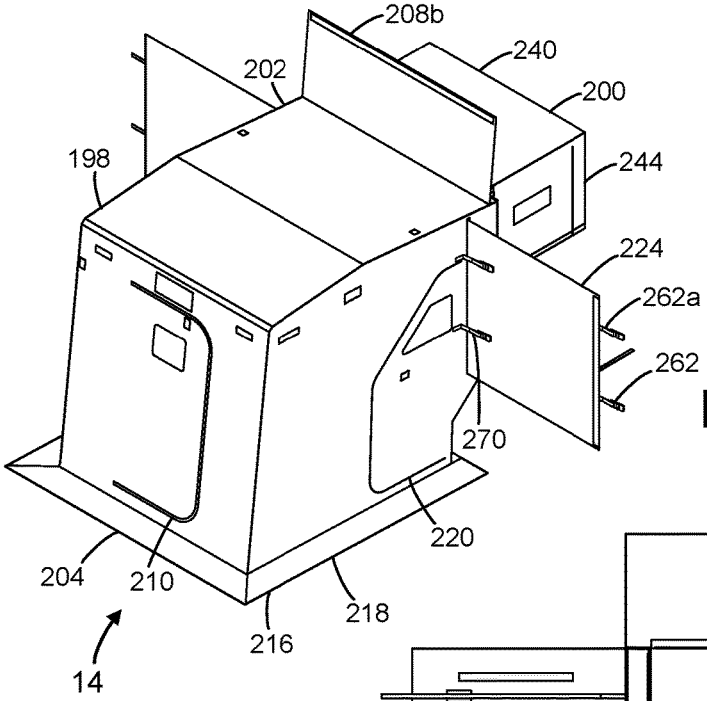
FIG. 47 is a top perspective view of the preferred embodiment of the present invention illustrating a primary shelter shell joining to a secondary shelter shell.
Figure 48:
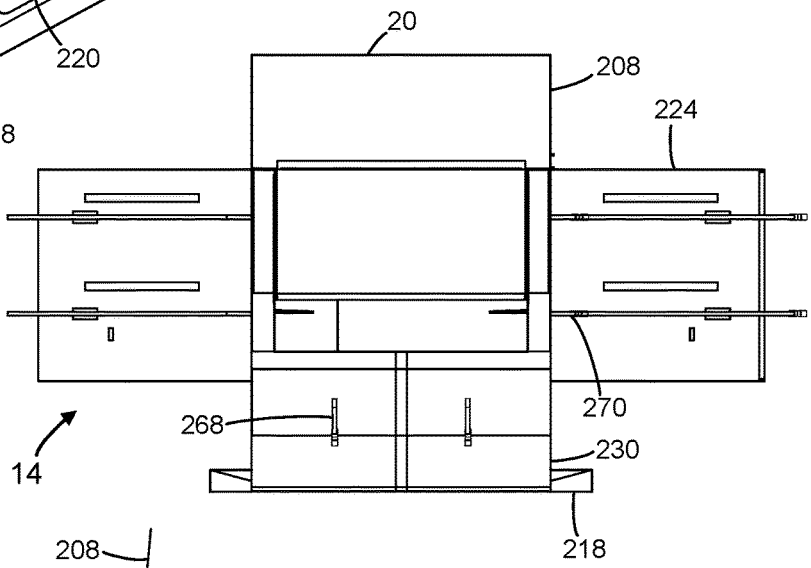
FIG. 48 is a front elevational view of the preferred embodiment of the present invention illustrating a primary shelter shell joining to a secondary shelter shell.
Figure 49:
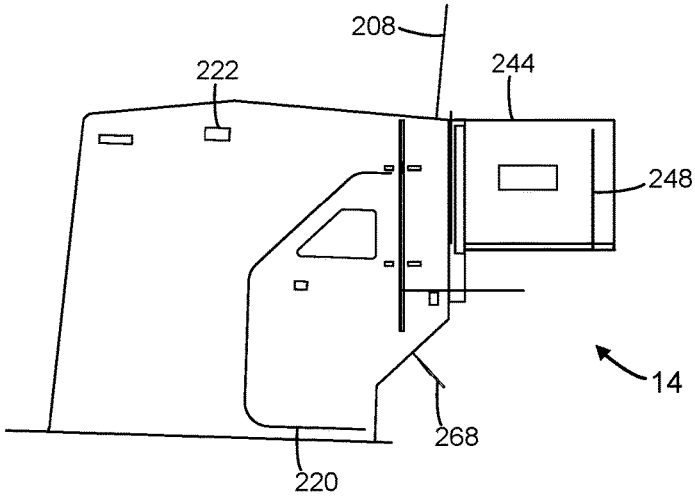
FIG. 49 is a side elevational view of the preferred embodiment of the present invention illustrating a primary shelter shell joining to a secondary shelter shell.

As generally shown in FIGS. 47-49, the protective shell assembly 14 comprises a primary shelter shell 198 designated for use with the moveable frame assembly 18 and a secondary shelter shell 200 designated for use with the box frame that generally exists separable from the primary shelter shell, but semi-permanently attached thereto to facilitate assembly and disassembly for repairs that may be needed from time to time, for example, as well as providing for varied use of the box frame 16, with and without the secondary shelter shell, apart from the moveable frame assembly 18, with and without the primary shelter shell, and vice versa.

The primary shelter shell, as represented in FIGS. 47 and 50-53, includes a top-rearward panel 202 integrally including a bottom outward flap 204 to engage with the ground's surface that functionally mitigates updrafts into an interior compailinent 206 of the portable shelter and an extending top flap 208 of the integral assembly of flaps 20 used in part to encase the moveable frame assembly while presented in collapsible form for transportational purposes. Other notable features of the top-rearward panel as in FIG. 50 include an integrated rearward access door 210 operably configured with a zipper 210*a* or equivalent type of closure mechanism for sealing the doorway and one or more windows 212 with each having a closable flap 214 configured with a hook-and-loop fastener 214*a* or equivalent attached along a top side thereof.

In FIGS. 49 and 54-57, the primary shelter shell 198 further includes a pair of side panels 216 each including common perimeter edge 216*a* sewnly attached to and along a common sideward edge 202*a* of the top-rearward panel, a bottom outward flap 218, an integrated door 220 to the likes set forth for the top-rearward panel, one or more sealable air vents 222, an elongate sideward flap 224 possessing protective functionality substantially equivalent to the extending top flap 208 for transportational purposes, and a sideward closure flap 226 for enclosing an elongate area 228 formed in between the supportive wind wall 84 and corner post 22 of the box frame 16.

In further association with the primary shelter shell 198, as shown in FIGS. 48 and 58-64, a pair of bottom panels 230 is fixedly positioned relatively about the lower wind wall 86, where in particular each bottom panel includes an outer sideward edge 230*a* sewnly attached to a lower perimeter edge 216*b* of the side panel and a common interior edge 230*b* configured with a hook-and-loop fastener 232 or equivalent to engagingly mate with a complementary hook-and-loop fastener 232*a* or equivalent associated with the adjacent, companion bottom panel 234.

Figure 50:
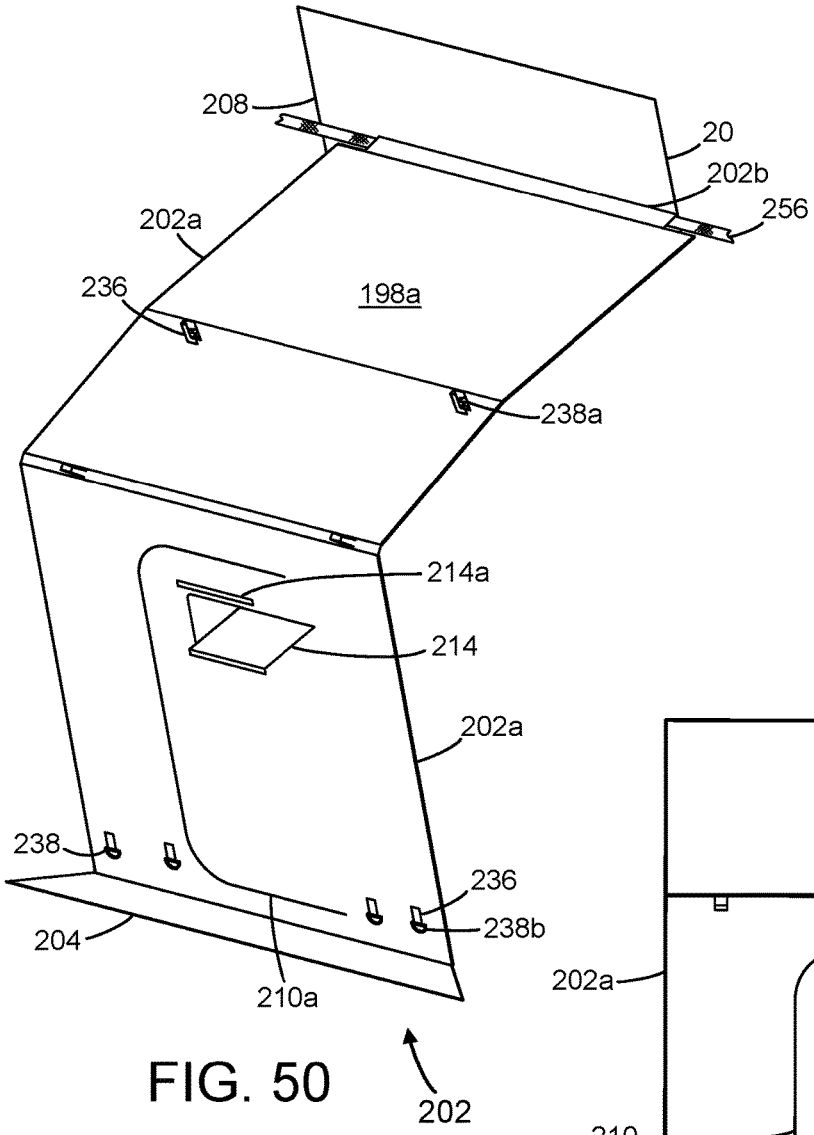
FIG. 50 is a bottom perspective view of the preferred embodiment of the present invention illustrating a top-rearward panel of a primary shelter shell.
Figure 51:
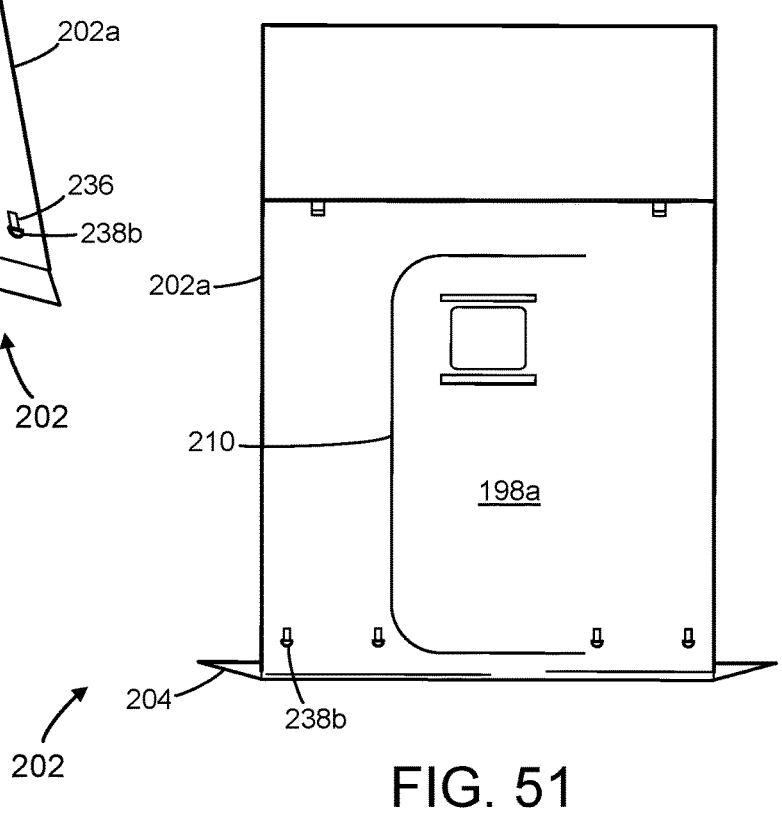
FIG. 51 is a rear elevational view of the preferred embodiment of the present invention illustrating a top-rearward panel of a primary shelter shell and having an integrated rearward access door.
Figure 52:
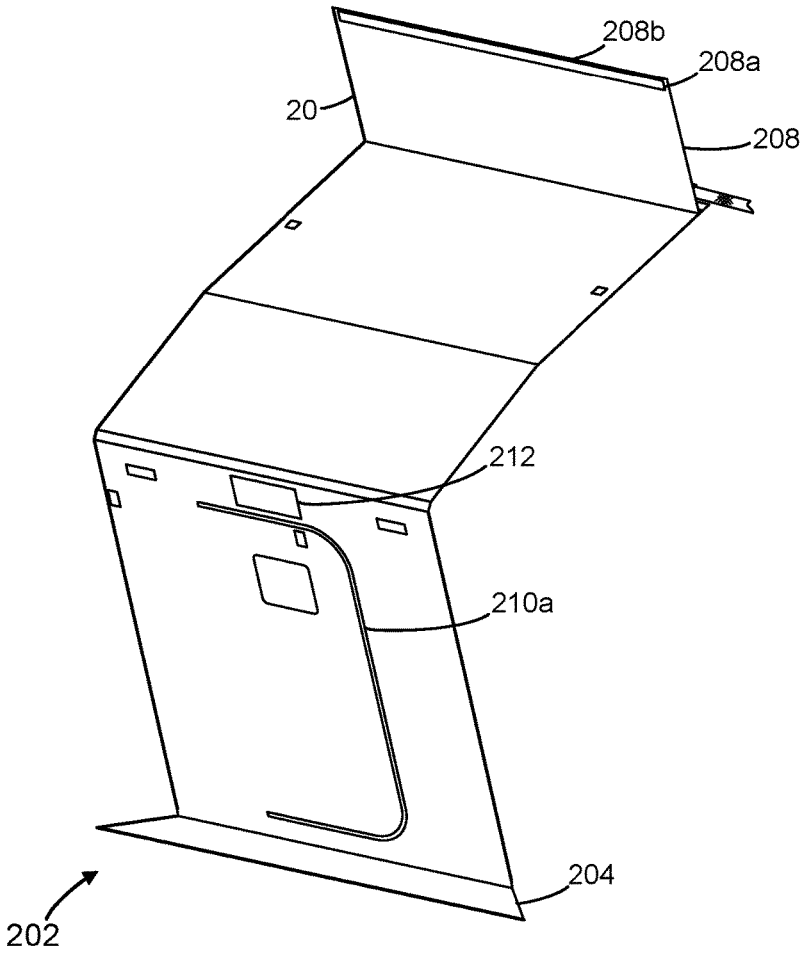
FIG. 52 is a top perspective view of the preferred embodiment of the present invention illustrating a top-rearward panel of a primary shelter shell.
Figure 53:
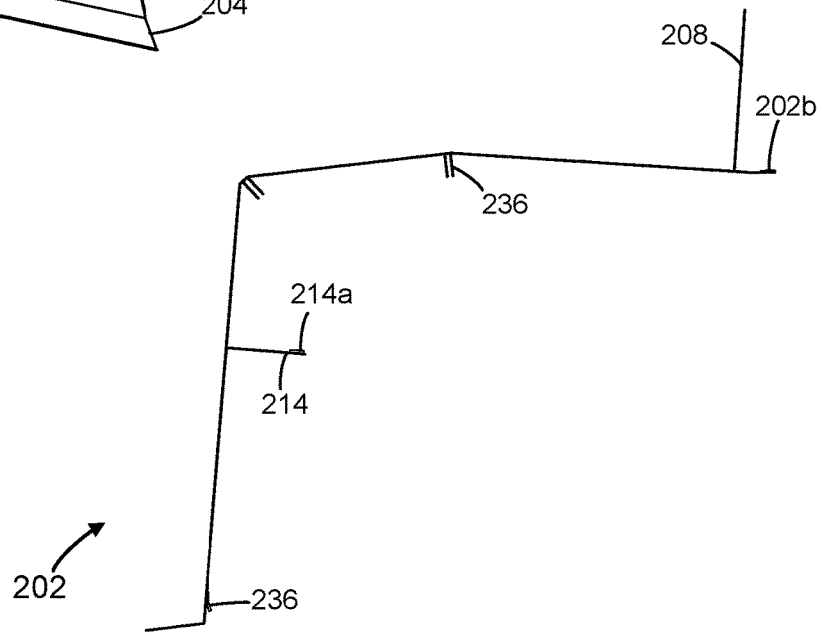
FIG. 53 is a side elevational view of the preferred embodiment of the present invention illustrating a top-rearward panel of a primary shelter shell.
Figure 54:
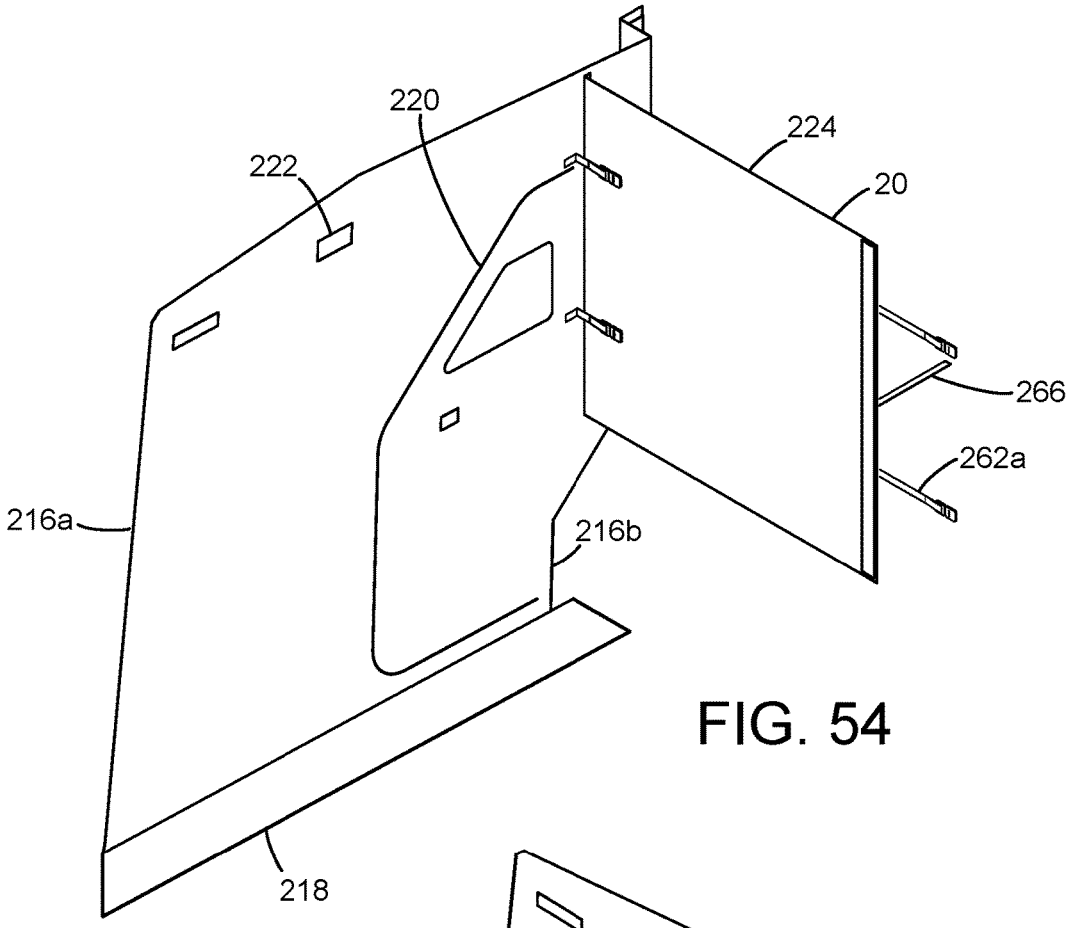
FIG. 54 is a side perspective view of the preferred embodiment of the present invention illustrating a side panel of a primary shelter shell and having an integrated door and an elongate sideward flap.
Figure 55:
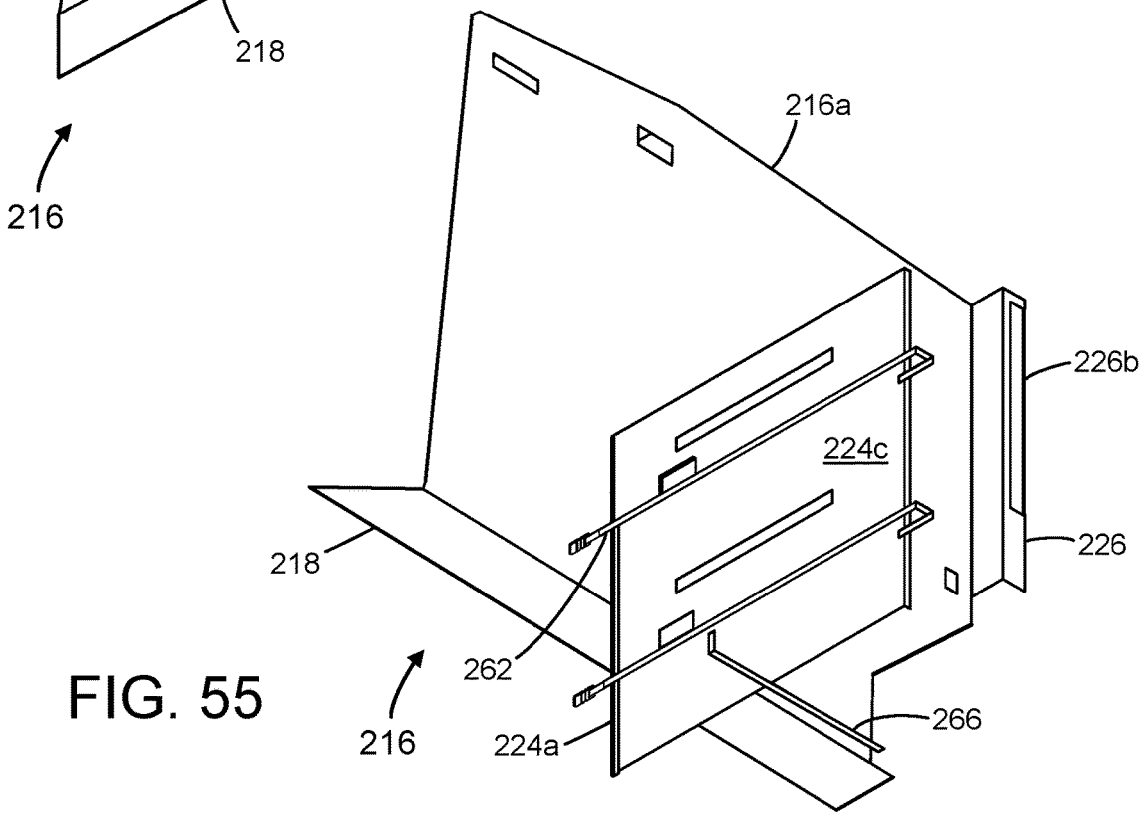
FIG. 55 is a front perspective view of the preferred embodiment of the present invention illustrating a side panel of a primary shelter shell and having an integrated door, an elongate sideward flap, and a sideward closure flap.
Figure 56:
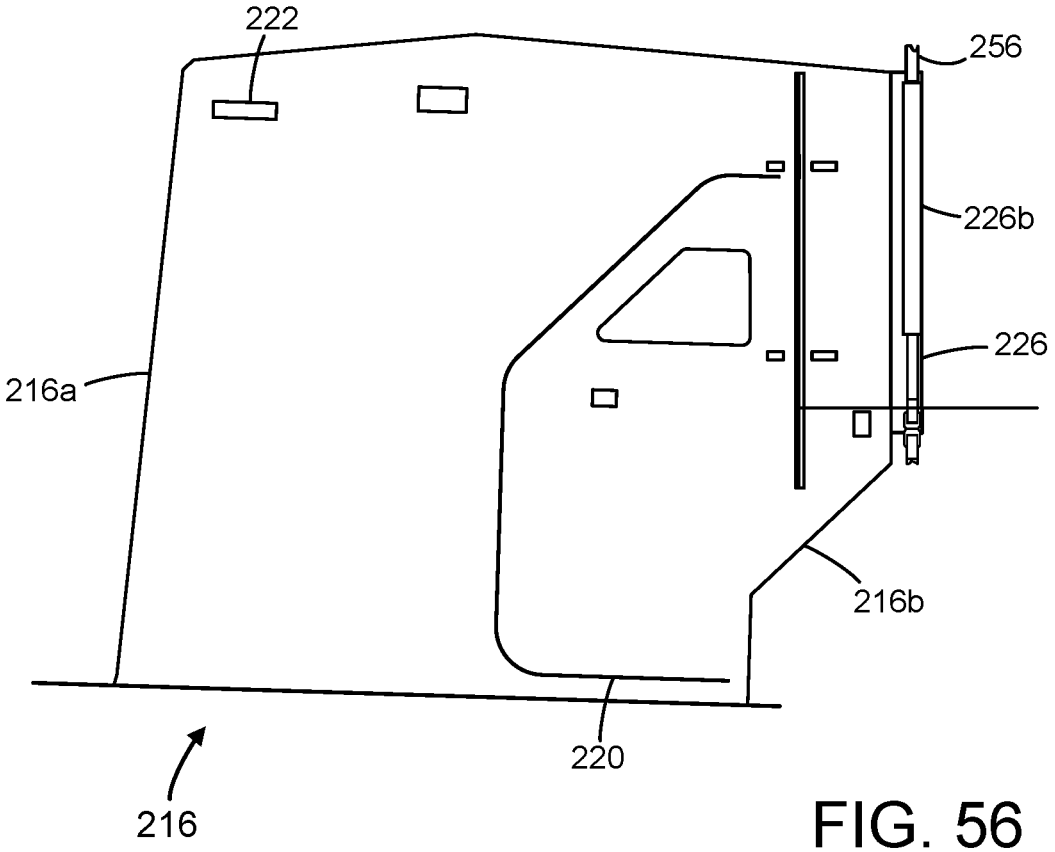
FIG. 56 is a side elevational view of the preferred embodiment of the present invention illustrating a side panel of a primary shelter shell and having an elongate sideward flap configured with a formed sleeve.
Figure 57:
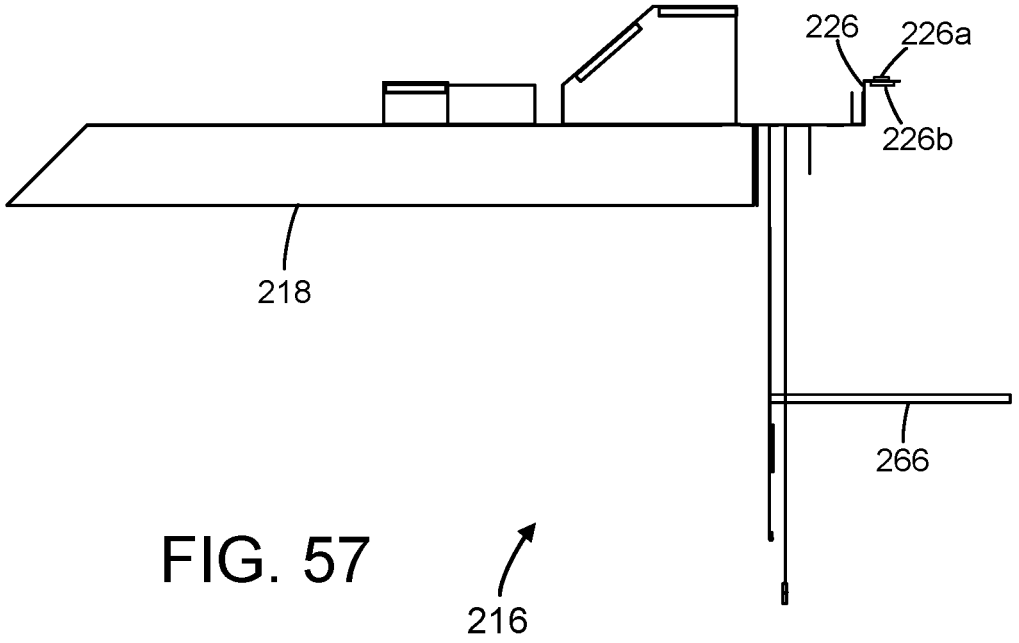
FIG. 57 is a top plan view of the preferred embodiment of the present invention illustrating a side panel of a primary shelter shell and having a bottom outward flap.
Figure 58:
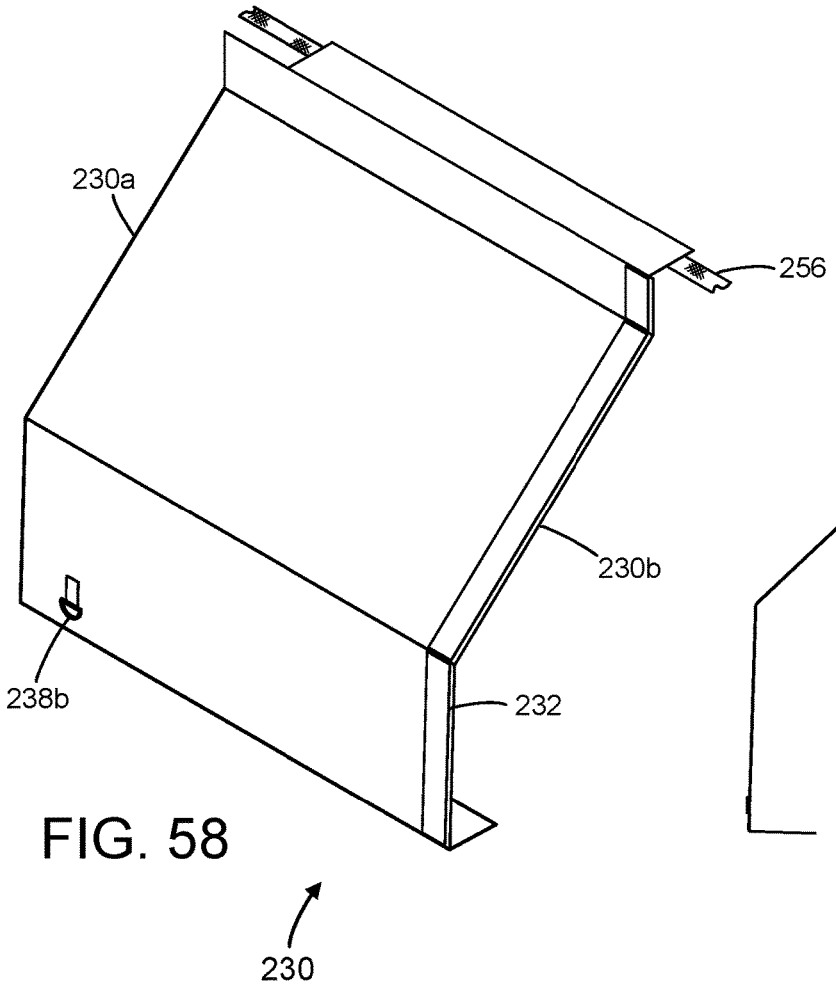
FIG. 58 is a rear perspective view of the preferred embodiment of the present invention illustrating one bottom panel of a pair of bottom panels and having a formed sleeve.
Figure 59:
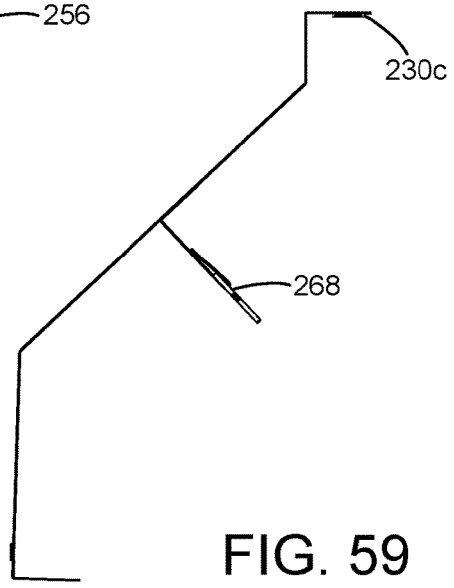
FIG. 59 is a side elevational view of the preferred embodiment of the present invention illustrating one bottom panel of a pair of bottom panels and configured with a buckle and strap assembly.
Figure 60:
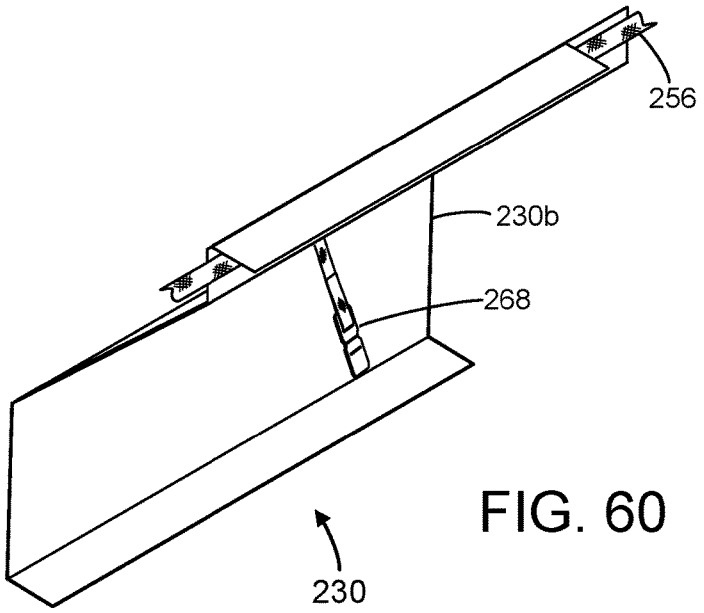
FIG. 60 is a front perspective view of the preferred embodiment of the present invention illustrating one bottom panel of a pair of bottom panels and configured with a buckle and strap assembly.
Figure 61:
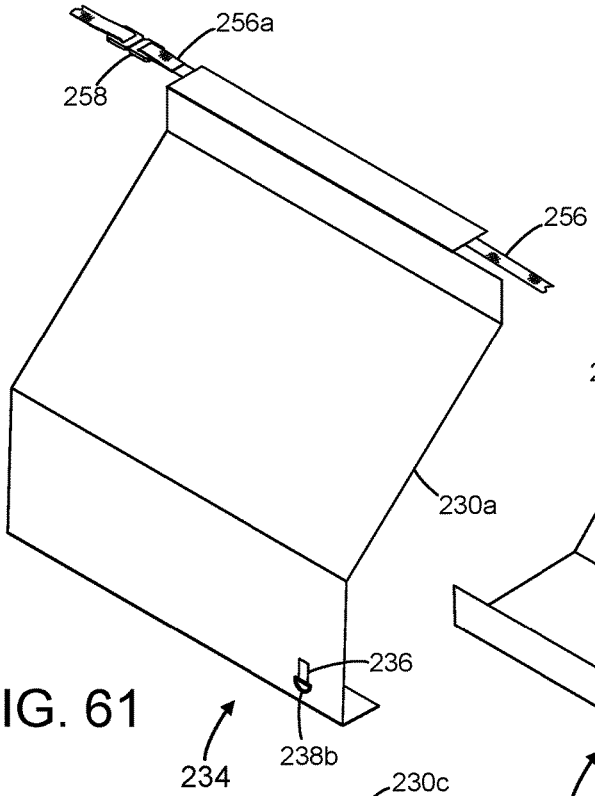
FIG. 61 is a rear perspective view of the preferred embodiment of the present invention illustrating a companion bottom panel of a pair of bottom panels and having a formed sleeve.
Figure 62:
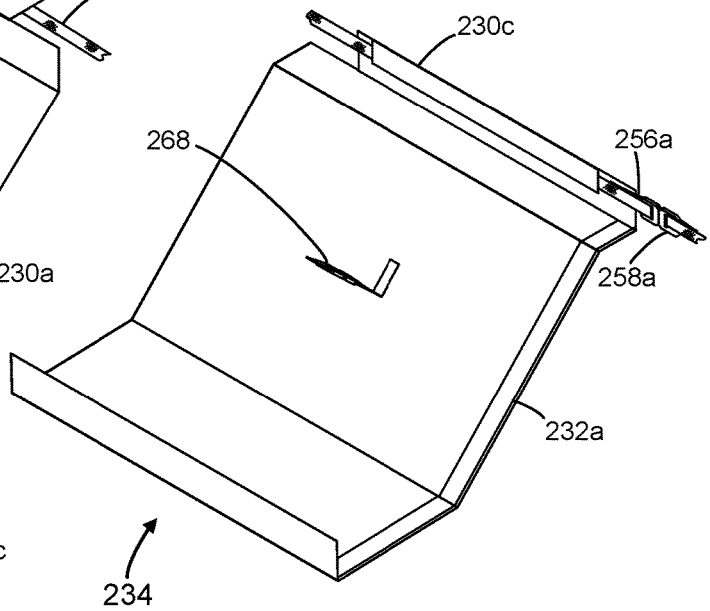
FIG. 62 is a front perspective view of the preferred embodiment of the present invention illustrating a companion bottom panel of a pair of bottom panels and having a formed sleeve.
Figure 63:
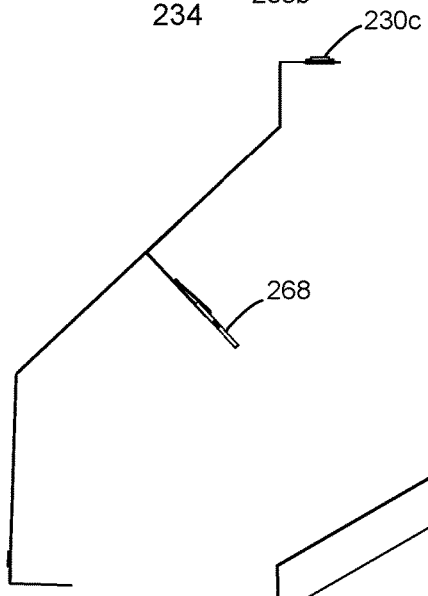
FIG. 63 is a side elevational view of the preferred embodiment of the present invention illustrating a companion bottom panel of a pair of bottom panels and having a buckle and strap assembly.
Figure 64:
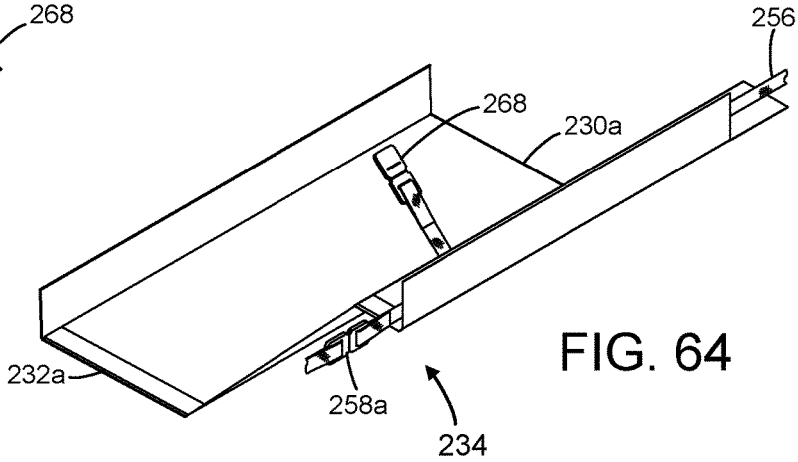
FIG. 64 is a top perspective view of the preferred embodiment of the present invention illustrating a companion bottom panel of a pair of bottom panels and having a buckle and strap assembly.
Figure 65:
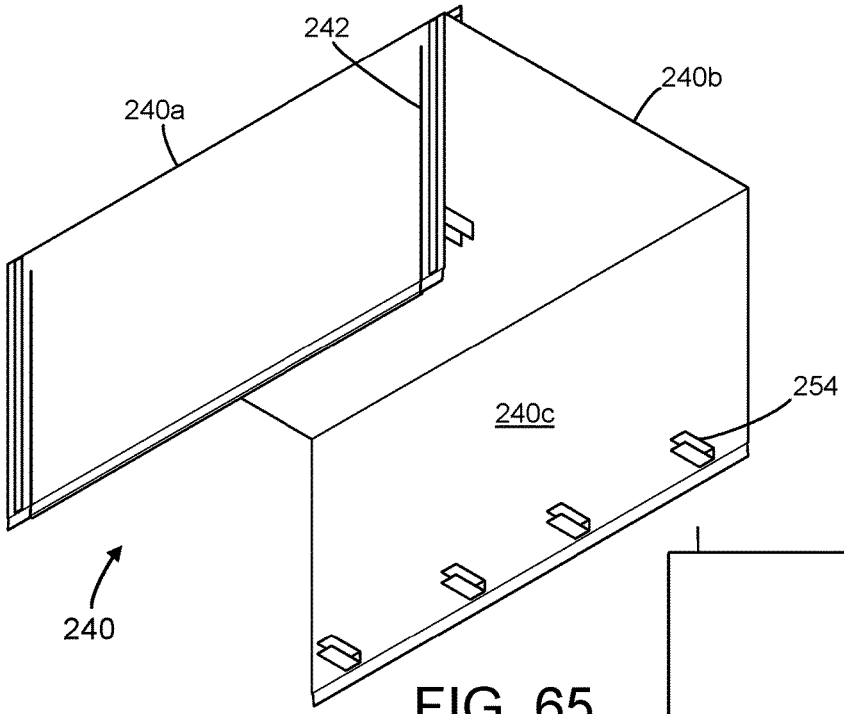
FIG. 65 is a bottom perspective view of the preferred embodiment of the present invention illustrating a frontal-top-rearward panel of a secondary shelter shell.
Figure 66:
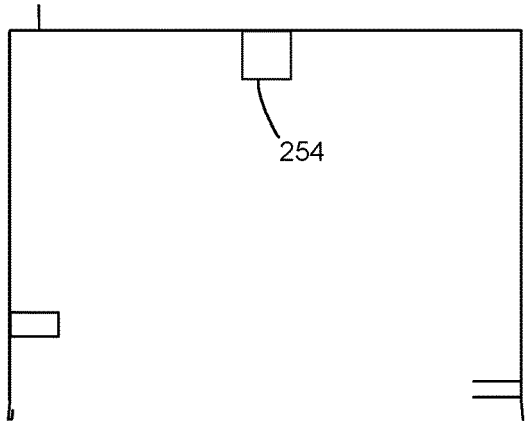
FIG. 66 is a side elevational view of the preferred embodiment of the present invention illustrating a frontal-top-rearward panel of a secondary shelter shell.
Figure 67:
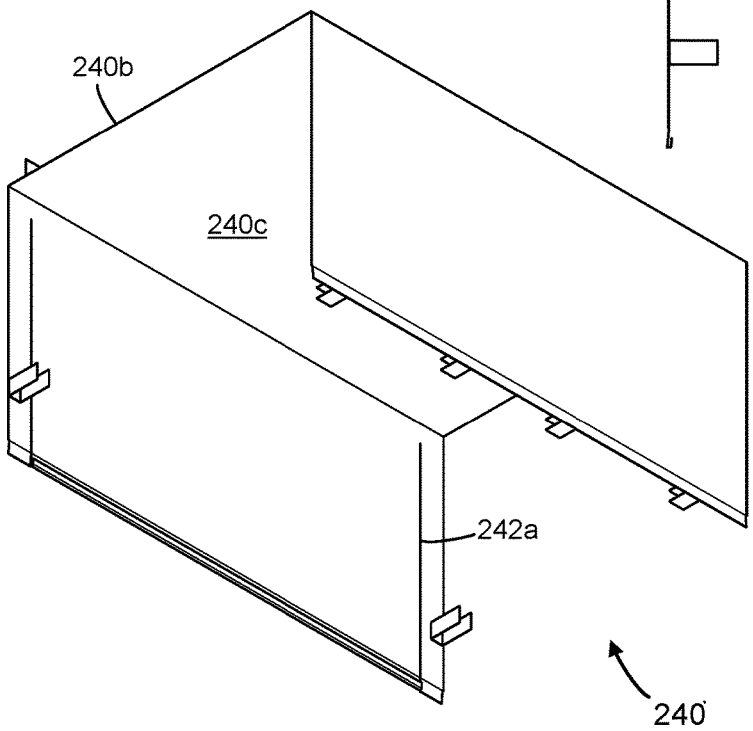
FIG. 67 is a bottom perspective view of the preferred embodiment of the present invention illustrating a frontal-top-rearward panel of a secondary shelter shell and having an access door.
Figure 68:
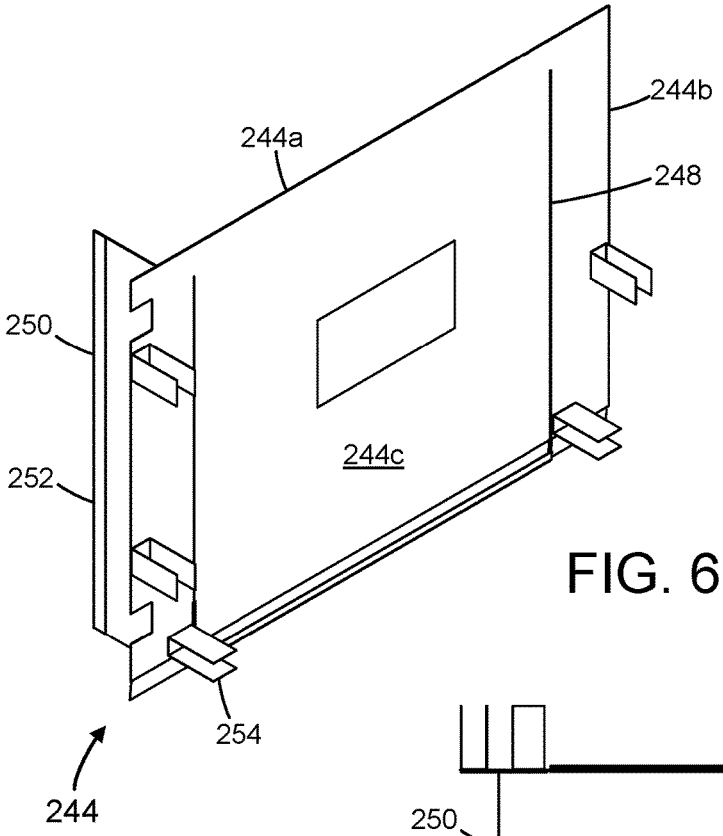
FIG. 68 is a top perspective view of the preferred embodiment of the present invention illustrating a box side panel of a secondary shelter shell.
Figure 69:
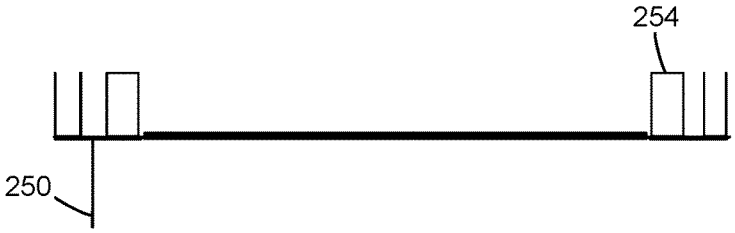
FIG. 69 is a bottom plan view of the preferred embodiment of the present invention illustrating a box side panel of a secondary shelter shell.
Figure 70:
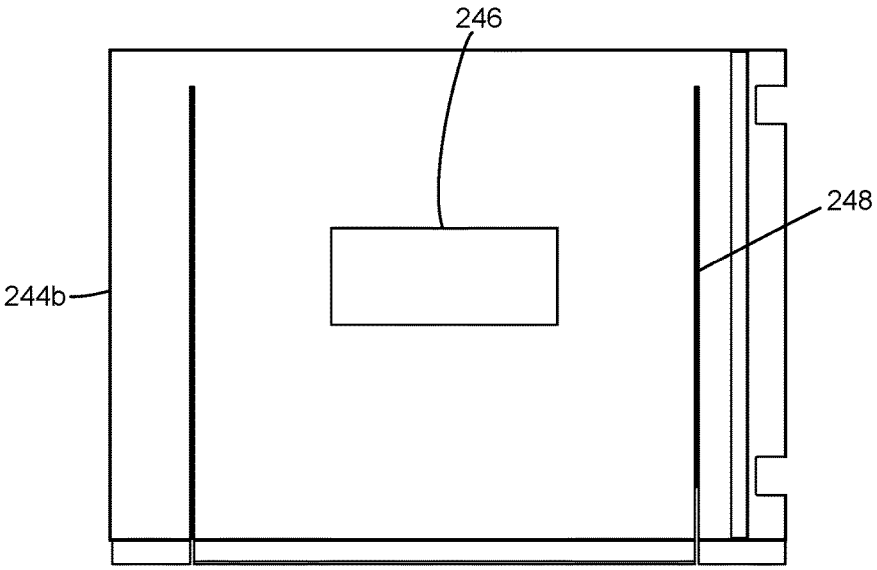
FIG. 70 is a side elevational view of the preferred embodiment of the present invention illustrating a box side panel of a secondary shelter shell and having a zippered door.

Connection of the primary shelter shell to the moveable frame assembly 18 as in FIGS. 50 and 51 is mainly provided by multiple straps 236 extending outwardly from and attaching to an interior surface 198*a* of the primary shelter shell. Each of the straps generally incorporates at its end a fastener 238 in the form of a hook-and-loop fastener 238*a*, a D-ring 238*b*, snap, button, or other suitable types generally recognized in the art for fulfilling this purpose. Configuration and securement of the straps 236 specifically in relation to the cross member of the primary canopy, cross support of the secondary canopy, and cross member of the ground brace generally involves encircling the straps around each of the foregoing structures and affixing their position with the fastener. FIGS. 50, 58 and 61 illustrate exemplarily availability of straps individually configured with a D-ring to effect connection of the top-rearward panel 202 to available structure of the cross member 182 of the ground brace 176 and bottom panels 230, 234 to the lower wind wall 86.

Comparatively, the secondary shelter shell 200, as generally depicted in FIGS. 49 and 65-70, is shown therein as including a frontal-top-rearward panel 240 selectively positioned over front, top and back sides of the box frame 16, whereby a rearward side 240*a* of the frontal-top-rearward panel includes an access door 242 configured with a zipper 242*a* or equivalent closure mechanism to possibly cordon off an interior space formed by the box frame and interior area of the moveable frame assembly or offer complete enclosure of the box frame 16, generally in instances of desirable non-use of or being disassembled apart from the moveable frame assembly 18.

Figure 2:
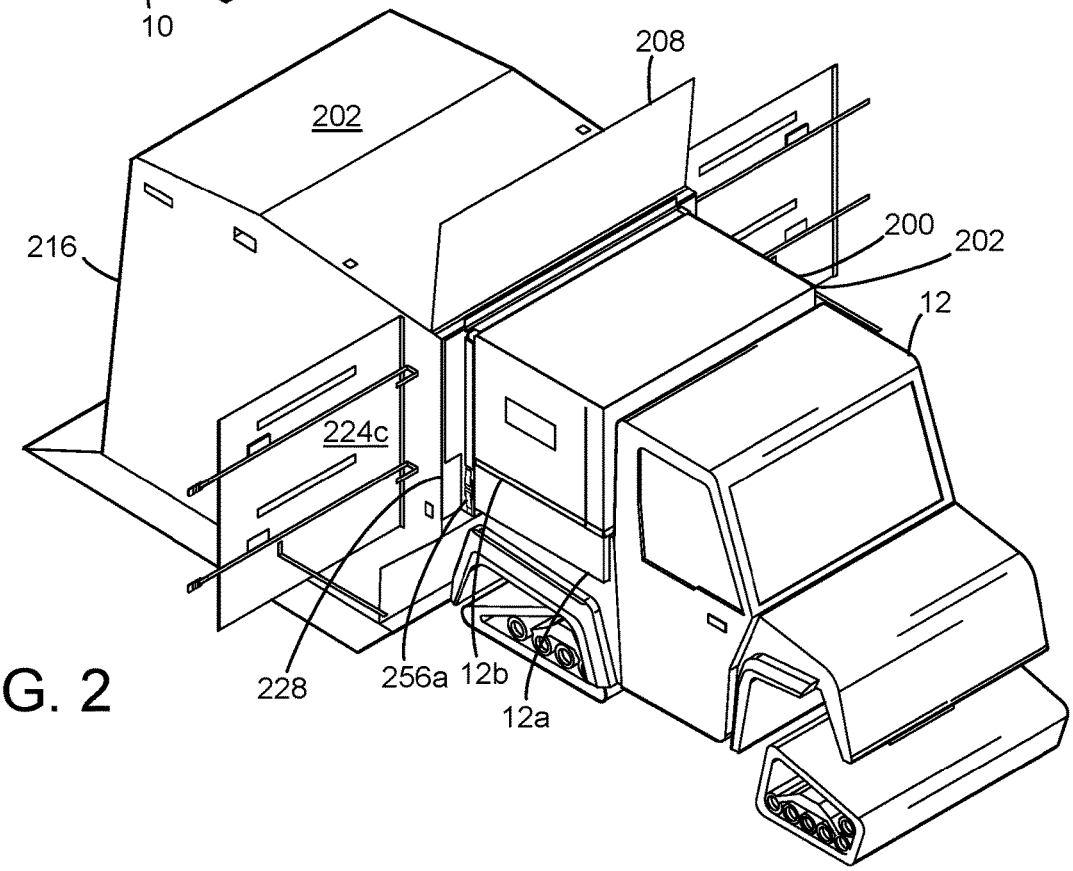
FIG. 2 is a front perspective view of the preferred embodiment of the present invention illustrating a primary shelter shell joined to a secondary shelter shell collectively covering a box frame and a moveable frame assembly and being attached to a vehicle.
Figure 3:
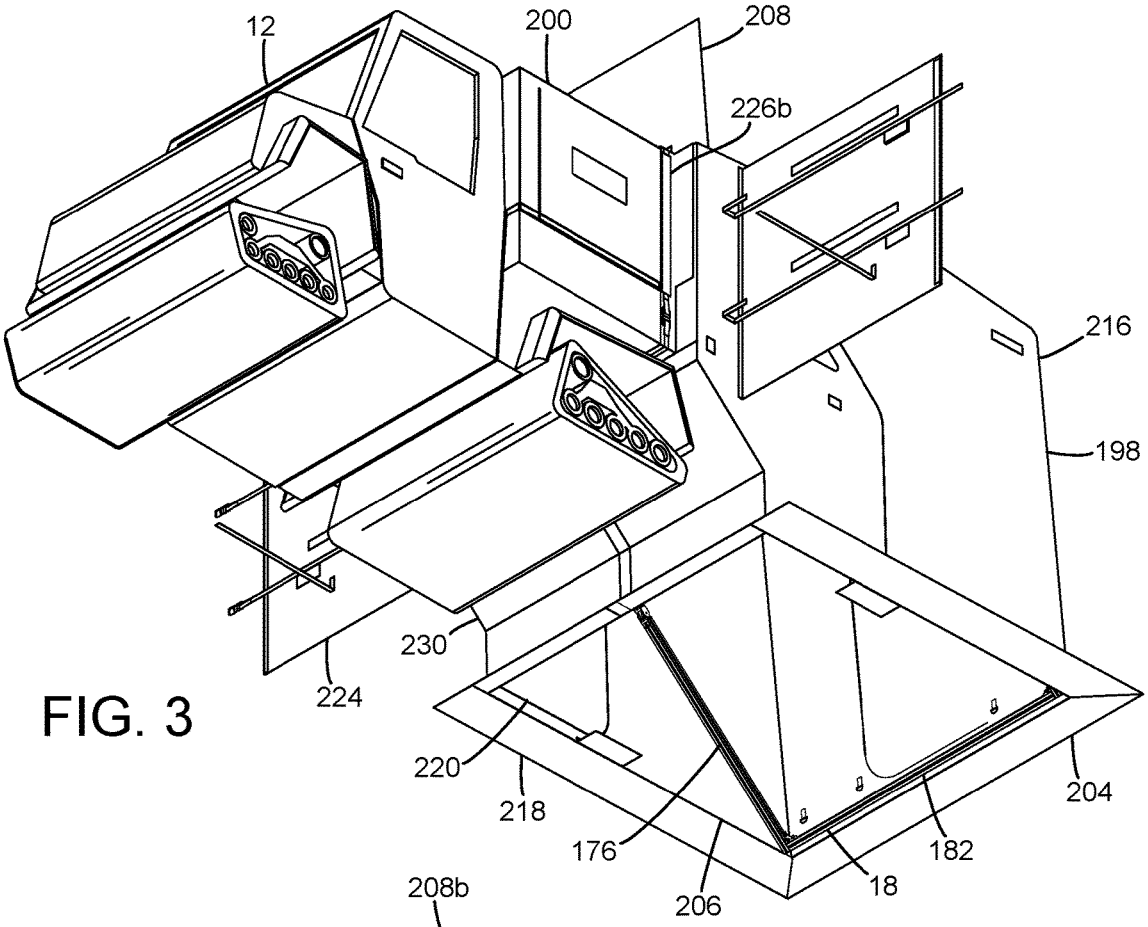
FIG. 3 is a bottom perspective view of the preferred embodiment of the present invention illustrating a primary shelter shell connecting to a secondary shelter shell operably attached to a vehicle.
Figure 4:
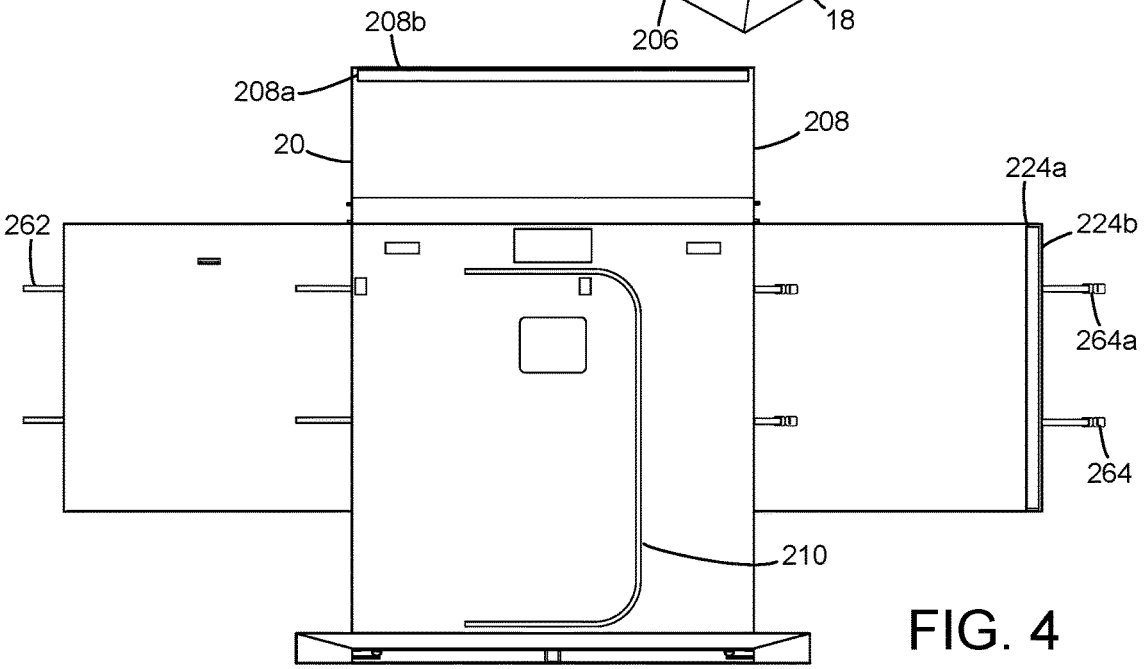
FIG. 4 is a rear elevational view of the preferred embodiment of the present invention illustrating a primary shelter shell having an extending top flap and a pair of elongate sideward flaps.

In completing enclosure of the box frame, as depicted in FIG. 49, the secondary shelter shell 200 includes a pair of box side panels 244 each having an upper perimeter 244*a* and a pair of sideward edges 244*b* sewnly attached to a common sideward edge 240*b* of the frontal-top-rearward panel 240. Other aspects of each box side panel as in FIGS. 68 and 70 include an optional window 246 and zippered door 248 to gain convenient access to the interior space of the box frame and an integral sideward flap 250 configured with a hook-and-loop fastener 252 that selectively mates with a hook-and-loop fastener 226*a* integral to the structure of the sideward closure flap 226 of the side panel 216, of which supplementally serves to protectively enclose the elongate area 228 formed in between the upright support of the supportive wind wall and corner post 22 of the box frame. Connection of the secondary shelter shell 200 to the box frame 16 is fulfilled by a plurality of straps 254 with each extending outwardly from an interior side 240*c*, 244*c* of the frontal-top-rearward panel and box side panel 244 and being configured with a fastener of the type generally associated, for example, with the top-rearward panel. In advancing a tight seal between the primary shelter and secondary shelter shells, an assembly of segmented straps 256 as in FIG. 2 are provided to slidably fit and reside within a formed sleeve 226*b*, 202*b*, 230*c* respectively integral to the sideward closure flap 226 of the side panel 216, top-rearward panel 202, and pair of bottom panels 230. Fasteners 258 in the form of a buckle 258*a*, hook-and-loop fasteners, snaps, buttons, or equivalent provide means for connecting together ends 256*a* of the segmented straps.

Now by way of briefly exemplifying description of the assembly and functionally of the portable shelter 10, one may appreciably gain further insight into the relatedness and interaction of the operative components discussed thus far that principally fulfill the utilitarian objects of the invention.

The box frame 16 is initially assembled by way of connecting together the corner posts 22 with that of the upper and lower horizontal members 24, 26 with structural provisions being made for mounting one or more shelves. The resultant box frame is selectively positioned about the sidewalls 12*c* of the open cargo bay and partially fitted with the secondary shelter shell 200 before finalizing attachment to the open cargo bay 12*a* by way of the turnbuckles 68.

Comparatively, the moveable frame assembly 18 is preferably assembled in whole as a structure without the primary shelter shell 198 before being fixedly attached to the box frame, where in particular the supportive wind wall 84 pivotally connects to the lower wind wall 86 and the pair of sideward arms 98 followed by the primary canopy pivotally connecting to the sideward arms, the ground brace 176 pivotally connecting to the primary canopy 164, and the secondary canopy 166 pivotally connecting to the sideward arms. In fulfilling automated operation for contraction and expansion of the portable shelter 10, multiple pairs of linear actuators 184 are selectively mounted within the structure of the moveable frame assembly.

The first pair of linear actuators 190 connectively spans from the supportive wind wall to the sideward arms 98, of which effects pivotal movement of the sideward arms outwardly from and inwardly toward the supportive wind wall 84 along path B in FIG. 36. The second pair of linear actuators 194 connectively spans from the sideward arms 98 to the primary canopy, of which effects pivotal movement of the primary canopy 164 outwardly from and inwardly toward the sideward arms along path C in FIG. 36. The third pair of linear actuators 196 connectively spans from the primary canopy to the ground brace 176, of which effects pivotal movement of the ground brace outwardly from and inwardly toward the primary canopy along path D in FIG. 36. By and through the operation of the three pairs of linear actuators, the secondary canopy will experience pivotable movement relatively about its associative pivot bracket PB-E and will sustain movement along path E in direction E' in FIG. 36 to attain a degree of compactness with that of the primary canopy 164 and ground brace 176 in proximity to the sideward arm 98 as in FIG. 8, and conversely, will expand outwardly from its compact state along path E in direction E" in FIG. 36 as a result of its connection to the primary shelter shell 198 during setup of the portable shelter 10 for purposes of occupancy.

Figure 71:
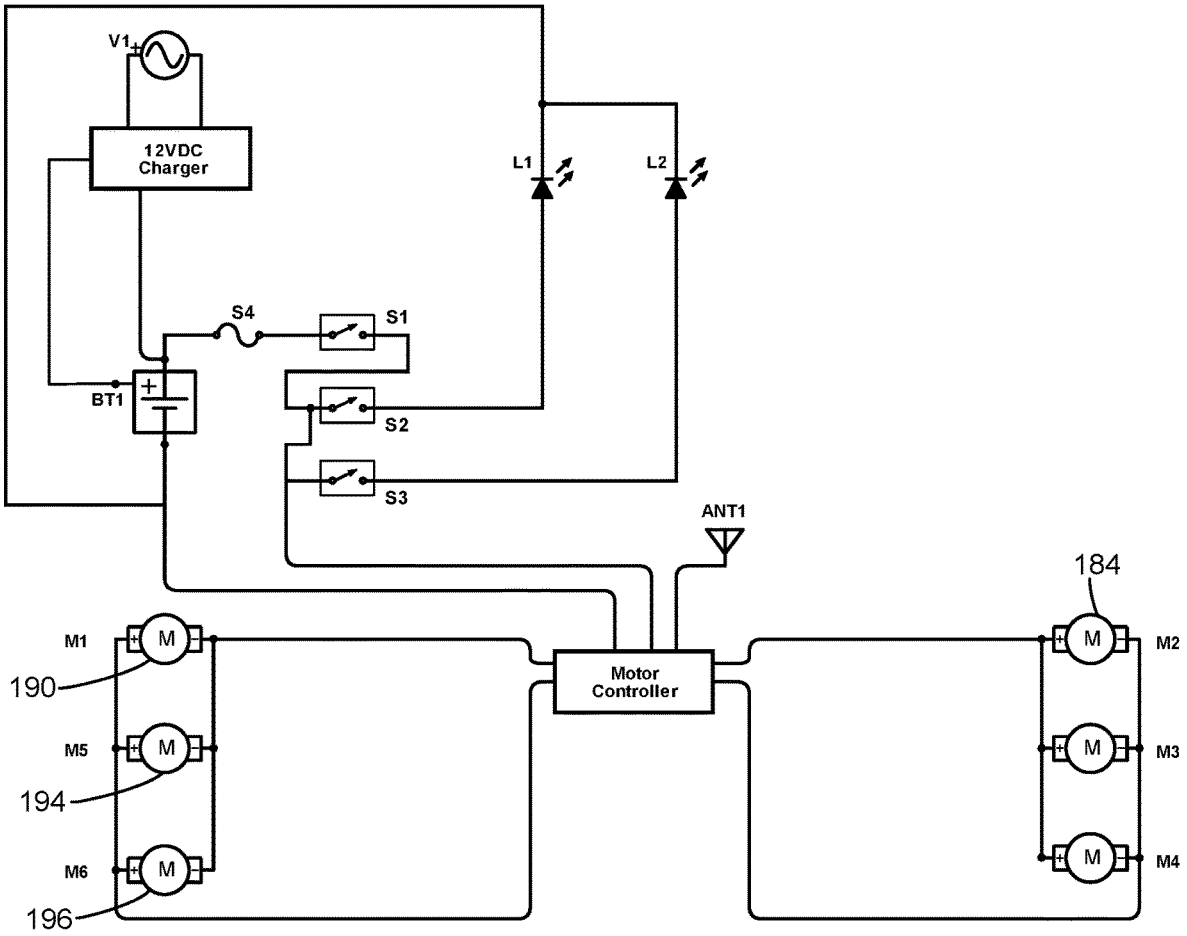
FIG. 71 is a schematic view of the preferred embodiment of the present invention illustrating electrical connections associated with operation of multiple linear actuators.

Control and operation of the linear actuators in this regard is preferably maintained by controller means, which principally comprises an on-board 12V power source BT1 communicatively coupled to a 12 VDC charger and multiple switches S1, S2, S3, S4 coupled in series to synchronize simultaneous operation of motors M1-M6 associated with the three pairs of linear actuators 184 via a motor controller, as schematically represented in FIG. 71.

Once in assembled form, the moveable frame assembly 18 is selectively located in vicinity of the box frame and positioned to rest upon detachable clevis pins 260 temporarily affixed to and extending outwardly from the rearward corner posts 22 of the box frame 16, whereupon cap screws 50*a* or equivalent of the first common connective assembly 50 are inserted within cross bores 22*e* extending through the corner post and threadably engaged within the cylindrical bores 94*a* associated with the pairs of inward supports 94 of the supportive wind wall 84. After attachment in this regard, the detachable clevis pins are removed from the corner posts and the primary shelter shell is fitted relatively about and over the moveable frame assembly 18 and affixed thereto by means of the straps 236, with sideward closure flaps 226 of the side panel of the primary shelter shell engagingly mating with the integral sideward flap 250 of the box side panels 244 of the secondary shelter shell 200 by way of the hook-and-loop fasteners.

In operational configurations of the portable shelter 10, the moveable frame assembly, as associatively attached to the box frame 16, is presented in expanded form with and without attachment of the primary shelter shell 198, as in FIG. 6, and, conversely, in contracted form, as in FIGS. 7 and 8, to permit encasement thereof by way of the integral assembly of flaps 20, particularly the extending top flap 208 and elongate sideward flap 224, with provisions for securement thereof by multiple elongate straps 262 configured with fasteners 264 in the form of buckles 264*a*, hook-and-loop fasteners, snaps, buttons, ties, or equivalent, primarily in preparation of transport.

In a typical, yet preferred approach to protectively encase and wrap the portable shelter 10 for storage and transport, the elongate sideward flaps 224 are moved inwardly and folded to cover a majority of the primary shelter shell 198 from behind, whereby hook-and-loop fasteners 224*a* existing along an outer leading edge 224*b* engagingly mate with one another, while ends 262*a* of the elongate straps 262 are secured together by the buckle 264*a* or equivalent. Subsequently, a pair of lower elongate straps 266 each connectively extending from the elongate sideward flaps 224 are positioned to engagingly mate with a buckle and strap assembly 268 associated with the pair of bottom panels 230. In completing encapsulation of the contracted moveable frame assembly, the extending top flap 208 is downwardly folded over the connected arrangement of the elongate sideward flaps 224 to permit hook-and-loop fasteners 208*a*, 262*a* respectively associated with a leading edge 208*b* of the extending top flap and on an exterior surface 224*c* of the elongate sideward flaps to engagingly mate with one another. Comparatively, in instances where the moveable frame assembly 18 is expanded for utilitarian purposes of occupancy, the elongate sideward flaps may be rolled and bounded by one or more sideward straps 270 extending from and connecting to the side panels 216, whereby fasteners 270*a* such as a buckle or equivalent secures ends of sideward straps for fulfilling compact storage of the elongate sideward flaps alongside the side panels.

It is obvious that the components comprising the portable shelter 10 may be fabricated from a variety of materials, providing such selection or use of materials possess the capacity to withstand forces acting thereon throughout its duration of use as well as limiting occurrences of premature failure due to repeated forces acting thereon during contraction and expansion of the moveable frame assembly 18. Accordingly, it is most desirable, and therefore preferred, to construct the portable shelter 10, namely, components of the box frame 16 and moveable frame assembly from extruded aluminum, high tensile strength plastic, polymer composites, or an equivalent type of material that meaningfully offers reasonable structural strength for its weight, while limiting the extent by which the components may unacceptably fail due to applied stresses.

While there has been shown and described a particular embodiment of the invention, it will be obvious to those skilled in the art that various changes and alterations can be made therein without departing from the invention and, therefore, it is aimed in the appended claims to cover all such changes and alterations which fall within the true spirit and scope of the invention.

What is claimed is:

1. A portable multi-hinged shelter for attachment to a vehicle having an open cargo bay formed by sidewalls, said multi-hinged shelter comprising, in combination:

a box frame adaptively mounting atop of and connecting to the open cargo bay;

a supportive wind wall adaptively attaching to said box frame and being substantially positioned rearward of the vehicle;

a moveable frame assembly having a pair of sideward arms each having a first end pivotally connecting to said supportive wind wall and a second end, a primary canopy pivotally connecting to said second ends of the sideward arms, a secondary canopy pivotally connecting to said sideward arms relatively midway along thereof, and a ground brace pivotally connecting to said primary canopy; and a protective shell assembly adaptively fitting to and substantially covering said moveable frame assembly, said supportive wind wall, and said box frame.

2. The portable multi-hinged shelter as set forth in claim 1, further comprising a lower wind wall pivotally connecting to said supportive wind wall.

3. The portable multi-hinged shelter as set forth in claim 2, wherein said lower wind wall comprises a pair of end supports each having a first end and a second end, an upper horizontal beam having ends individually connecting to said first end of one of the end supports, a pair of running supports each having an outward end connecting to said second end of one of the end supports and an inward end, a pair of cantilevered supports each having a first end connecting along said upper horizontal beam and a second end connecting to said inward end of one of the running supports, a pair of outward vertical pillars each having a first end connecting along one of said end supports and a second end, a pair of inward vertical pillars each having a first end connecting along one of said cantilevered supports and a second end, a lower horizontal beam having a pair of outward ends each connecting substantially near said second end of one of the outward vertical pillars, a pair of vertical members each connecting to one of said end supports and having an opposing end, and a pair of anchoring supports each having a first end connecting to said supportive wind wall and a second end pivotally connecting to one of said vertical members in proximity to its opposing end.

4. The portable multi-hinged shelter as set forth in claim 3, further comprising surface-mounted pivot bracket assemblies each mountably connecting said secondary canopy to said sideward arms and said anchoring supports individually to one of said vertical members of the lower wind wall.

5. The portable multi-hinged shelter as set forth in claim 4, wherein said surface-mounted pivot bracket assembly comprises a first pivot bracket, a second pivot bracket and a bracket connective assemblage for joining together said first and second pivot brackets.

6. The portable multi-hinged shelter as set forth in claim 2, further comprising a pair of bottom panels removably attached to said lower wind wall with each having a common interior edge fitted with a hook-and-loop fastener for temporarily connecting together said bottom panels.

7. The portable multi-hinged shelter as set forth in claim 1, wherein said protective shell assembly comprises a primary shelter shell adaptively fitting to and substantially covering said moveable frame assembly and said supportive wind wall and a secondary shelter shell adaptively fitting to and substantially covering said box frame.

8. The portable multi-hinged shelter as set forth in claim 7, wherein said secondary canopy comprises a cross support having ends and a pair of sideward members each having a first end connecting to one of said ends of the cross support and a second end pivotally connecting to one of said sideward arms.

9. The portable multi-hinged shelter as set forth in claim 7, wherein said primary shelter shell comprises a pair of side panels each having a common perimeter edge and a top-rearward panel having a pair of common sideward edges individually connecting to and along said common perimeter edge of one of the side panels.

10. The portable multi-hinged shelter as set forth in claim 9, wherein said primary shelter shell further comprises an integral assembly of flaps extending outwardly from and connecting to each of said side panels and said top-rearward panel for covering and enclosing said primary shelter shell while said moveable frame assembly attains a state of compactness for storage and transport.

11. The portable multi-hinged shelter as set forth in claim 9, wherein each of said side panels comprises an integrated door for gaining access into said primary shelter shell while said moveable frame assembly attains a state of expansion.

12. The portable multi-hinged shelter as set forth in claim 7, wherein said secondary shelter shell comprises a frontal-top-rearward panel having a pair of common sideward edges and a pair of box side panels each having a pair of sideward edges and an upper perimeter collectively attached to and along one of said common sideward edges of the frontal-top-rearward panel.

13. The portable multi-hinged shelter as set forth in claim 1, further comprising a first pair of linear actuators connectively spanning from said supportive wind wall to said sideward arms, a second pair of linear actuators connectively spanning from said sideward arms to said primary canopy, and a third pair of linear actuators connectively spanning from said primary canopy to said ground brace, whereby synchronized operation of said linear actuators fulfills expansion and contraction of said moveable frame assembly respectively for occupancy and compact transport alongside the vehicle.

14. The portable multi-hinged shelter as set forth in claim 13, further comprising a power source, a predetermined number of switches communicatively coupled to said power source, and a motor controller having inputs communicatively coupled to said switches and outputs communicatively coupled to said first, second and third pairs of linear actuators, whereby selectively activating said switches operably powers said linear actuators to correspondingly move said sideward arms, said primary canopy, and said ground brace inwardly toward or outwardly from said supportive wind wall to respectively attain contraction or expansion of said moveable frame assembly.

15. The portable multi-hinged shelter as set forth in claim 1, wherein said box frame comprises upper horizontal members, lower horizontal members and corner posts, each of said corner posts having a first end supporting and connecting to one or more of said upper horizontal members and a second end connecting to one or more of said lower horizontal members.

16. The portable multi-hinged shelter as set forth in claim 15, further comprising a plurality of alignment plates for aligning said box frame relatively about the open cargo bay, each of said alignment plates having a top planar element engaging and attaching to said lower horizontal member and a sideward planar element integrally connecting to said top planar element and engaging one of the sidewalls of the open cargo bay.

17. The portable multi-hinged shelter as set forth in claim 16, further comprising a plurality of turnbuckles for securing said box frame to the open cargo bay, each of said turnbuckles having a pair of ends with one end thereof engaging and attaching to said lower horizontal member and the other end thereof engaging and attaching to a bottom surface of the open cargo bay.

18. The portable multi-hinged shelter as set forth in claim 15, wherein said box frame further comprises a pair of vertically orientated intermediate members each having ends respectively connecting to said upper and lower horizontal members, a pair of shelf supports each having ends respectively connecting to said corner post and said vertically orientated intermediate member, and a shelf platform situated atop of and mounted to said shelf supports.

19. The portable multi-hinged shelter as set forth in claim 1, wherein said supportive wind wall comprises a pair of upper outward members each having a first end and a second end, a pair of lower outward members each having a first end and a second end, a pair of upright supports each having a top end and a bottom end respectively connecting to said first ends of the upper and lower outward members, a lower support member having a pair of ends connecting to said second ends of the lower outward members, and a pair of inward supports connecting to and extending outwardly from each of said upright supports.

20. The portable multi-hinged shelter as set forth in claim 19, wherein said inward supports engage with and connect to said corner posts substantially positioned rearward of the open cargo bay to advance connection of said supportive wind wall with that of said box frame.

21. The portable multi-hinged shelter as set forth in claim 19, wherein said primary canopy comprises a pair of shortened arms, a cross member having ends, and a pair of sideward members each having a first end connecting to one of said ends of the cross member and a second end connecting to one of said shortened arms relatively midway along thereof.

22. The portable multi-hinged shelter as set forth in claim 21, wherein said ground brace comprises a cross member having ends and a pair of sideward supports each having a first end pivotally connecting to one of said shortened arms and a second end connecting to one of said ends of the cross member.

23. The portable multi-hinged shelter as set forth in claim 22, further comprising end-mounted pivot bracket assemblies each mountably connecting said sideward arms individually to one of said upper outward members of the supportive wind wall, said sideward arms individually to one of said shortened arms of the primary canopy, and said shortened arms individually to one of said sideward supports of the ground brace.

24. The portable multi-hinged shelter as set forth in claim 23, wherein said end-mounted pivot bracket assembly comprises a first pivot bracket, a second pivot bracket, and a bracket connective assemblage for joining together said first and second pivot brackets.

25. A portable multi-hinged shelter for attachment to a vehicle having an open cargo bay formed by sidewalls, said multi-hinged shelter comprising, in combination:

a box frame adaptively mounting atop of and connecting to the open cargo bay;

a supportive wind wall adaptively attaching to said box frame and being substantially positioned rearward of the vehicle;

a moveable frame assembly having a pair of sideward arms each having a first end pivotally connecting to said supportive wind wall and a second end, a primary canopy pivotally connecting to said second ends of the sideward arms, a secondary canopy pivotally connecting to said sideward arms relatively midway along thereof, and a ground brace pivotally connecting to said primary canopy;

a protective shell assembly adaptively fitting to and substantially covering said moveable frame assembly, said supportive wind wall, and said box frame;

a first pair of linear actuators connectively spanning from said supportive wind wall to said sideward arms;

a second pair of linear actuators connectively spanning from said sideward arms to said primary canopy; and a third pair of linear actuators connectively spanning from said primary canopy to said ground brace, whereby synchronized operation of said linear actuators fulfills expansion and contraction of said moveable frame assembly respectively for occupancy and compact transport alongside the vehicle.

26. The portable multi-hinged shelter as set forth in claim 25, further comprising a lower wind wall pivotally connecting to said supportive wind wall.

27. The portable multi-hinged shelter as set forth in claim 26, wherein said primary canopy comprises a pair of shortened arms, a cross member having ends, and a pair of sideward members each having a first end connecting to one of said ends of the cross member and a second end connecting to one of said shortened arms relatively midway along thereof, said secondary canopy comprises a cross support having ends and a pair of sideward members each having a first end connecting to one of said ends of the cross support and a second end pivotally connecting to one of said sideward arms, and said ground brace comprises a cross member having ends and a pair of sideward supports each having a first end pivotally connecting to one of said shortened arms and a second end connecting to one of said ends of the cross member.

28. The portable multi-hinged shelter as set forth in claim 27, further comprising a power source, a predetermined number of switches communicatively coupled to said power source, and a motor controller having inputs communicatively coupled to said switches and outputs communicatively coupled to said first, second and third pairs of linear actuators, whereby selectively activating said switches operably powers said linear actuators to correspondingly move said sideward arms, said primary canopy, and said ground brace inwardly toward or outwardly from said supportive wind wall to respectively attain contraction or expansion of said moveable frame assembly.

29. A portable multi-hinged shelter for attachment to a vehicle having an open cargo bay formed by sidewalls, said multi-hinged shelter comprising, in combination:

a box frame adaptively mounting atop of and connecting to the open cargo bay;

a supportive wind wall adaptively attaching to said box frame and being substantially positioned rearward of the vehicle;

a moveable frame assembly having a pair of sideward arms each having a first end pivotally connecting to said supportive wind wall and a second end, a primary canopy pivotally connecting to said second ends of the sideward arms, a secondary canopy pivotally connecting to said sideward arms relatively midway along thereof, and a ground brace pivotally connecting to said primary canopy;

a lower wind wall pivotally connecting to said supportive wind wall;

a primary shelter shell adaptively fitting to and substantially covering said moveable frame assembly and said supportive wind wall;

a secondary shelter shell adaptively fitting to and substantially covering said box frame;

a first pair of linear actuators connectively spanning from said supportive wind wall to said sideward arms;

a second pair of linear actuators connectively spanning from said sideward arms to said primary canopy; and a third pair of linear actuators connectively spanning from said primary canopy to said ground brace, whereby synchronized operation of said linear actuators fulfills expansion and contraction of said moveable frame assembly respectively for occupancy and compact transport alongside the vehicle.

30. The portable multi-hinged shelter as set forth in claim 29, further comprising a power source, a predetermined number of switches communicatively coupled to said power source, and a motor controller having inputs communicatively coupled to said switches and outputs communicatively coupled to said first, second and third pairs of linear actuators, whereby selectively activating said switches operably powers said linear actuators to correspondingly move said sideward arms, said primary canopy, and said ground brace inwardly toward or outwardly from said supportive wind wall to respectively attain contraction or expansion of said moveable frame assembly.

* * * * *